US008347785B2

(12) United States Patent
Bernard et al.

(10) Patent No.: US 8,347,785 B2
(45) Date of Patent: Jan. 8, 2013

(54) WEB OFFSET PRESS AS WELL AS METHOD FOR OPERATING THE WEB OFFSET PRESS

(75) Inventors: Andreas Ewald Heinrich Bernard, Sulzfeld (DE); Klaus Ludwig Christmann, Worms (DE); Burkard Otto Herbert, Würzburg (DE); Bernd Ulrich Herbert Keller, Veitshöchheim (DE); Erwin Paul Josef Lehrieder, Gaukönigshofen (DE); Klaus Walter Röder, Würzburg (DE); Karl Robert Schäfer, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 118 days.

(21) Appl. No.: 12/736,972

(22) PCT Filed: May 27, 2009

(86) PCT No.: PCT/EP2009/056461

§ 371 (c)(1),
(2), (4) Date: Feb. 9, 2011

(87) PCT Pub. No.: WO2009/150054

PCT Pub. Date: Dec. 17, 2009

(65) Prior Publication Data

US 2011/0132215 A1 Jun. 9, 2011

(30) Foreign Application Priority Data

May 28, 2008 (DE) ..... 10 2008 002 056
May 28, 2008 (DE) ..... 10 2008 002 058

(51) Int. Cl.
*B41F 7/02* (2006.01)

(52) U.S. Cl. ..... 101/217; 101/227; 270/21.1

(58) Field of Classification Search ..... 101/226, 101/227, 217, 219; 270/4, 5.01, 6, 8, 5.02, 270/5.03, 20.1, 21.1
See application file for complete search history.

(56) References Cited

U.S. PATENT DOCUMENTS

| | | | | |
|---|---|---|---|---|
| 5,362,008 | A * | 11/1994 | Nagel et al. | 242/417 |
| 5,676,056 | A * | 10/1997 | Stein et al. | 101/226 |
| 7,707,934 | B2 | 5/2010 | Herbert et al. | |
| 7,765,925 | B2 | 8/2010 | Eckert et al. | |
| 2006/0130683 | A1 | 6/2006 | Behmel et al. | |
| 2007/0095225 | A1 * | 5/2007 | Bernard et al. | 101/217 |
| 2007/0234911 | A1 * | 10/2007 | Schafer et al. | 101/177 |

(Continued)

FOREIGN PATENT DOCUMENTS

DE 10 2004 043 681 A1 3/2006

(Continued)

*Primary Examiner* — Ren Yan
(74) *Attorney, Agent, or Firm* — Mattingly & Malur, P.C.

(57) ABSTRACT

A web offset press includes several printing units through which a web passes essentially in a horizontal direction. The printed web then passes to at least one first folding unit. Each of the printing units has at least one plate cylinder and one transfer cylinder which interacts with the web being printed. An effective plate width of the plate cylinder corresponds to the print image of at least eight upright or prone printed pages in a BIN 4A format. The printed web is slit longitudinally into a plurality of web strands: A first number of these web strands are supplied to the first folding apparatus. At the same time, a second number of web strands, produced by the slitting of the same web, are supplied to a second folding apparatus for further processing.

23 Claims, 35 Drawing Sheets

U.S. PATENT DOCUMENTS

| | | | | |
|---|---|---|---|---|
| 2007/0289461 | A1 | 12/2007 | Bernard et al. | |
| 2008/0257182 | A1 * | 10/2008 | Eckert et al. | 101/227 |
| 2009/0064883 | A1 | 3/2009 | Eckert et al. | |
| 2009/0107352 | A1 | 4/2009 | Eckert et al. | |
| 2009/0134265 | A1 * | 5/2009 | Deininger | 242/560.1 |

FOREIGN PATENT DOCUMENTS

| | | | |
|---|---|---|---|
| EP | 257390 | A1 * | 3/1988 |
| EP | 1 671 787 | A1 | 6/2006 |
| EP | 1 688 251 | A2 | 8/2006 |
| EP | 1 742 796 | A | 1/2007 |
| EP | 1 908 588 | A2 | 4/2008 |
| WO | 2005/105445 | A1 | 11/2005 |
| WO | 2005/105447 | A1 | 11/2005 |
| WO | 2005/108262 | A1 | 11/2005 |
| WO | 2006/111521 | A1 | 10/2006 |
| WO | 2007/020288 | A1 | 2/2007 |
| WO | 2008/015152 | A2 | 2/2008 |

* cited by examiner 100.2

Fig. 18

| Table 1 Vertical Pages | | | Format Overview of Vertical Pages | | | | | | | | |
|---|---|---|---|---|---|---|---|---|---|---|---|
| Page Width mm | Trim Allowance mm | Web Edge mm | Ribbons in Folder / Signatures | Web Width mm | Rounded | 1 | 2 | 3 | 4 | 5 | x circumference |
| 210 | 4 | 2.5 | 4 | 861 | 860 | 16 | 32 | 48 | 64 | 80 | VERTICAL Pages |
| | | | 5 | 1075 | 1075 | 20 | 40 | 60 | 80 | 100 | |
| | | | 6 | 1289 | 1290 | 24 | 48 | 72 | 96 | 120 | |
| | | | 7 | 1503 | 1505 | 28 | 56 | 84 | 112 | 140 | |
| | | | 8 | 1717 | 1720 | 32 | 64 | 96 | 128 | 160 | |
| | | | 9 | 1931 | 1930 | 36 | 72 | 108 | 144 | 180 | |
| | | | 10 | 2145 | 2145 | 40 | 80 | 120 | 160 | 200 | |
| | | | 11 | 2359 | 2360 | 44 | 88 | 132 | 176 | 220 | |
| | | | 12 | 2573 | 2575 | 48 | 96 | 144 | 192 | 240 | |
| | | | 13 | 2787 | 2790 | 52 | 104 | 156 | 208 | 260 | |
| | | | 14 | 3001 | 3000 | 56 | 112 | 168 | 224 | 280 | |
| Page Height mm | Trim Allowance mm | Allowance for Copies | | | | 619.5 | 1239 | 1858.5 | 2478 | 3097.5 | Circumference mm |
| | | | | | | 620 | 1240 | 1860 | 2480 | 3100 | Rounded |
| 297 | 8 | 9.5 | | | | 2 | 4 | 6 | 8 | 10 | Copies on Circumference |

| Table 2 Horizontal Pages | | | Format Overview of Horizontal Pages | | | | | | | | |
|---|---|---|---|---|---|---|---|---|---|---|---|
| Page Width mm | Trim Allowance mm | Web Edge mm | Ribbons in Folder / Signatures | Web Width mm | Rounded | 1 | 2 | 3 | 4 | 5 | x circumference |
| 297 | 4 | 2.5 | 4 | 1209 | 1210 | 16 | 32 | 48 | 64 | 80 | HORIZONTAL Pages |
| | | | 5 | 1510 | 1510 | 20 | 40 | 60 | 80 | 100 | |
| | | | 6 | 1811 | 1810 | 24 | 48 | 72 | 96 | 120 | |
| | | | 7 | 2112 | 2110 | 28 | 56 | 84 | 112 | 140 | |
| | | | 8 | 2413 | 2415 | 32 | 64 | 96 | 128 | 160 | |
| | | | 9 | 2714 | 2715 | 36 | 72 | 108 | 144 | 180 | |
| | | | 10 | 3015 | 3015 | 40 | 80 | 120 | 160 | 200 | |
| Page Height mm | Trim Allowance mm | Allowance for Copies | | | | 445.5 | 891 | 1336.5 | 1782 | 2227.5 | Circumference mm |
| | | | | | | 445 | 890 | 1340 | 1780 | 2230 | Rounded |
| 210 | 8 | 9.5 | | | | 2 | 4 | 6 | 8 | 10 | Copies on Circumference |

| y | Folder 1 | | | |
|---|---|---|---|---|
| Ribbons Superstructure | A4> | A4>> | A3/T/Tabloid> | A3/T/Tabloid>> |
| 6 | 2 x 48 | 96 | 2 x 24 | 48 |
| | | | | |
| 5 | 2 x 40 | 80 | 2 x 20 | 40 |
| 5 | 2 x 40 | 80 | 2 x 20 | 40 |
| | | | | |
| 4 | 2 x 32 | 64 | 2 x 16 | 32 |
| 4 | 2 x 32 | 64 | 2 x 16 | 32 |
| | | | | |
| 3 | 2 x 24 | 48 | 2 x 12 | 24 |
| 3 | 2 x 24 | 48 | 2 x 12 | 24 |
| 3 | 2 x 24 | 48 | 2 x 12 | 24 |
| | | | | |
| 2 | 2 x 16 | 32 | 2 x 8 | 16 |
| 2 | 2 x 16 | 32 | 2 x 8 | 16 |
| 2 | 2 x 16 | 32 | 2 x 8 | 16 |
| | | | | |
| 5.5 | 2 x 44 | 88 | | |
| 5.5 | 2 x 44 | 88 | | |
| | | | | |
| 4.5 | 2 x 36 | 72 | | |
| 4.5 | 2 x 36 | 72 | | |
| | | | | |
| 3.5 | 2 x 28 | 56 | | |
| 3.5 | 2 x 28 | 56 | | |
| 3.5 | 2 x 28 | 56 | | |
| | | | | |
| 2.5 | 2 x 20 | 40 | | |
| 2.5 | 2 x 20 | 40 | | |
| 2.5 | 2 x 20 | 40 | | |
| | | | | |

Page numbers optionally exchangeable

| z | Folder 2 | | | |
|---|---|---|---|---|
| Ribbons Superstructure | S1/h> | S1/h>>> | S2/v/Tabloid> | S2/v/Tabloid>>> |
| 0 | 0 | 0 | 0 | 0 |
| | | | | |
| 1 | 3 x 4 | 12 | 3 x 2 | 6 |
| 2 | 3 x 8 | 24 | 3 x 4 | 12 |
| | | | | |
| 2 | 3 x 8 | 24 | 3 x 4 | 12 |
| 3 | 3 x 12 | 36 | 3 x 6 | 18 |
| | | | | |
| 3 | 3 x 12 | 36 | 3 x 6 | 18 |
| 4 | 3 x 16 | 48 | 3 x 8 | 24 |
| 5 | 3 x 20 | 60 | 3 x 10 | 30 |
| | | | | |
| 4 | 3 x 16 | 48 | 3 x 8 | 24 |
| 5 | 3 x 20 | 60 | 3 x 10 | 30 |
| 6 | 3 x 24 | 72 | 3 x 12 | 36 |
| | | | | |
| 0 | 0 | 0 | 0 | 0 |
| 1 | 3 x 4 | 12 | 3 x 2 | 6 |
| | | | | |
| 1 | 3 x 4 | 12 | 3 x 2 | 6 |
| 2 | 3 x 8 | 24 | 3 x 4 | 12 |
| | | | | |
| 2 | 3 x 8 | 24 | 3 x 4 | 12 |
| 3 | 3 x 12 | 36 | 3 x 6 | 18 |
| 4 | 3 x 16 | 48 | 3 x 8 | 24 |
| | | | | |
| 3 | 3 x 12 | 36 | 3 x 6 | 18 |
| 4 | 3 x 16 | 48 | 3 x 8 | 24 |
| 5 | 3 x 20 | 60 | 3 x 10 | 30 |
| | | | | |

WEB OFFSET PRESS AS WELL AS METHOD FOR OPERATING THE WEB OFFSET PRESS

CROSS-REFERENCE TO RELATED APPLICATIONS

This application is the U.S. national phase, under 35 U.S.C. 371, of PCT/EP2009/056461, filed May 27, 2009; published as WO 2009/150054 A1 on Dec. 17, 2009, and claiming priority to DE 10 2008 002 058.3, filed May 28, 2008, and to DE 10 2008 002 056.7, filed May 28, 2008, the disclosures of which are expressly incorporated herein by reference.

FIELD OF THE INVENTION

The present invention is directed to a web-fed offset printing press and to a method for operating the web-fed offset printing press. The press utilizes a plurality of I-type printing units positioned as blanket-blanket printing units. A web passes through these printing units in a horizontal direction. Each of the printing units has at least one forme cylinder and one transfer cylinder that interacts with the web. An effective cylinder width of the forme cylinder corresponds to the printing images of at least 8 vertical or horizontal pages in DIN A4 format.

BACKGROUND OF THE INVENTION

DE 10 2004 043 681 A1 discloses a commercial printing press which is comprised of a reel stand, an infeed unit, multiple I-type printing units, optionally a coating unit, a dryer, a cooling unit, a superstructure and a folding unit. This press is capable of imprinting webs with four printed pages, arranged side by side, such as, for example, four printed pages in DIN A4, with a maximum width of 1,000 mm.

WO 2005/108262 A1 discloses a printing system having two commercial printing press lines which are arranged in parallel. A web can be imprinted in a variable cut length by the use of printing units that use exchangeable modules comprising printing couple cylinders having different circumferences of between 1,100 mm and 1,500 mm, and can be processed in a folding unit with a variable cut length. In this case, a length of the forme cylinder is equal to at least six, and preferably is equal to eight, DIN A4 pages. In various embodiments, the printing system can be assigned an asymmetrical superstructure system, a symmetrical superstructure system, or a superstructure system which is embodied as a former superstructure, with small- and large-format folding units. A wide range of products can be produced by combining formers and turner bars in the superstructure systems and folding units, with differing variability and production with four, six, or eight pages in circumference.

WO 2005/105447 discloses a newspaper printing press, in which two printing formes, each three pages in width, are provided side by side on one forme cylinder that is six newspaper pages in width. To produce special tabloid products, for example, the printing formes can have formats of different printed page widths, side by side.

WO 2006/111521 A1 discloses a newspaper printing press with printing towers. In this device, webs are turned 90° over web-width turner bars and are directed to a former structure having multiple fold formers side by side. The ribbons which are coming from the fold formers are fed to a shared folding unit which is located downstream of the printing towers, for further processing.

WO 2007/020288 discloses a printing press system comprising a first newspaper printing press and a second printing press. Webs from the first and from the second printing press can be fed together to a former structure. In one of several possible embodiments, the second printing press can also be embodied as a commercial printing press. In this case, the folder of the newspaper printing press can have one or two folding units.

SUMMARY OF THE INVENTION

The problem which is addressed by the present invention is that of providing a web-fed offset printing press for large numbers of pages, which printing press is highly variable and efficient while maintaining print quality, along with a method for operating said press.

The problem is solved, in accordance with according the present invention by the provision of a printing press with a plurality of I-type printing units that are configured as blanket-to-blanket printing units through which a web passes essentially in a horizontal direction. The press includes at least two folding units for providing cross folds in the printed products. Each printing unit has at least one forme cylinder and one transfer cylinder that interacts with the web. An effective width of the forme cylinder corresponds to the printing images of at least 8 vertical or horizontal pages in DIN A4 format. A first number of web ribbons, formed by slitting the web, are fed to the first folding unit. At the same time, a second number of second web ribbons are fed to the second folding unit to form a cross fold.

Commercial printing presses are characterized, in relation to traditional newspaper printing presses, for example, by demonstrating relatively higher standards of quality in the printed product that they produce. This higher quality of the printed products is ensured by a number of technical differences. However, these high standards of quality are not compatible with an enlargement of the presses. The result is that products having large numbers of pages are usually produced on several press lines. The commercial printing press, which will be described in what follows, makes it possible to substantially increase output while still maintaining higher standards of quality.

A commercial web-fed rotary printing press in oversized format, with variable production of intermediate and final printed products is provided by the present invention. This printing press can nevertheless be operated cost-effectively for use in printing smaller product thicknesses.

The present invention relates to a commercial web-fed rotary printing press or to a web-fed rotary printing system with, for example, 1 to i, with i being preferably 2, and optionally 3 to 5 reel stands with infeed units, which infeed units may be located separately, but which preferably are integrated into the reel stand. The press in accordance with the present invention imprints 1 to i paper webs of a large web width or of a maximum web width which is greater than 2,000 mm, and which is preferably at least 2,500 mm, or which, at least, corresponds to the width of 8 horizontal or 12 vertical DIN A4 pages in, for example, 1 to m printing couple paths for one web-fed rotary printing system m, preferably 2. Each printing couple path has 1 to p, with p being a maximum of 4, and preferably $2<p<6$ printing units m, such as, for example, I-type printing units, each comprising two printing couples lying one above the other, and between which the paper web will be fed and imprinted. There is further provided one web catching and severing device for each paper web and/or for each printing couple path, and which is usable for preventing wrap-arounds in the case of web breaks. One drying system, for example, is also provided for each paper web and/or printing couple path. Generally, 1 dryer is provided per web, but also may operate with 2 to 4 webs passed through and being dried by one dryer. A subsequent cooling of the web may be accommodated by, for example, one cooling roller group per web; and, if applicable, these may be provided the option of re-dampening with or without the application of silicone. A multifunctional superstructure, in which the 1–i webs are cut lengthwise into 2 to r. Wherein r>=8, and preferably is 10 or 12, but is fewer than 30, preferably evenly numbered ribbons or partial webs is provided. Individual and/or multiples of these ribbons or partial webs are turned, on the basis of product requirements, and are guided onto or between other ribbons or partial webs or are combined with such other ribbons or partial webs. Perforations can be optionally produced, with various spacings, in the lengthwise or crosswise direction, and glue lines can be applied, optionally timed in the longitudinal direction or continuously.

In one embodiment of the present invention, the assembled and prepared ribbons or partial webs of the at least one printing couple path are fed over 1 to q fold formers, with q being preferably 1, most frequently 2, but also possibly being 3 or 4, and up to 8 fold formers and/or over 1 to v with v being preferably at least r turner bars with corresponding register units into one folding unit system. The folding unit system consists, for example, of 1 to m fixed format and/or variable format pin/jaw/belt/rotary folding unit apparatuses, which may be situated separately side by side or which may be situated in one apparatus comprising 1 to 4 cross-cutting and folding units, so as to not collect the cut-off units, or to collect the cut-off units multiple times, preferably 2 times, to fold them crosswise, to split them to 1 to 2 or even 3 to 4 deliveries, and then, in one advantageous embodiment, to fold them again and to then pass them on for further processing.

In another embodiment of the present invention, the assembled and prepared ribbons or partial webs of the at least one printing couple path are fed to a cross cutter or cutter, which then cuts the individual products crosswise to the direction of web travel, and passes these on for further processing. This enables the production of intermediate or of final printed products having page numbers between 2, such as, for example, for poster/advertisement printing and 392, such as, for example, for small format books, journals, magazines and the like.

Additional processing options may be used in the web paths. They may be, for example, a UV printing and coating unit with a dryer and/or with a longitudinal/web edge trimmer and/or a double-gate fold or plough fold device or devices.

BRIEF DESCRIPTION OF THE DRAWINGS

A preferred embodiment of the present invention is depicted in the set of drawings and will be specified in greater detail in what follows.

The drawings show:

FIG. 18 tables listing embodiments of a forme cylinder body in connection with printing page loading configurations;

DESCRIPTION OF THE PREFERRED EMBODIMENT

Figure 1:
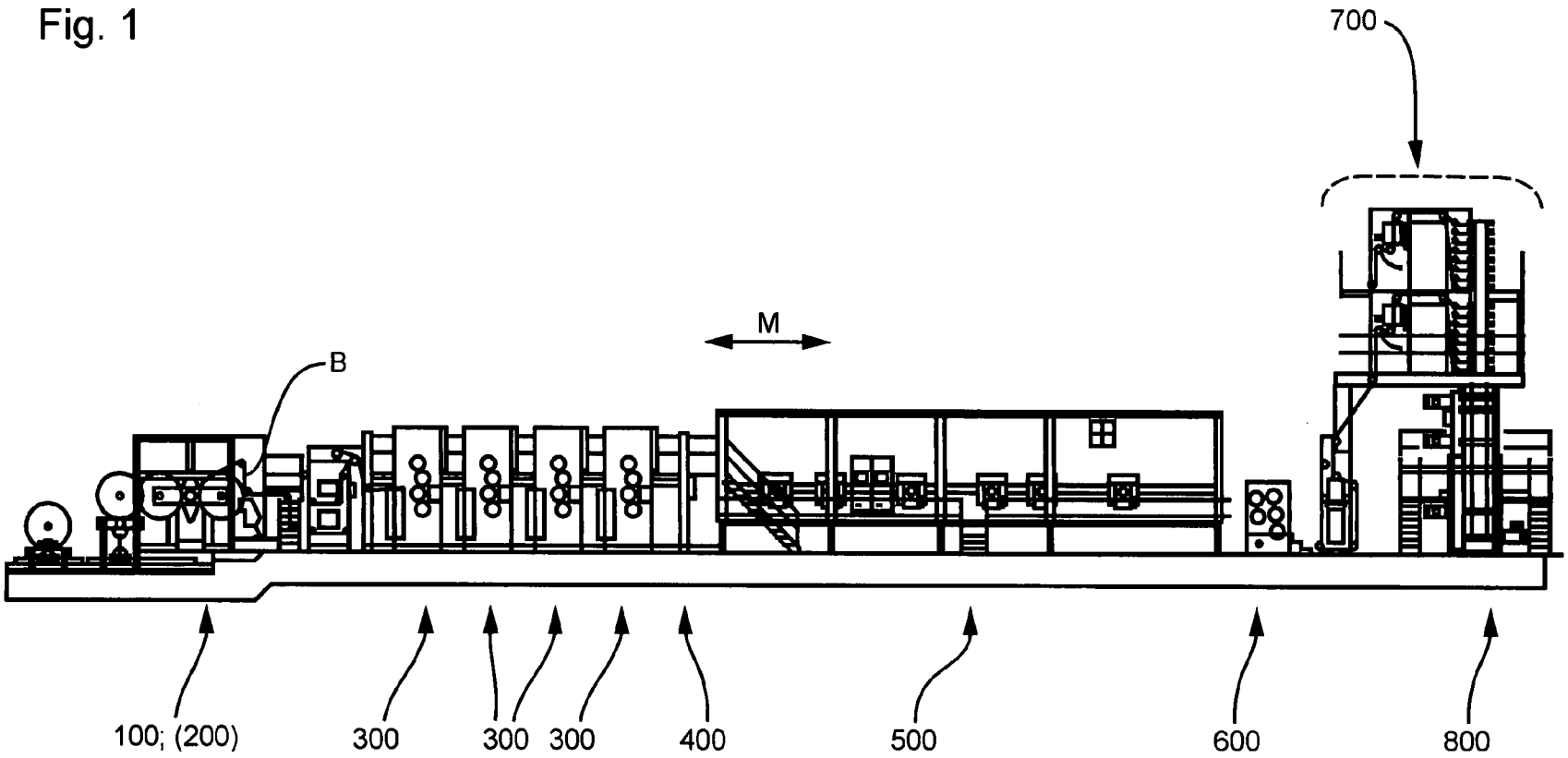
FIG. 1 a schematic side elevation view of a printing press with one printing couple line.

Referring initially to FIG. 1, there may be seen a web processing and/or finishing machine, such as, for example, a printing press, and particularly a web-fed rotary printing press which is embodied as a web-fed offset printing press, and which is usable for imprinting one or more webs B. Such a web processing machine has a plurality of units 100; 200; 300; 400; 500; 600; 700; 800 for supplying a web B of material to be printed, for imprinting the web, and for further processing the web, all as seen in FIG. 1. The web B, and particularly a paper web B, that is to be imprinted is wound off a reel stand 100, and particularly is wound off a reel changer 100, before being fed by an infeed unit 200 to one or more printing units 300. In addition to printing units 300 that are routinely provided for multicolor printing, such as, for example, four units for four-color printing, additional printing units 300 may also be provided, which can then be used alternatingly with one or more of the other printing units 300, for example, for accomplishing a flying printing forme change.

In one advantageous embodiment, a coating unit 400 can be provided in the web path.

In one operating mode of the present invention, the web B preferably consists of a paper that is stronger and is more heavily coated than newsprint. For example, this web B may have a base weight of at least 60 g/m$^2$, particularly at least 70 g/m$^2$, and/or may have a coating weight of at least 5 g/m$^2$, and particularly may have a coating weight of at least 10 g/m$^2$. In another advantageous operating mode, such as, for example, for use in telephone book production, the web B consists of a paper which, for example, may be thinner than newsprint, and which preferably is uncoated paper. Such a web now has a base weight of 25 g/m$^2$ to 35 g/m$^2$, for example. The web to be printed passes essentially horizontally through the printing units 300.

Figure 24:
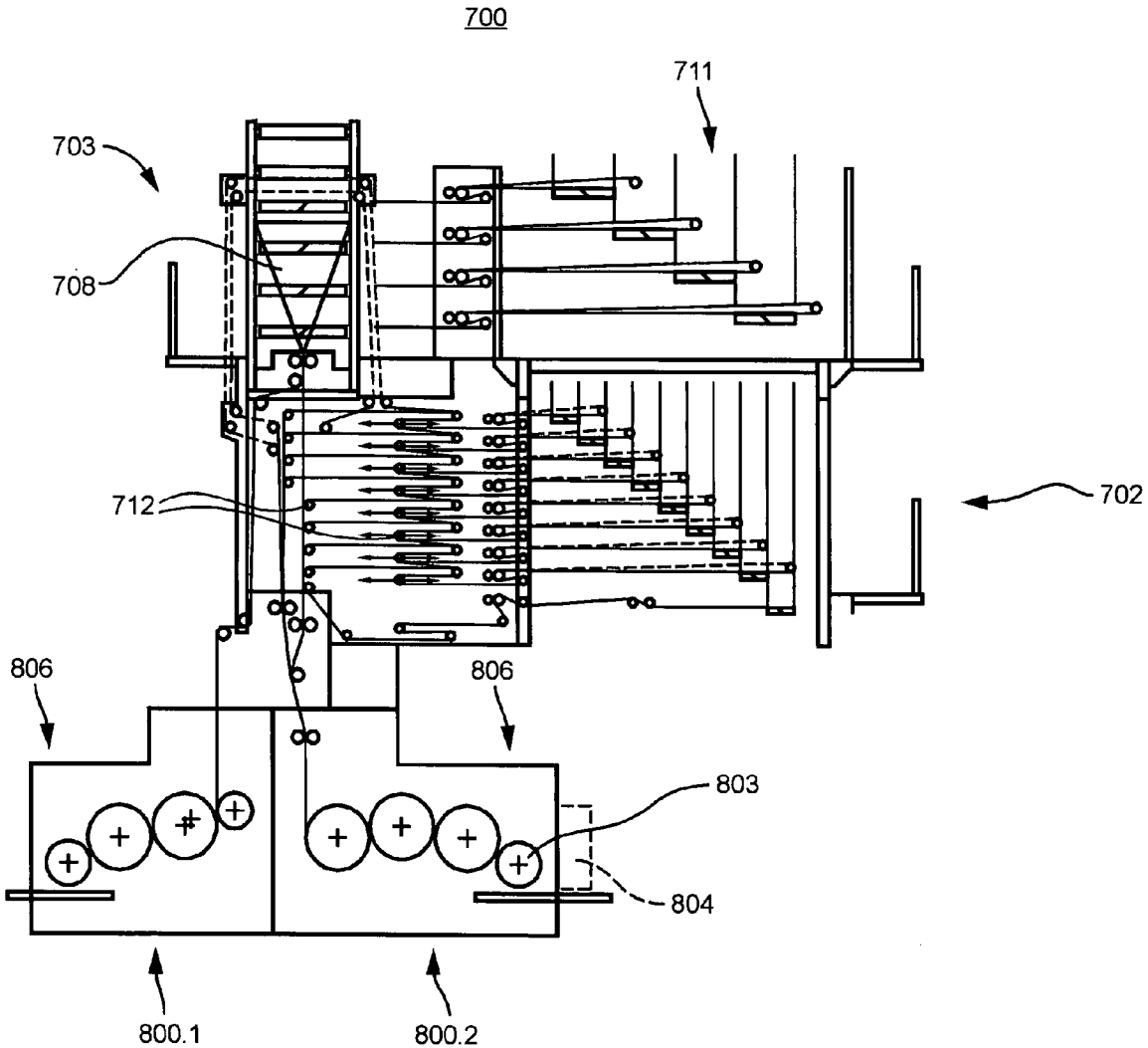
FIG. 24 yet a further embodiment of a superstructure with folding units.

After being imprinted and, if applicable, after also being coated, the web B passes through a dryer 500 and is then optionally recooled in a cooling unit 600. Such a cooling unit 600 is typically provided if drying of the web B was performed using thermal drying. Downstream of the dryer 500, in, or downstream of the cooling unit 600, at least one additional conditioning unit, which is not specifically shown in FIG. 1, and which may be, for example, a coating unit and/or a remoistening unit, can be provided. After it has undergone the appropriate the cooling and/or conditioning, the web B can be fed, by the use of a superstructure 700, to a folding unit 800. The superstructure 700 comprises, for example, at least one silicone unit, which is not specifically shown in FIG. 1, at least one slitter, and, in one embodiment, at least one or more turner units 711, with turner bars 712 that are traversed in pairs and which are usable to offset a number of partial webs, all as seen in FIG. 24. The superstructure 700 may also include a former unit 703 with one or more fold formers 708, or, in another embodiment, a group of individual turner bars 712, which corresponds at least to the number of partial webs to be produced. The silicone unit can also be arranged upstream of the superstructure 700, such as, for example, in the area of the cooling unit 600. The superstructure 700 can further include a perforating device, which is also not specifically shown in FIG. 1, a gluing unit, a counting unit and/or a plough folding unit. After passing through the superstructure 700, the web B or partial webs is/are fed to a folding unit 800.

In one embodiment of the present invention, the printing press also has a special cross-cutter, such as, for example, a so-called sheet delivery apparatus. In such a sheet delivery device, a web B that has not been guided through the folding unit 800, for example, can be cut into trimmed sheets and can optionally be stacked or delivered.

Figure 2:
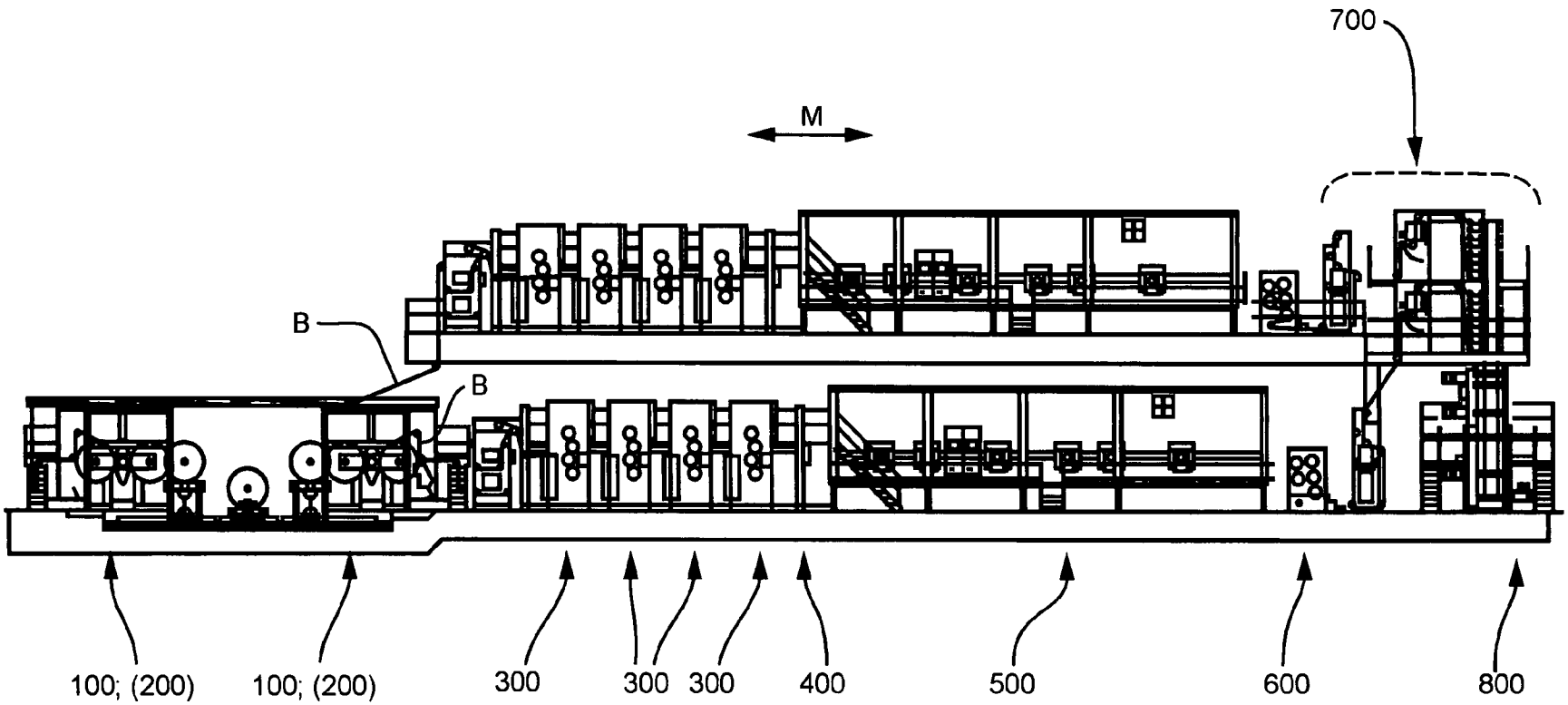
FIG. 2 a schematic side elevation view of a printing press system with two printing couple lines, one above the other.
Figure 3:
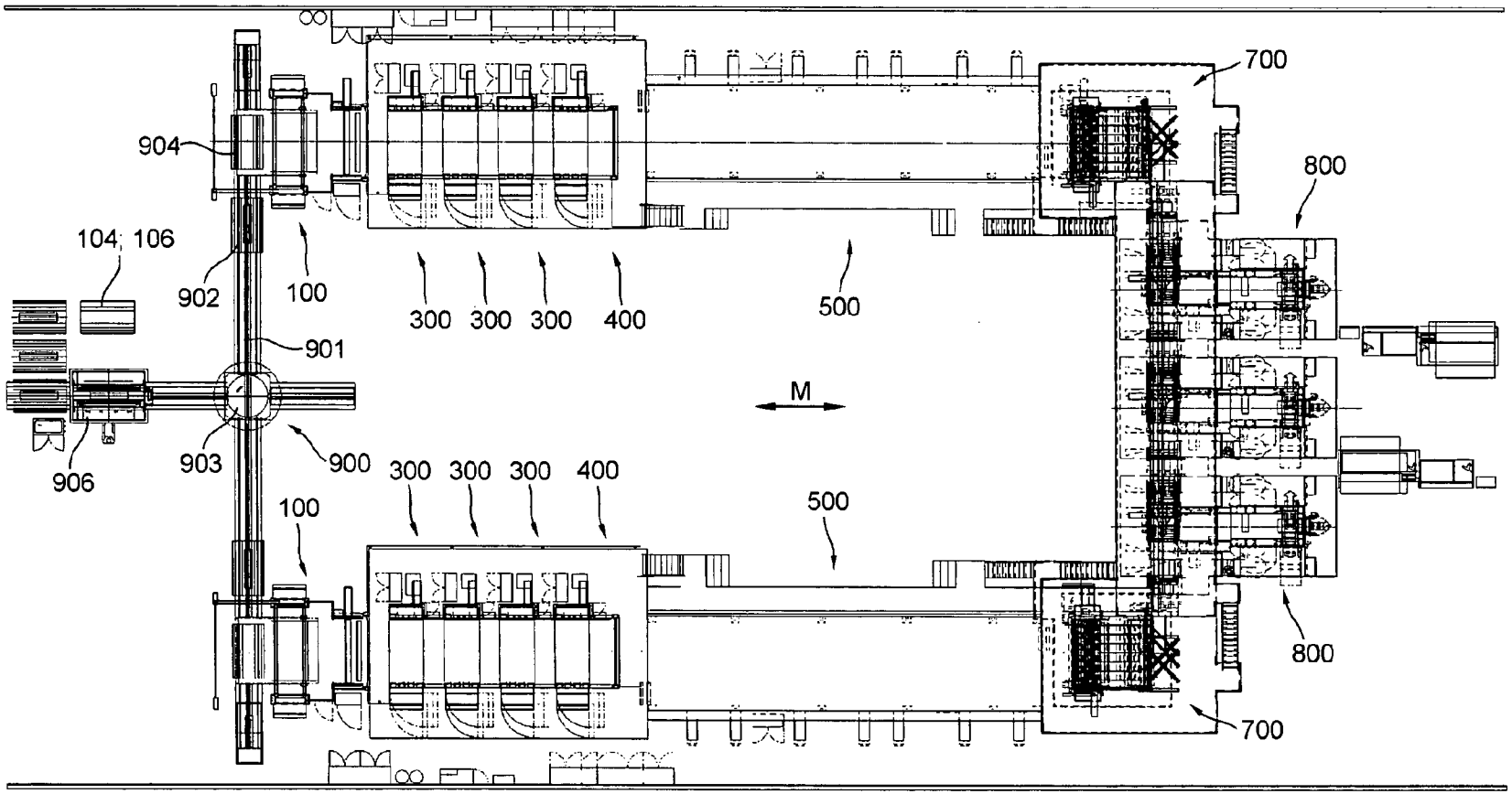
FIG. 3 a top plan view of a printing press system with two printing couple lines side by side.

FIG. 2 and FIG. 3 depict advantageous embodiments of a printing press or of a printing press system comprising two printing couple lines M or machine alignments M, each of which receives a web B from a reel changer 100. The imprinted webs B can be further processed, in a superstructure 700 and subsequently can be delivered to a folding unit 800 downstream thereof, separately into products, or, at least in part, into a combined product. In FIG. 2, the two depicted printing couple lines or machine alignments M are arranged in two planes lying one above the other vertically, and particularly are arranged one directly above the other. The two printing couple lines or machine alignments M, which are depicted in FIG. 3, are arranged side by side, and lie essentially within the same horizontal plane. In these cases, two folding units 800, along with guide elements, which accomplish the transfer of web ribbons from one of the printing couple lines M to optionally one or the other of the folding units 800, are preferably provided.

The various units 100; 200; 300; 400; 500; 600 of the printing press, which all interact with the still uncut web B, each have an effective width, transversely to the direction of transport of the web B, which effective width will permit the processing of webs B having a maximum width bB of, for example, at least 2,000 mm, and particularly having a maximum web width of at least 2,500 mm, and/or having a maximum web width bB that corresponds to the width of at least 8 horizontal or to the width of at least 12 vertical DIN A4 pages, side by side. The effective width, in this case, refers to the respective width or inside width of those components, such as, for example, roller, cylinder, feed-through, sensor system, adjustment paths, and the like, of the units 100; 200; 300; 400; 500; 600, which components interact directly or indirectly with the web B, in order for the web B to be processed, conditioned and advanced along its full width bB. Further, the units 100; 200; 300; 400; 500; 600 are embodied in terms of functionality, such as, for example, material infeed, web transport, sensor systems, further processing, and the like, such that even only partial-width webs B', having partial web widths down to a partial web width Bb' of only 450 mm, can be processed in the printing press.

The units 100; 200; 300; 400; 500; 600; 700; 800, that define or that process a print section having a width and a printing length "a", are embodied such that they define a printing length "a" of, for example, between 1,100 mm and 1,900 mm, and advantageously of between 1,200 mm and 1,900 mm, in a more slender embodiment, and especially a printing length "a" of approximately 1,240±5 mm or 1,340±5 mm, and, in a wider embodiment, of 1,780±5 mm or 1,860±5 mm, for each revolution of the cylinder 304, such as, for example, the printing couple cylinder 304, which carries the print master, on the web B. Advantageously, in a first preferred embodiment, printing length "a" is between 1,100 mm or, optionally is between 1,200 mm and 1,400 mm, and in the second embodiment, it is between 1,700 mm and 1,900 mm. In the first embodiment, the printing length "a" is routinely imprinted or is covered, in the longitudinal direction of the web B, or in the circumferential direction of the printing couple cylinder 304, with four vertical pages or with six horizontal printed pages, in, for example, a DIN A4 format, and/or is covered, in the transverse direction of the web B, with 12 vertical or with 8 horizontal printed pages in DIN A4 format and arranged side by side. In the thicker, second embodiment, the web B is routinely imprinted and/or is covered, in the longitudinal direction of the web B, or in the circumferential direction of the printing couple cylinder 304, for example, with 8 horizontal or with 6 vertical printed pages, for example, having a length "s", such as, for example, a DIN A4 format, and in the transverse direction of the web B, in the first variant, with 6 horizontal pages in the circumferential direction, for a total of 96 pages, front and back, or with 9 horizontal pages in the circumferential direction, for a total of 144 pages, front and back, horizontal printed pages side by side, and in the second variant with 8 pages, for a total of 96 pages. or with 12 pages for a total of 144 pages, as vertical printed pages in DIN A4 format. In a web B that is correspondingly narrower, by a multiple of the horizontal or the vertical DIN A4 format, than the maximum width bB, smaller numbers of pages, based upon the segmentation such as, for example, ¾ web, are imprinted onto a printing section. The latter represents the conditions, in a first operating situation, in which the printing couple cylinder 304, or the web B that is imprinted by the printing couple, is covered in a manner which is homogeneous with respect to format, such as, for example, with printed pages of the same format such as, for example, in format A, which may be, for example, DIN A4, and with the same orientation, either horizontal or vertical. The cylinders, printing couples and/or presses, which are embodied as having a cut length "a" and/or a circumference c304 of four DIN A4 pages, vertical or horizontal, are also referred to, for example, as cylinders, printing couples, and/or presses of double circumference, or as double-circumference presses. Accordingly, the cylinders, printing couples and/or presses, which are embodied as having a cut length "a" and/or a circumference c304 of 6 DIN A4 pages, vertical or horizontal, are also referred to, for example, as cylinders, printing couples, or presses of triple circumference, or as triple-circumference presses.

Depending upon the printing image and the subsequent further processing in the superstructure 700 and folding unit 800, however, other numbers of pages and/or other formats, or different formats and/or orientations for printing length "a" at the same time, are possible on the printing couple cylinder 304 which is embodied as forme cylinder 304.

Because of the heavy reel weights, which may be up to 7.5 t with a reel diameter of 60 inches, a partially or a fully automatic transport and/or handling system 900 for transporting and aligning the reels is provided. This is illustrated by way of example in FIG. 3. A transport path 901, such as, for example, a rail path 901 or a rail system 901, for a transport device 902, such as, for example, a transport carriage 902, is provided. The transport path 901 extends from a receiving station 906 to the reel changer 100, optionally through one or more turntables 903.

Because of the wide reel width, a centering device is provided for use in reel uploading, for example. One option for this centering device, for example, may involve hoisting, using support rollers, and/or an additional measurement, with axis correction of the reel core 116, for example, core 116, onto a transfer platform 904, which is merely suggested in FIG. 3. Advantageously, a transport carriage 902 or a transfer platform 904, which supports the reel 104; 106 prior to uploading, is embodied as being swivelable about a vertical axis, as depicted schematically by the curved double-headed arrow in FIG. 4. In a further development, the transport carriage or platform is even swivelable 180° about a vertical axis, to allow for correction of the wrap direction, such as, for example, of a reel 104; 106 that has been delivered in the wrong wrap direction, on the transfer platform 904 in the reel changer 100.

Additionally, in the reel supply area, such as, for example, in the rail system 901 with transport carriage 902, in addition to the rail path 901 coming from the warehouse area, additional branch rails, which may be arranged in a star pattern on the transfer platform 904, can be provided directly on the reel changer 100 as reel buffer positions.

Figure 4:
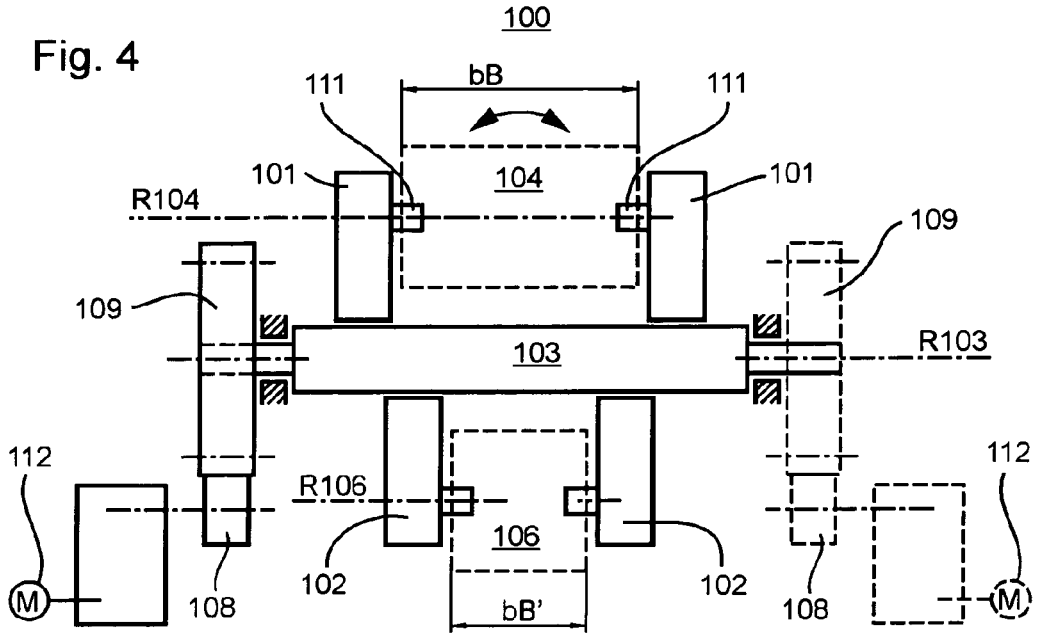
FIG. 4 a schematic illustration of a reel changer.

The reel stand 100 can be embodied as an idle reel changer with web storage. Advantageously, as shown in FIG. 4, the reel stand can be configured as a reel changer 100 for flying reel change.

In one embodiment of the present invention, which is advantageous in terms of uploading, it can be provided that the new reel 104; 106 is mounted on a transport carriage 902 that supports that reel, so as to be rotatable, such as, for example, flying. The transport carriage 902 serves, at the same time, as a support during unwinding, in that the reel 104; 106, or the journal or journals of the transport carriage 902, is coupled to a drive of the reel stand 100, and is then uncoupled again when unwinding is complete.

The reel stand 100, which may be embodied as a reel changer 100 for flying reel change has a plurality of pairs of support arms 101; 102. In the depiction of FIG. 4, there are shown two such pairs of support arms, which are mounted, in pairs, on a support 103, in parallel alignment with the rotational axis R104; R106 of a reel 104; 106 to be unwound, for example, and so as to be individually movable. The separated, individually movable support arms 101; 102 of each pair of support arms enable reels 104; 106 of different widths bB; bB' to be received simultaneously by the pairs of support arms 101 and 102, respectively. Axial movement of these support arms is effected, for example, by drive motors, which are not shown, and/or by spindle drives, which are also not shown. The support 103, which, overall, is embodied as having multiple sections, for example, is mounted to be swivelable about a center axis R103, which center axis R103 is parallel to the rotational axes R104; R106, by the operation of a motor, in a frame, which is also not shown here, or in frame walls on both sides. The two pairs of support arms 101; 102 are preferably arranged offset from one another circumferentially by 180° about the center axis R103. Cones 111, that serve to hold a reel core, can be rotationally driven, for example, via a belt drive by a drive motor, which is not specifically shown, either at one cone 111 for each pair of support arms 101; 102, or, in one advantageous embodiment, for both cones 111 for each pair. In the latter case, in one advantageous embodiment, the two drive motors which are assigned to a pair of cones 111 are driven in electronic synchronization. They are embodied as being controllable, at least with respect to their speed, and advantageously also with respect to their angular position. They preferably receive their speed and/or their angular position settings from a shared drive controller, such as, for example, from the same frequency converter.

In one advantageous further development, in the region of the reel changer 100 or between the reel changer 100 and a first printing unit 300, which is situated downstream from the reel changer 100, a web edge detector, which is not shown, for the trailing web B; B' is provided. The result is compared with a target value and, in the event of a deviation, the location of the web edge is corrected by axially moving the reel 104; 106 through movement of the corresponding pair of support arms 101; 102.

FIG. 4 shows an advantageous embodiment of the swivel drive of the support 103. The support 103 is swivelable on both sides of the reels 104; 106 by drive motors 112. In an advantageous embodiment, the two drive motors 112, which are assigned to the support 103 on both sides thereof, are driven in electronic synchronization. They are embodied as being controllable at least with respect to their speed, and advantageously also with respect to their angular position. They receive their speed and/or their angular position settings from a shared drive controller, such as, for example, from the same frequency converter.

In an advantageous embodiment of a swivel drive, that drive can be implemented by a transmission, such as, for example, by a toothed gear 109, which is non-rotatably connected to the axis of the support 103, and a pinion gear 108 of a drive motor 112 or an output of an intermediate transmission. In an embodiment which is not specifically illustrated here, the pinion gear 108, or the motor pinion gear, can also mesh with two intermediate gears, which, in turn, mesh with toothed gear 109 at two points on their circumferences.

Figure 6:
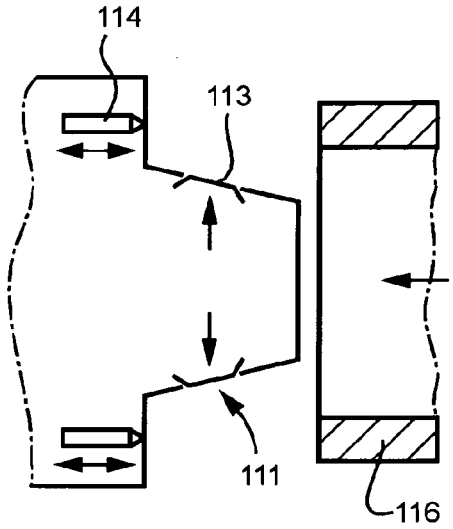
FIG. 6 a schematic illustration of a reel changer cone.

In one embodiment, which is also advantageous with respect to reel weight, the cones 111, in addition to the provision of their customary clamping mechanisms of radially acting, for example, of spring-mounted, clamping elements 113, can also have axially movable drivers 114, for example, in the manner of mandrels 114. Such mandrels, when activated, engage into the end face of the core 116 that supports the paper, thereby producing a positive connection which acts in a circumferential direction, as seen in FIG. 6.

Figure 5:
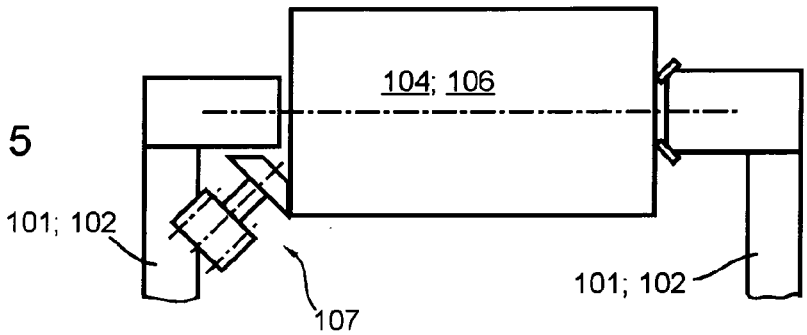
FIG. 5 a schematic illustration of a reel changer brake.

It is also advantageous, either alone or in combination with one or more of the aforementioned measures, for a brake 107 to be provided. Such a brake can be engaged against the end face of the reel 104; 106 as needed, such as, for example, for accomplishing an emergency stop. Such a brake can be embodied as a rotatable roller, for example as a friction wheel, with rotary resistance. In this case, the roller can be arranged on a rotor of a resistor which may be embodied as a motor, and which may be operated by a generator. The brake 107 can be provided at both end faces of the reel 104; 106, as depicted schematically in FIG. 5.

Preferably, dancing rollers and/or other guide rollers of the reel changer 100 and/or a gluing roller or the support for a gluing brush, which are not shown here and which determine the web tension and web unwind, are made of plastic, advantageously of plastic piping, and particularly are made of carbon fiber reinforced plastic or CFRP.

Figure 8:
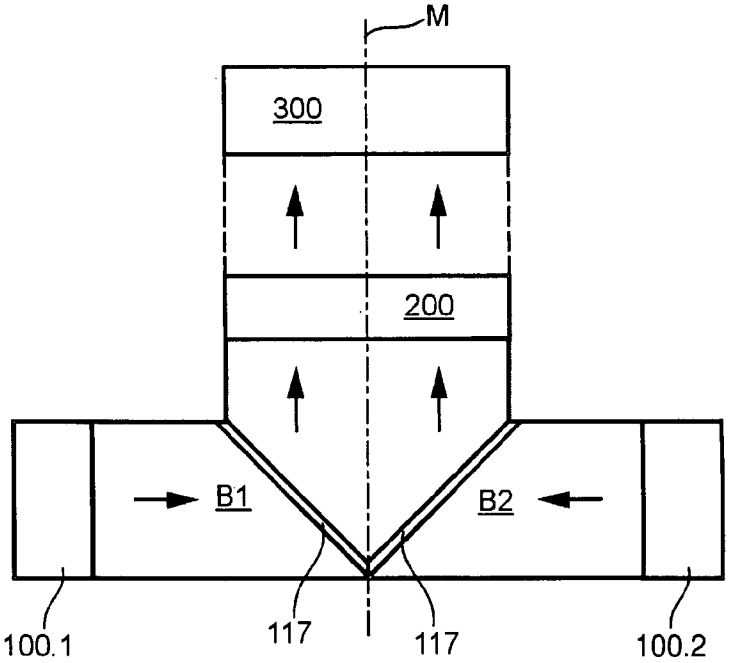
FIG. 8 a schematic illustration of a material infeed using two reel changers.
Figure 7:
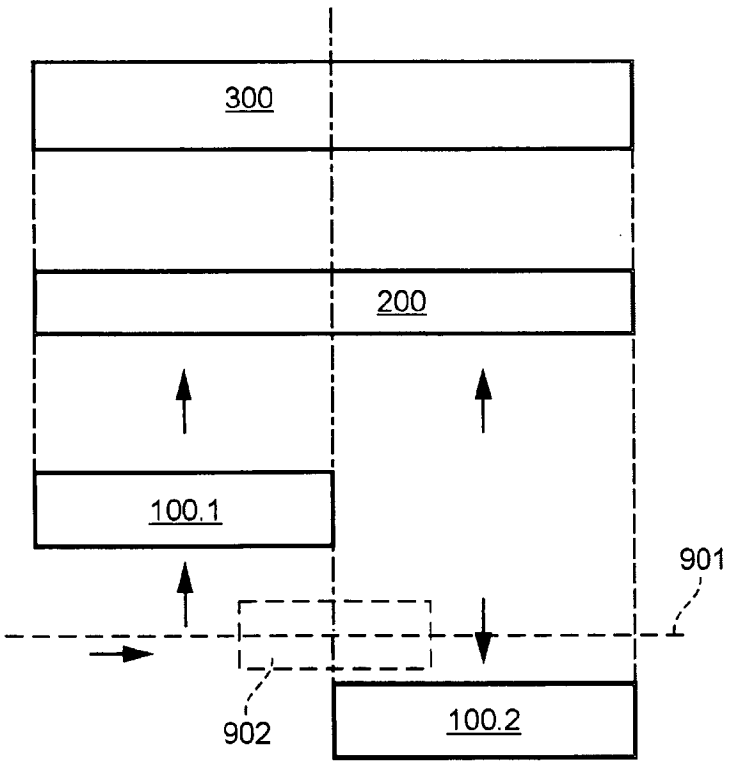
FIG. 7 a schematic illustration of a material infeed using two reel changers.
Figure 9:
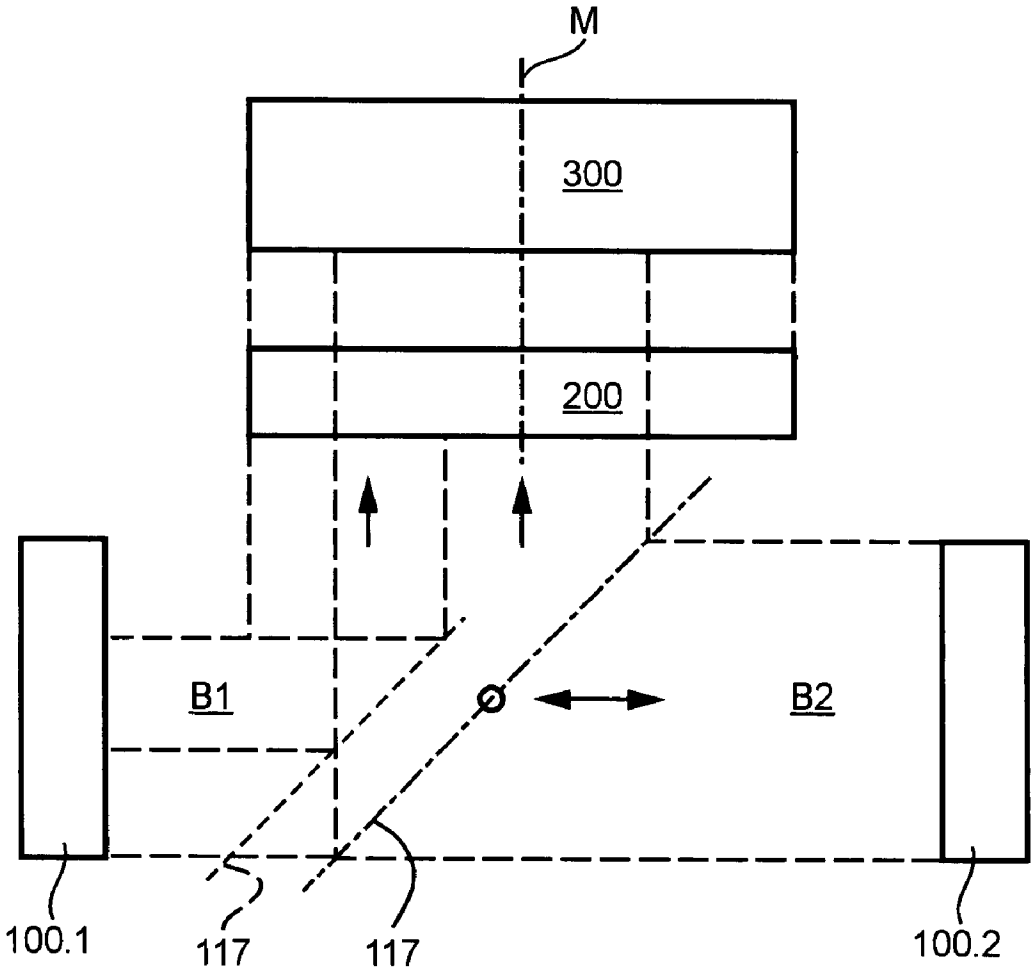
FIG. 9 a schematic illustration of a material infeed using two reel changers having different web widths.

In variations of the subject invention, which are shown in FIG. 7, FIG. 8 and FIG. 9, which are advantageous in terms of proven and available technology, and also in terms of susceptibility to reel break, the printing couple line M, either without or particularly in combination with one or more of the other specified measures, can also be supplied with two partial-width webs B1; B2 from two reel changers 100.1; 100.2, in parallel or side by side, rather than with a single width web B. For partial widths of this type, corresponding reel changers 100.1; 100.2, along with assemblies for reel logistics, such as transport carriages 902, and the like, are already available, with the exception of additional optional measures.

As may be seen, in FIG. 7, two reel changers 100.1; 100.2 are arranged offset from one another, as viewed in the direction of the printing couple line, and side by side, as viewed transversely to the web B1; B2, to accomplish this result. The spacing, viewed in the direction of the printing couple line, can be dimensioned such that reel loading can occur through a transport path 901, which is indicated by dashed lines, for example, by the use of a rail-mounted transport carriage 902 or an automated guided vehicle or AGV, in alignment between the two reel changers 100.1; 100.2 that are offset from one another.

In an advantageous embodiment, as depicted in FIG. 8, the reel changers 100.1; 100.2 are arranged with their rotational axes parallel to the direction of the printing couple line M or the machine alignment M, and are located on both sides of the machine alignment M. Each web B1; B2, which is to be reeled off its respective reel changer 100.1; 100.2, is turned once through 90°, into the direction of the machine alignment M, over a turner bar 117. In the embodiment of FIG. 8, two reel changers 100.1; 100.2, which are both embodied with the same maximum nominal width, can be provided.

FIG. 9 shows an embodiment in which either two reel changers 100.1; 100.2, each having the same, maximum nominal width or, advantageously, an embodiment in which the two reel changers 100.1; 100.2 have inherently different nominal widths and can thus support reels 104; 106 also having different widths. In an advantageous further development of the embodiments including the turner bars 117, if those turner bars are embodied as being movable in a direction, such as, for example, transversely or longitudinally, and particularly as being movable transversely to the machine alignment M, at least within a significant adjustment range, then it is also possible to feed webs B1; B2 of variable web widths into a desired machine alignment M by positioning the appropriate turner bar or turning bars 117 appropriately.

The following discussion does not refer expressly to the embodiments comprising a web B which is embodied as "two webs" B1; B2. Instead, the web B or B' will be discussed.

For example, for web widths up to a certain first web width, such as, for example, up to 2,000 mm, the printing couple line M could be loaded with only one web B2. For web widths that exceed this width, the line could be loaded with two webs B1 and B2 situated side by side.

Preferably, an infeed system, for use in feeding the web B; B' into the press, is provided. Such a web infeed system typically has a cable or a chain system on both sides of the web, and which is preferably equipped with tensile force compensation, especially when the infeed path is not identical to web path. This tensile force compensation can be a spring system in the infeed nose, for example. For purposes of synchronization, the two sides of the system, such as a chain or cable, can be connected to one another by a rod, for example.

The infeed unit 200 can be equipped at least with a device for adjusting web tension and, optionally, can also be equipped with a device for lateral alignment. In an embodiment which is advantageous in terms of shorter paths and stability, the infeed unit 200 is integrated into the frame of the reel changer 100, as depicted schematically in FIG. 7, FIG. 8 and FIG. 9.

Figure 10:
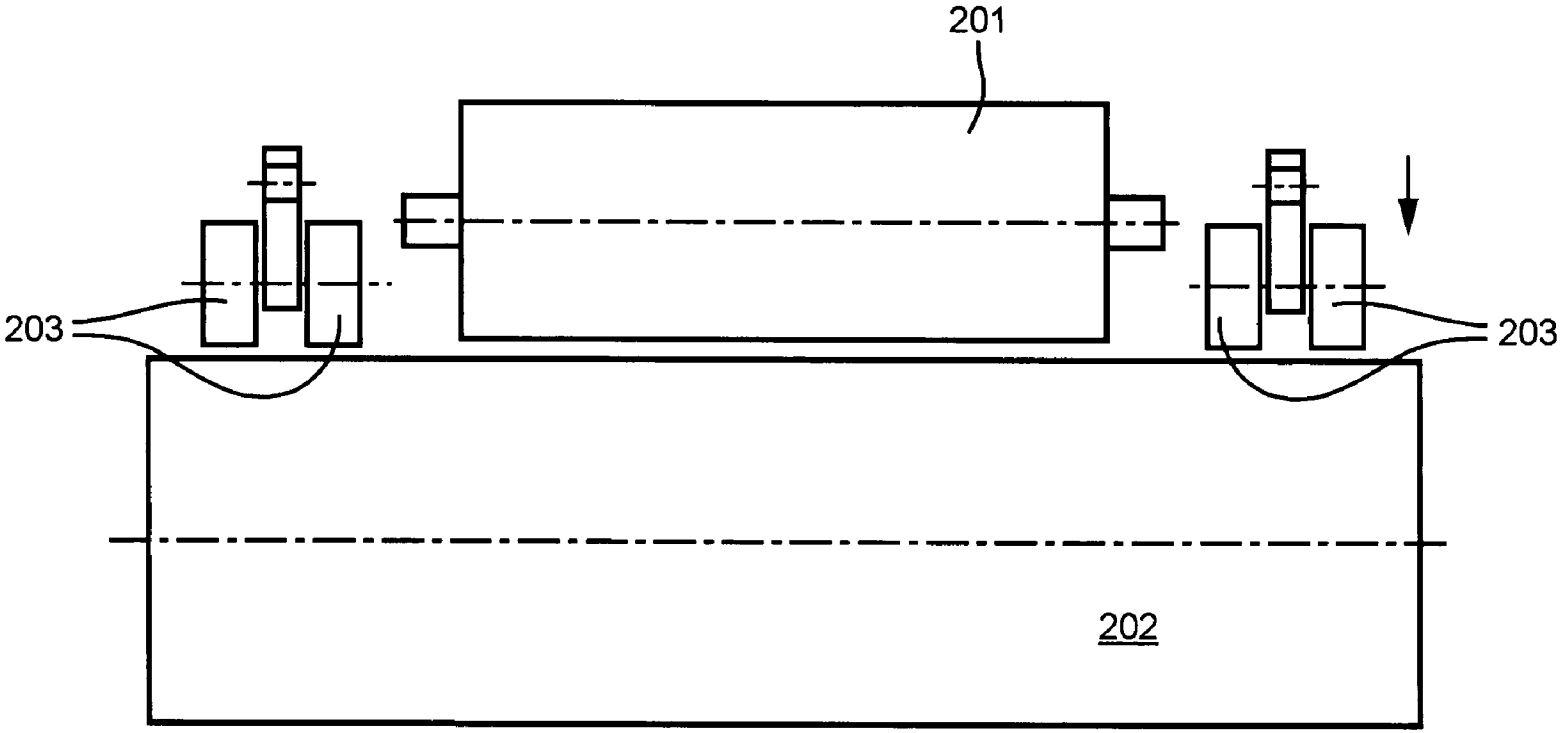
FIG. 10 a diagram of a draw roller.

For web transport and for adjusting web tension, the infeed unit 200 has a draw roller 202, which is driven by a drive motor, that is not specifically shown in FIG. 10. In one variation, the drive motor can be embodied as a torque controlled motor, and in another variation, it can be embodied as a speed controlled motor.

Slippage is prevented, or is minimized, on one hand, by a large wrap, around the draw roller 202, of 90 to 180°, with an S-shaped path of the web B in the infeed unit 200, and on the other hand by rollers 203, each with a width in the axial direction of less than 100 mm, and/or by a pressure roller 201, with a width in the axial direction of at least half the length of the draw roller, such as, for example, by a pressing roller 201, which roller or rollers can be pneumatically engaged, for example, against the draw roller 202. In the advantageous embodiment shown in FIG. 10, cooperation with a pressing roller 201 is provided over a center region of the draw roller 202, as a stretching effect, and at both edge areas, in which cooperation with one or more individual rollers 203 in each region is provided for preventing folds. In a further development, the pressing roller 201 and/or the rollers 203 on both ends, at the different halves of the draw roller 202, can be engaged against the draw roller 202 with different levels of pressure. The axial positioning of the lateral edges of the web B can thereby be influenced, within certain limits, and can be controlled, in connection with the corresponding sensor system and control device, for example.

The printing units 300 are typically embodied as so-called I-type printing units 300, which are arranged vertically in the manner of a blanket-to-blanket printing unit 300. The cylinders 303; 304, such as, for example, the printing couple cylinders 303; 304, and particularly the transfer and forme cylinders 303; 304, are arranged primarily one above the other vertically, and/or are configured with an essentially horizontal web path between the printing units 300.

Figure 11:
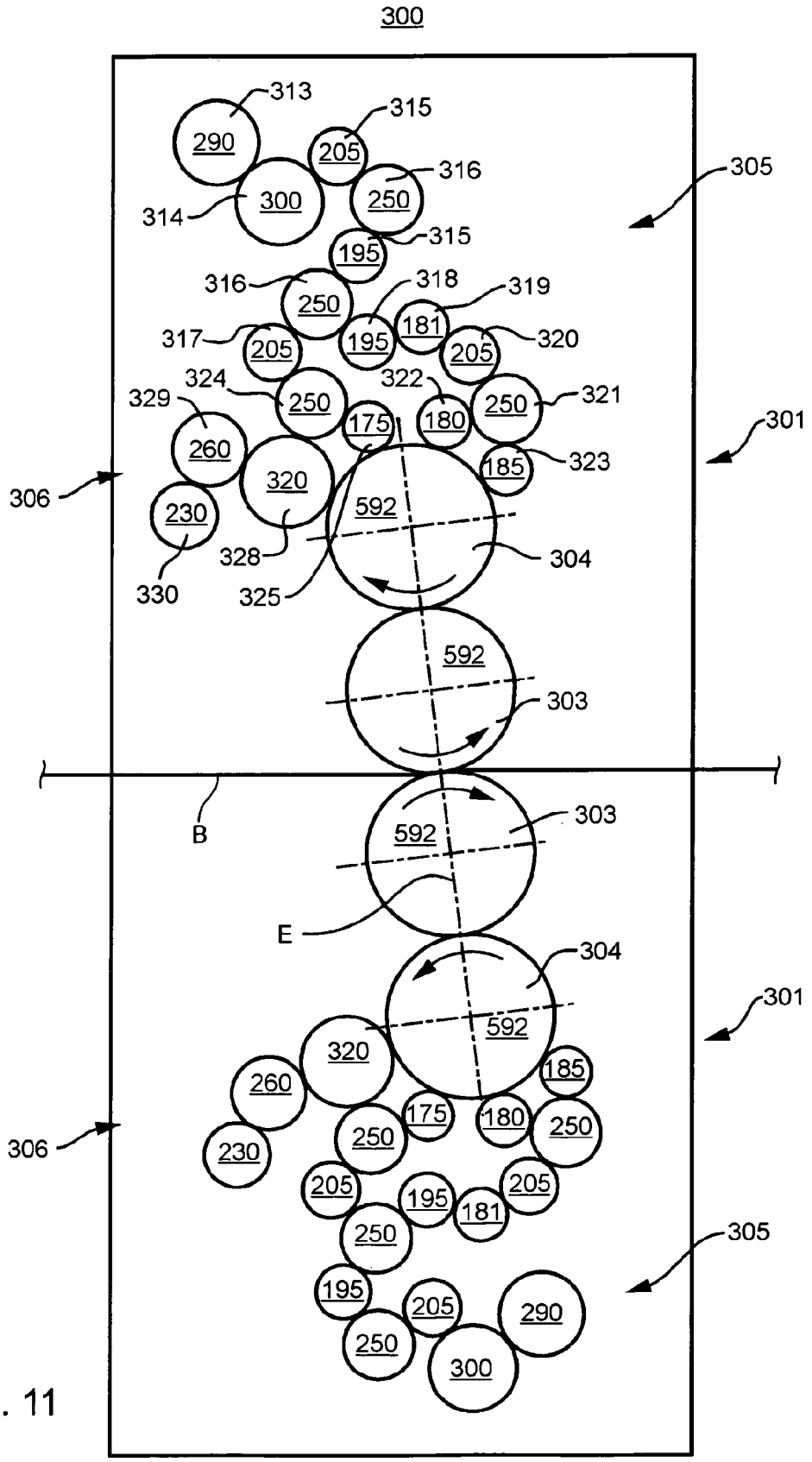
FIG. 11 a schematic, side elevation view of an embodiment of a printing unit.

In one preferred embodiment, the rotational axes of the printing couple cylinders 303; 304 of a blanket-to-blanket printing unit 300, or the four printing couple cylinders 303; 304 of the two cooperating printing couples 301, are embodied as lying essentially within a shared plane E in the print-on position. As depicted in FIG. 11, the shared plane E forms an angle, for example, of between 76° and 87°, and especially of between 80° and 85°, with the plane of the incoming web B and/or with horizontal FIG. 11.

In addition to an ink delivery system, which is not shown in FIG. 11, such as, for example, an ink fountain with an adjustment device for regulating ink flow or an ink delivery bar with a plurality of metering openings for a number of ink pumps, an inking unit 305 also comprises a plurality of rollers 313 to 325. The not depicted ink delivery system can also be embodied as a doctor blade bar. When rollers 313 to 325 are engaged against one another, ink travels from the ink fountain, from an ink fountain roller 313, an ink film roller 314, and by one or more serially arranged first inking rollers 315 and first distribution cylinders 316, depending upon the mode of operation of the inking unit 305, viand by at least one inking roller 317 to 320, to at least one additional distribution cylinder 321; 324, and from there, by at least one forme roller 322; 323; 325 to the surface of the forme cylinder 304. In one advantageous embodiment, the ink travels from the first distribution cylinder 316 through various different possible paths, based upon the position of the rollers 317 and 318, alternatingly or simultaneously, in series or parallel, through two additional distribution cylinders 321; 324 to the forme rollers 322; 323; 325.

In one embodiment, one roller 328, such as, for example, a forme roller 328 of the dampening unit 306, can optionally be placed, in a first position, in contact with the distribution cylinder 324 of the inking unit 305, where an ink/dampening agent emulsion is formed. At the second of its two positions, however, it interacts with the forme cylinder 304 as one cylinder, and with an additional roller 329 of the dampening unit 306, such as, for example, with a distribution roller 329, and in particular, with an oscillating chromium roller 329. The chromium roller 329 receives the dampening agent from a dampening device, such as, for example, a roller 330, and particularly from a dipping roller 330, which dips into a dampening agent reservoir 332, for example, a water fountain. The dampening device can, however, also be a rotating brush or a spray bar of a spray dampening unit.

The underlined numbers which are provided inside the circles, which circles represent, in FIG. 11, rollers 313 to 325 and 328 to 330 of the inking and dampening units 305; 306, respectively, indicate examples of diameter dimensions in mm for an advantageous embodiment of the relevant rollers 313 to 325 and 328 to 330. The underlined numbers which are provided in the printing couple cylinders 303; 304 represents the preferred diameter measurement for a variation of the thicker embodiment of approx. 1,860±5 mm printing length.

Figure 12:
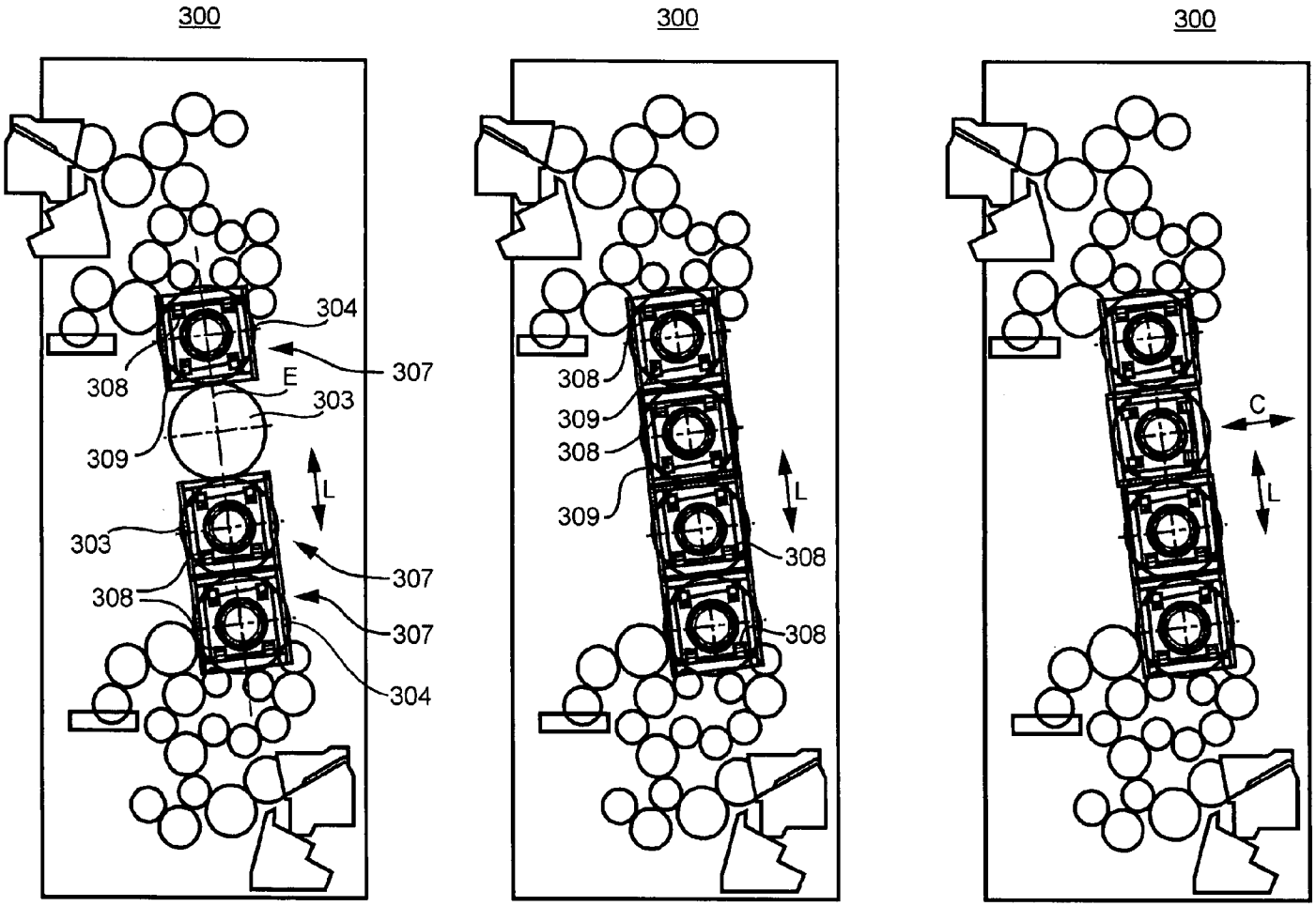
FIG. 12 schematic side elevation views of embodiments a), b) and c) of a printing unit with linear bearings.

The printing couple cylinders 303; 304, which are movable in terms of print-on/print-off adjustment, can advantageously be mounted in bearing units 307, and particularly in linear bearing units 307, for movement along a linear adjustment path L, as depicted in FIGS. 12*a*), 12*b*) and 12*c*). The bearing units 307 are preferably arranged in such a way, or are even mounted on the interior side of the frame in such a way, that the bearing points of the radial bearings that are close to the cylinder and that accommodate the cylinder journals, are arranged on the interior side of the frame, such as, for example, in an area that projects inward out of the frame alignment.

FIGS. 12*a*), 12*b*) and 12*c*) show variations of the printing unit 300, in which the movable cylinders 303; 304 are arranged in bearings, each having a linear adjustment path L. By way of example, in FIGS. 12*a*), 12*b*) and 12*c*), the inking units 305 are shown in a variation which is different from that of FIG. 11, and with only three distribution cylinders 321; 324; 316. In the embodiment of FIG. 12*a*), the lower forme and transfer cylinders 304; 303 and the upper forme cylinder 304 are mounted, in bearing units 307, so as to be movable along a linear adjustment path L to accomplish a print-on/print-off movement. The upper transfer cylinder 303 here is stationarily mounted, or optionally is merely adjustable. In FIG. 12*b*), all four of the printing couple cylinders 303; 304 are mounted so as to be movable along a linear adjustment path L.

The direction of the linear adjustment path L preferably extends such that it forms a maximum angle of 15° with the plane E and, for example, forms a maximum acute angle β of about 10°, and preferably of about 0°, with the plane E, for example, for purposes of a force-defined print-on adjustment, as will be discussed below.

In addition to having a radial bearing which accommodates the journal of the relevant cylinder 303; 304, the bearing unit 307 also has, for example, bearing assemblies that are usable for moving the cylinder 303; 304 radially. For this purpose, the bearing unit 307 has stationary bearing elements, for example, along with the bearing elements that are movable relative to those stationary bearing elements. The bearing elements, in pairs, accommodate a bearing block, which holds the radial bearing. The bearing elements, which are stationarily fixed to the frame or to the carrier, are arranged on a support, which will be, or which is connected, as a unit, to the side frame. In addition, power-controllable actuators 308, that can be run on hydraulic, magnetic or piezoelectric power, are preferably provided, and which are arranged to adjust the bearing block in the direction of the print position. Preferably, in the bearing unit 307 of at least one of the movable cylinders 303; 304, an adjustable stop, which limits the path toward the print position, is provided. This stop can be adjusted first during adjustment to the print-on position, so that the cylinder 303; 304 is engaged, with the desired engagement pressure. The stop can then be moved to the resulting position, and, during print operation, the cylinder 303; 304 can then be clamped with a pressure level which is greater than that of the engagement pressure against the adjusted stop.

For the upper cylinders 303; 304, which, in the examples, can be adjusted to the print-on/print-off position, second actuators 309, for example, are provided on the side of the bearing unit 307 that is close to the print position. These actuators are able to compensate for the force of weight at a corresponding pressure level, for example, and can be actuated for disengagement. In this case, the lower cylinders 303; 304 have no such second actuators 309. In the print-on position, however, the lower cylinders must be adjusted with a pressure level that is higher than that of the upper cylinders 303; 304 by an amount corresponding to their weight.

In the embodiment of FIG. 12*c*), the upper transfer cylinder 303 is stationarily arranged, referring to a movement in the direction of adjustment along the adjustment path L for print-on/print-off adjustment. However, as is schematically illustrated in FIG. 12*c*), this cylinder 303 is mounted, on at least one end surface, in bearings, for example, and is also supported in linear bearings, so as to be movable in a direction of movement C, which direction of movement C is perpendicular to the rotational axis of the cylinder and also has at least one component of direction that is perpendicular to the direction of adjustment along the adjustment path L.

The direction of movement C is preferably chosen to be perpendicular to the direction of adjustment along the adjustment path L, and, when it is actuated on one side, it places the relevant cylinder 303 in an inclined position (so-called "cocking"). The cylinder 303 can be displaced using a manual or a motorized adjustment assembly, preferably a motor-driven adjustment spindle or a pressure-actuable actuator. A mount of this type makes it possible for a cylinder 303, that is mounted in this manner, to assume an inclined position.

The power-controlled adjustment, or the implementation of a purely force-based pre-adjustment of an adjustable stop, ensures, in contrast to a path-controlled adjustment, compensation for different print substrate thicknesses or for other geometric effects.

Figure 13:
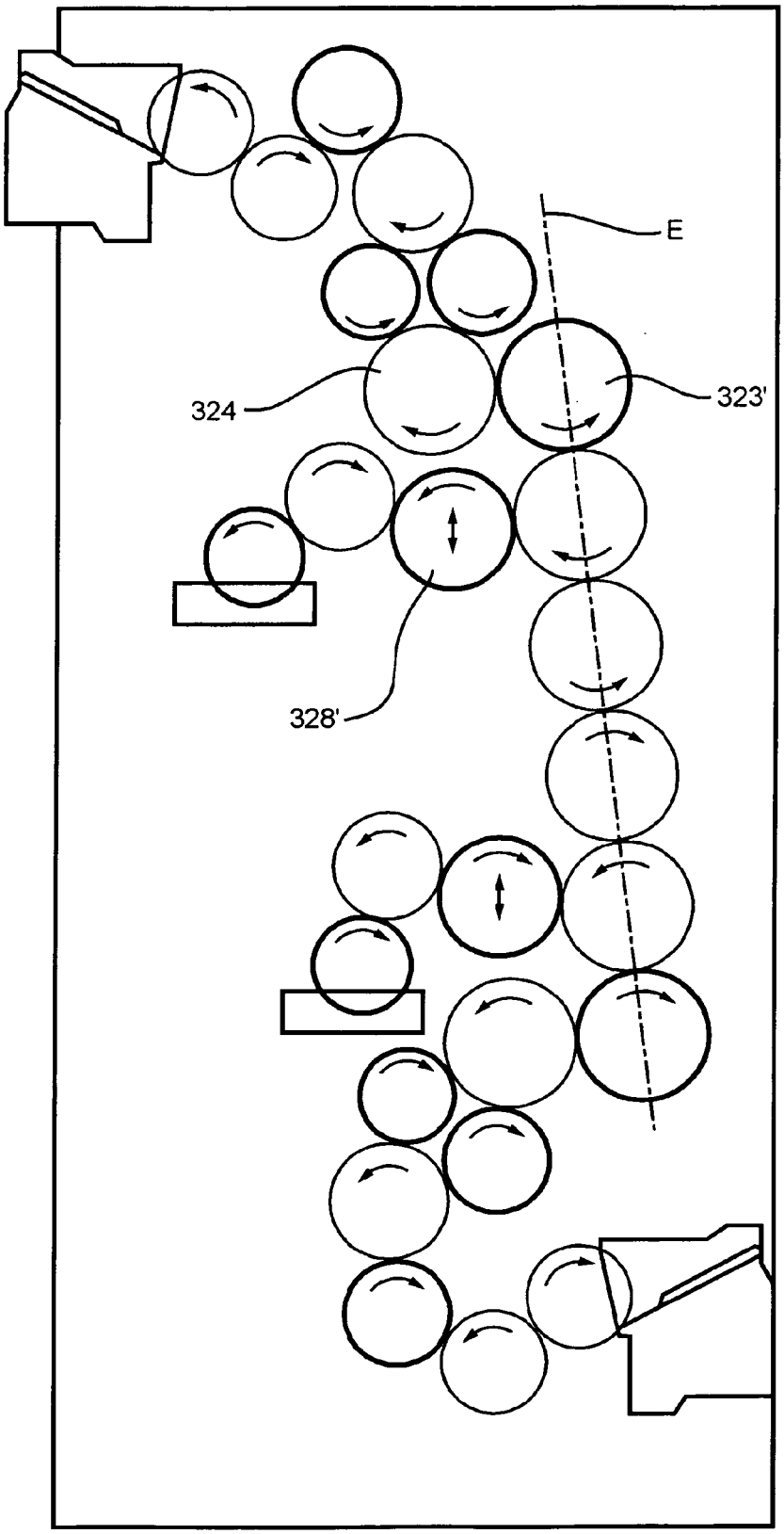
FIG. 13 a schematic side elevation view of an embodiment of a printing unit.

FIG. 13 shows a further embodiment of an advantageous inking unit/dampening unit configuration. An ink application roller 323' is provided in which the diameter of the ink application roller corresponds essentially to that of the forme cylinder 304, or is about the same or slightly smaller, such as, for example, 0.3-3% smaller. In the print-on position, this ink application roller 323' also lies with its rotational axis in the plane E. The diameter of dampening fluid application roller 328' can also correspond essentially to that of forme cylinder 304, or can be about the same or slightly smaller, such as, for example, 0.3-3% smaller. As described above, it can also be arranged, or can optionally be arranged, adjacent to the distribution roller 329 of the dampening unit 306 so as to also interact with the distribution cylinder 324 of the inking unit 305.

In one advantageous embodiment, the forme and/or transfer cylinders 304; 303 are embodied with a cooling unit.

In addition to the printing couple lines shown in FIGS. 1 to 3, a line can have five printing units 300, of which then two, for example, can be selectively operated during a change for a flying printing plate change, such as an imprint operation.

It can also be advantageous, particularly in terms of dimensions, to furnish devices on the printing couple 301 for accomplishment of either a partially or a fully automatic plate change. With this device, for example, automatic plate change would be possible on a printing couple 301 that has just been disengaged, even during imprint operation, while other machines are running. It is also advantageous, in this case, for the two cylinders 303; 304 of each printing couple 301 to be driven mechanically independently of other printing couples 301, either individually or in pairs, by at least one drive motor.

Figure 14:
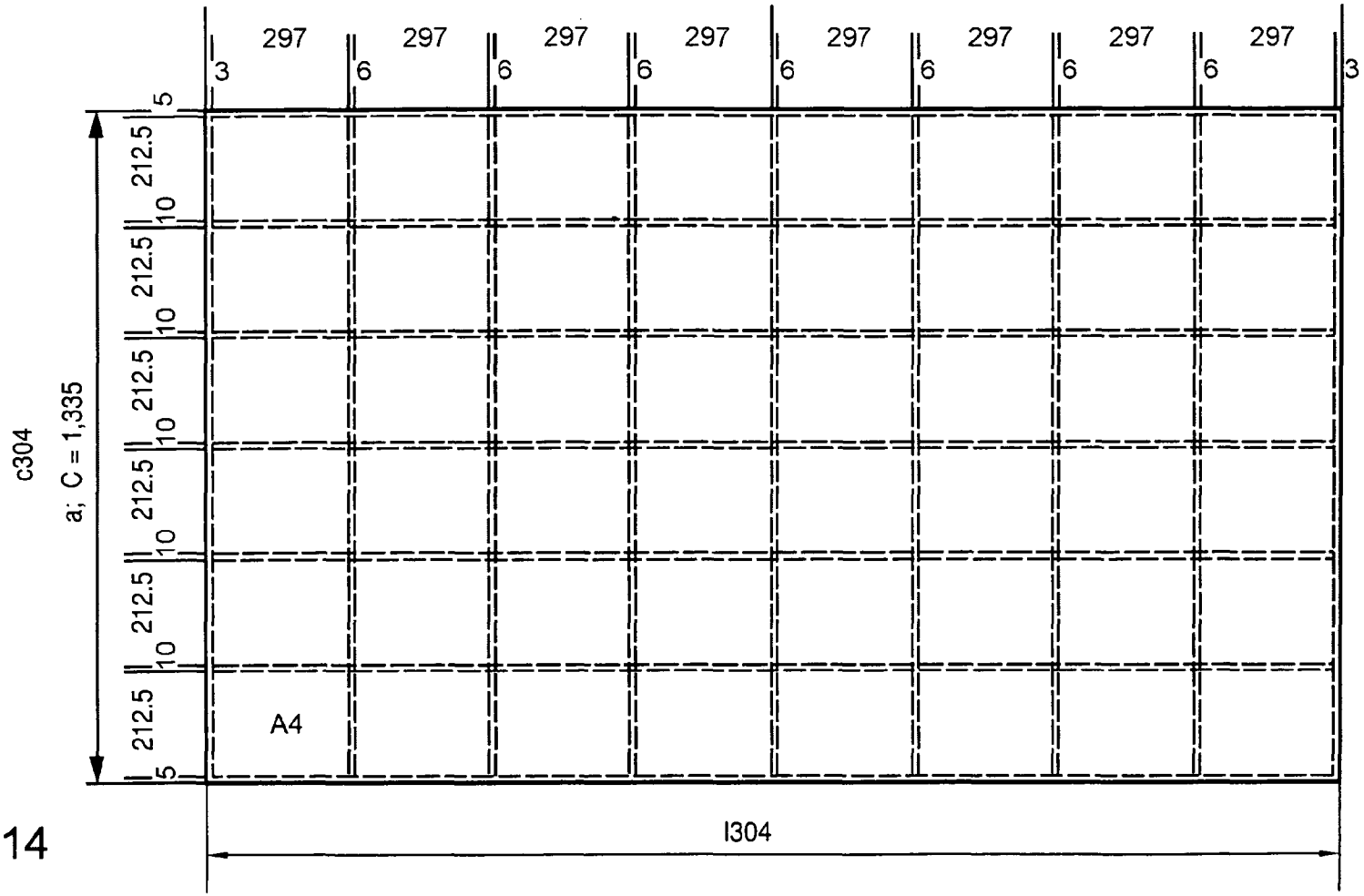
FIG. 14 a first configuration of printing images loaded on a cylinder.

FIG. 14 shows a loading configuration of a forme cylinder 304 with six horizontal printing pages in the circumferential direction of the forme cylinder c304 and with up to eight horizontal printing pages of one format F1, and particularly of a DIN A4 format A4, in the longitudinal direction 304. The numerical figures given in FIG. 14 are intended as examples of the page lengths of the format shown, and of cutting edges in mm. Format F1 represents a standard format for the printing press, for example, in which then, for example, the nominal width and/or nominal number of pages are then also indicated. In this case, forme cylinder 304 has an effective cylinder length 304, for example, of at least approximately 2,415 mm, plus additional length for trimming, if applicable in the longitudinal direction, and has a circumference c304 of approximately 1,335 mm, 1,340±5 mm. This embodiment is listed as an advantageous embodiment in Table 2 of FIG. 18 under column "3"× Circumference, for a total number of 96 pages, front and back sides of the web for each printing couple revolution. 1× Circumference in the meaning used here refers to two pages in the circumferential direction, to be applied accordingly to 2× and 3×, etc.

Figure 15:
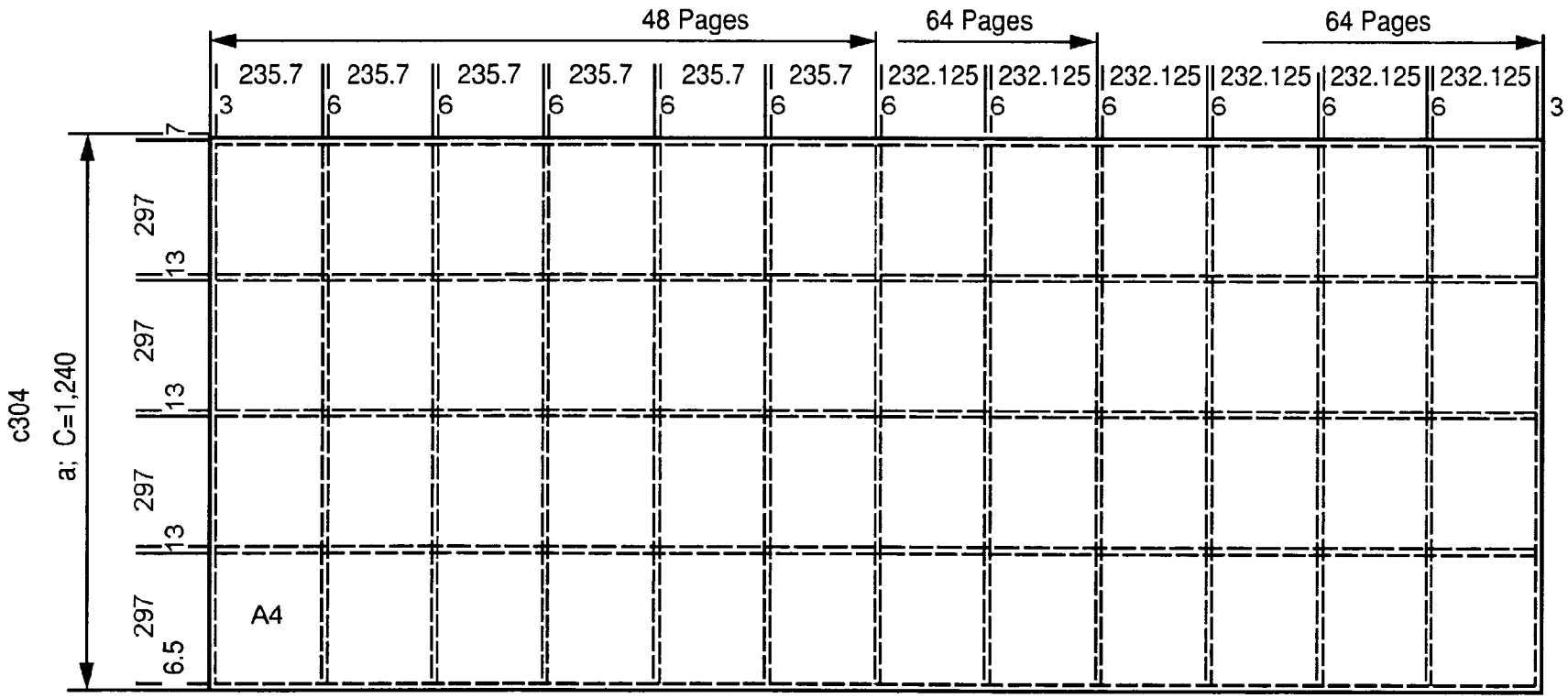
FIG. 15 a second configuration of printing images loaded on a cylinder.

FIG. 15 shows a variation for the loading configuration of a forme cylinder 304 with four vertical printing pages in the circumferential direction c304, and with up to 12 vertical printing pages of one format F1, particularly DIN A4 format A4, in the longitudinal direction l 304. The numerical figures given in FIG. 14 are intended as examples of the page lengths of the format shown, and of cutting edges in mm. In this case, forme cylinder 304 has an effective cylinder length l 304 of at least approximately 2,575 mm, plus additional length for trimming, if applicable in the longitudinal direction, and a circumference c304 of approximately 1,240 mm, 1,240±5 mm. This embodiment is listed as an advantageous embodiment in Table 1 of FIG. 18 under column "2"× Circumference, for a total number of 96 pages, front and back sides of the web for each printing couple revolution.

Figure 16:
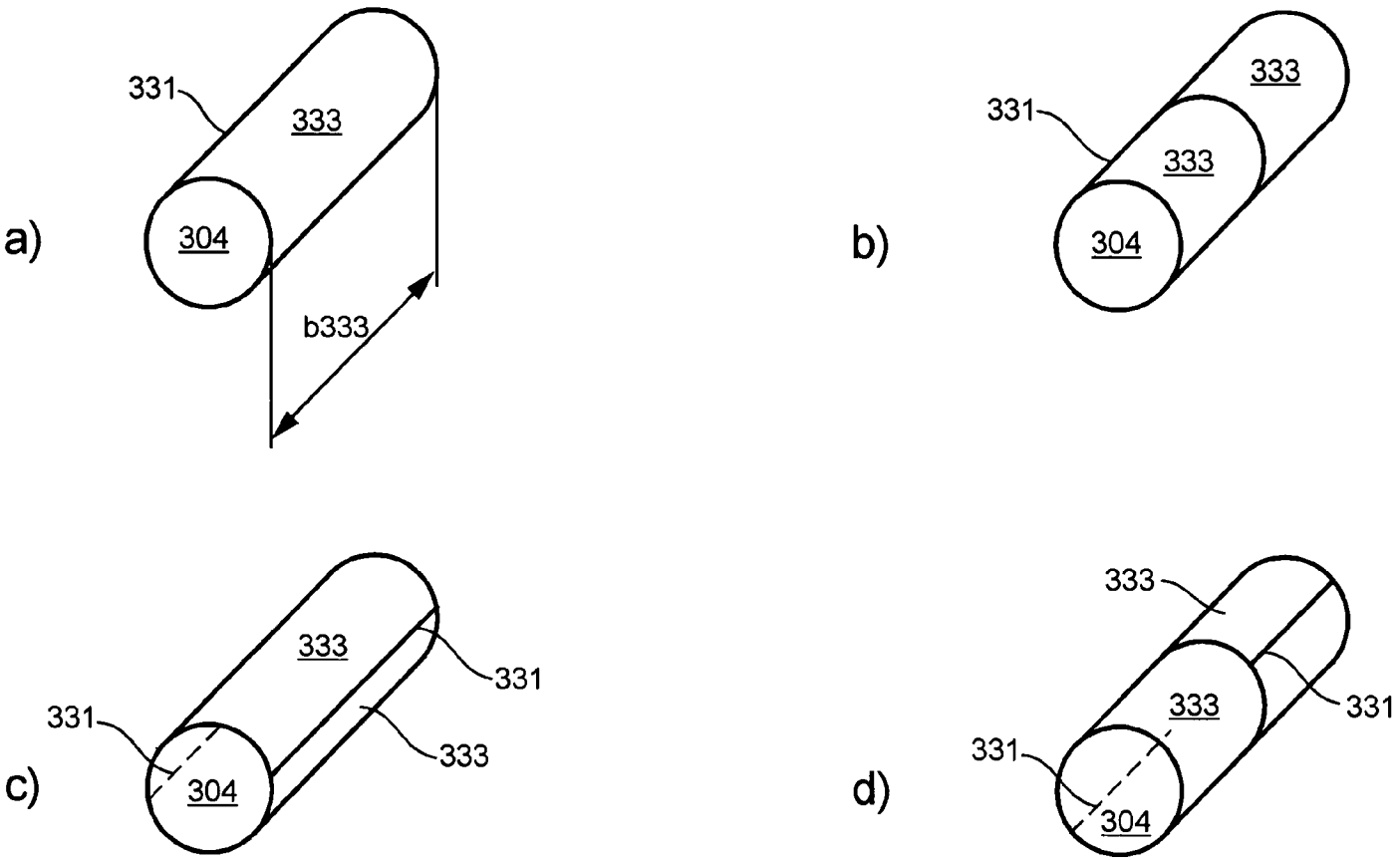
FIG. 16 schematic perspective views of four advantageous loading configurations a), b), c) and d) of printing formes on a forme cylinder.

FIG. 16 shows advantageous embodiments 16*a*), 16*b*) 16*c*) and 16*d*) for the loading configuration of forme cylinder 304 with one or more printing formes which bear the printing pages.

In FIG. 16*a*), a single printing forme or plate 333 is arranged, for example, over the entire effective length l 304 of the forme cylinder 304 and essentially the entire circumference c304 of the forme cylinder. This printing forme 333 has a width b333 of 3,040 mm, for example. It is secured, at its ends, in a groove 331, which groove 331 extends continuously in the longitudinal direction of the cylinder's outer surface. This embodiment offers the greatest variability in formats to be printed.

FIG. 16*b*) shows an embodiment which is advantageous in terms of plate or forme handling. Two plates, such as printing formes 333, each, for example, being about 1,520 mm in width, are arranged side by side in the longitudinal direction of the forme cylinder 304, with each forme 333, extending essentially around the entire circumference c304. These plates or formes 333 can both be secured, at their ends, arranged in the same continuous groove 331 and with their ends aligned. Alternatively, as is shown in FIG. 16*d*, the plate or forme ends can each be secured in one of two grooves 331 or groove segments that are offset from one another by 180°, with the ends of the two plates or formes 333 now being offset from one another by 180°, thereby reducing susceptibility of the forme cylinder 304 to vibration. In another advantageous embodiment, two printing formes 333, which each extend over the entire length of the forme cylinder 304, but which each extend around only half of the circumference of forme cylinder 304, can have their ends secured in two grooves 331 which are offset from one another by 180°, as seen in FIG. 16*c*. The latter is advantageous when an arrangement of print images in the longitudinal direction is to be ensured, with easy handling, and without limitation by a butt joint. This can be the case, for example, when, in addition to an even number, an odd number of printing images are to be arranged, distributed over the entire length.

Figure 17:
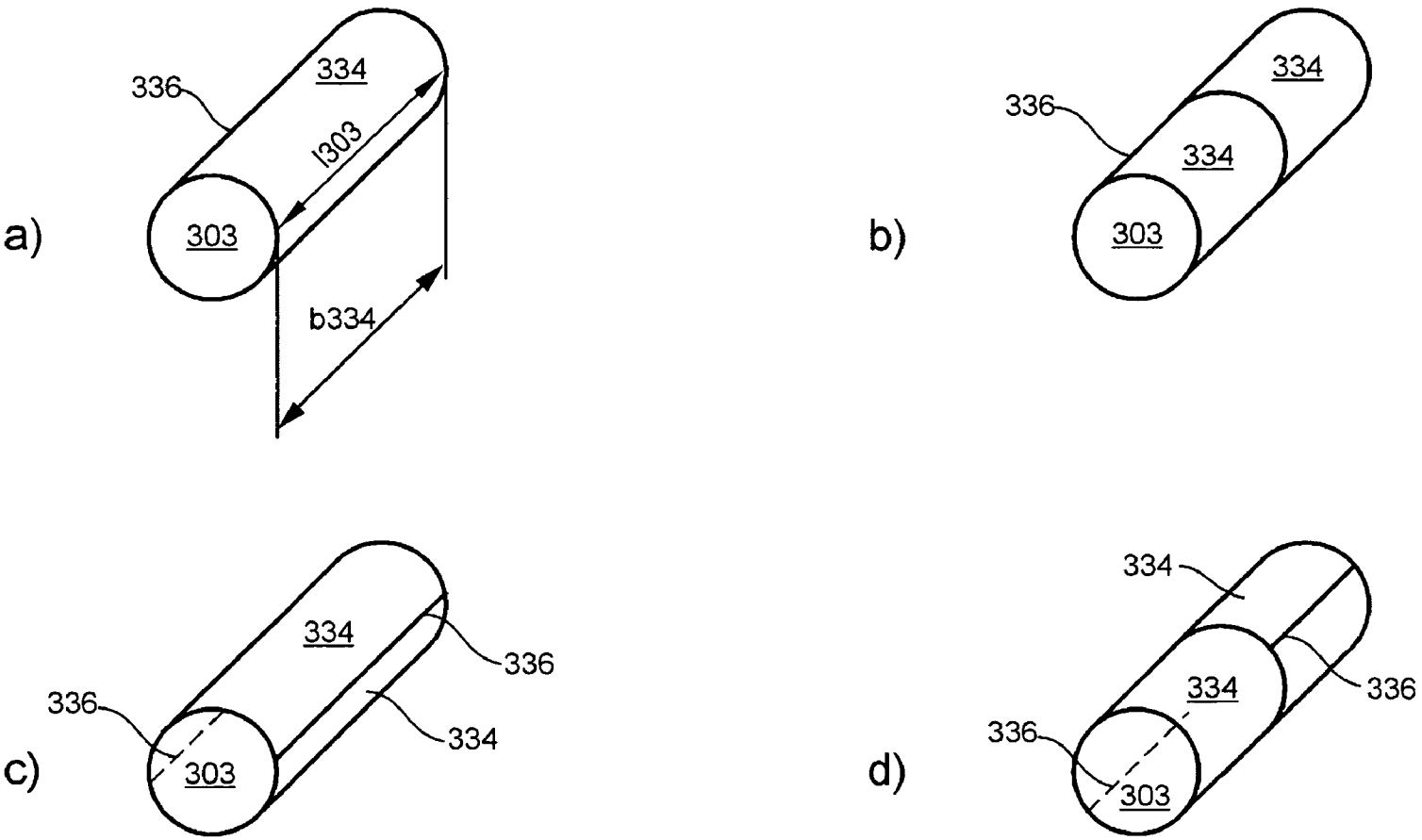
FIG. 17 schematic perspective views of four advantageous loading configurations a), b), c) and d) of printing blankets on a transfer cylinder.

FIG. 17 shows advantageous embodiments 17*a*), 17*b*), 17*c*) and 17*d*) for covering the transfer cylinder 303 with one or more printing blankets 334.

FIG. 17*a*) shows a single printing blanket 334 arranged over the entire length l 303 and essentially the entire circumference c303 of the transfer cylinder 303. This printing blanket 334 has a width b334 of 3,040 mm, for example. It is held, at its ends, in a groove 336 which extends continuously in the longitudinal direction of the cylinder's outer surface. This embodiment offers the greatest variability in formats to be transferred.

FIG. 17*b*) shows an embodiment which is advantageous in terms of blanket handling. Two printing blankets 334, for example, each having a width b334 of approximately 1,520 mm, are arranged side by side in the longitudinal direction, with both blankets 334 extending essentially around the entire circumference c303 of the transfer cylinder 303. These printing blankets can be positioned with their end secured in the same continuous groove 336, with their ends aligned, or, as shown in FIG. 17*d*), the two blankets can have their ends secured in two grooves 336, or groove segments, that are offset from one another by 180°, with the ends of the two blankets being offset from one another by 180° or stacked, thereby reducing susceptibility of the blanket or transfer cylinder 303 to vibration. This is advantageous when an arrangement of print images, in the circumferential direction, is to be ensured, with easy handling, and without limitation by a butt joint. In another advantageous embodiment, two printing blankets 334 which each extends over the entire transfer cylinder's length, but which each extends around only half the transfer cylinder's circumference, can be arranged in two grooves 336 that are offset from one another by 180°, as seen in FIG. 17*c*. The latter is advantageous when an arrangement of print images, in the longitudinal direction, is to be ensured, with easy handling, and without limitation by a butt joint. This can be the case, for example, when, in addition to an even number, an odd number of print images are to be arranged, distributed over the entire length of the transfer or blanket cylinder 303.

In one advantageous embodiment, so-called metal printing blankets, which are configured having an elastic and/or a compressible layer located on a metallic support plate, are used as the printing blankets 334. In this case, it is advantageous that, using the insertable angled metallic ends of the support plate, these blankets can be inserted into a narrow slit, such as, for example, a slit having a maximum opening width of 5 mm in the circumferential direction, which narrow slit extends lengthwise along the circumference of the transfer cylinder 303. This variation of the printing blanket 334 is of particular benefit for the aforementioned loading configurations, and is particularly advantageously in combination with the configuration of the two printing blankets 334 arranged one in front of the other in the circumferential direction, and with their ends arranged in two grooves 336 which extend continuously over the usable length, but which grooves 336 are offset 180° from one another.

In another advantageous, alternative embodiment of the printing blankets 334 and/or a further development of the metal printing blankets, the printing blankets 334 are each equipped with a relatively thick, elastic/compressible active layer, which may be, for example, at least 2 mm thick, and/or are equipped with a relatively more compressible and thus a softer material. The consequences of cylinder fluctuation, which may be caused by vibration, in the event of contact pressure between the cylinders 303; 304, can thereby be decreased.

In principle, it is advantageous for the same loading pattern to be used for the printing formes 333 and the printing blankets 334. With the exception of the combinations of FIG. 16*b*) with FIG. 17*c*) or FIG. 16*c*) with FIG. 17*b*), other combinations can also be advantageously used.

FIG. 18 provides an overview of variations of the present embodiment of effective lengths and circumferences of the printing couple cylinders 303; 304 that are conceivable in principle, and in which particularly preferred variations are circled. The specified numbers of pages indicate the numbers of pages that can be generated with a full loading with printing pages of format F1, such as, for example, DIN A4 format A4, in production in the first operating situation utilizing homogeneous covering of the forme cylinder 304 with printing images of the same format and the same orientation.

For the aforementioned dimensions, in an advantageous embodiment, the bodies of the forme cylinder 303 and/or the transfer cylinder 304, respectively, are structured as cylindrical bodies comprising multiple layers of plastic, for example CFRP, or as cascade connected bodies, composed of multiple individually produced plastic pipes, for example CFRP pipes, which are glued or cast to one another. In this case, the base body can be made entirely of plastic, or, in another embodiment, the base body can also have a metallic layer, in which case, however, the plastic layers contribute at least significantly, such as, for example, contribute at least one-half, to supporting the load as load-bearing elements.

As was stated above, in one embodiment, multiple printing blankets 334 and/or multiple printing formes 333 are arranged side by side or are optionally stacked or are positioned one in front of the other on the circumference of the corresponding cylinder 303; 304.

The printing formes 333 can advantageously be reinforced by strips, for example, at the leading and/or trailing ends, which reinforcement offers advantages in terms of transport and mounting of the printing formes 333 on the cylinder 304.

Rollers 313 to 325 and 328 to 330 of the inking and/or of the dampening unit 305; 306, particularly, for example, an aforementioned chromium roller 329 and/or one or more of the aforementioned forme rollers 322; 323; 325; 328, can be embodied in the manner of pressing rollers. In this case, for example, the outer sleeve is stressed and/or is supported against a continuous central shaft. The same is true of the forme cylinders 303 and/or of the transfer cylinder 304 in a special embodiment, for example, also in the plastic embodiment.

Advantages also result from an embodiment of the present invention in which the forme cylinder 303 and/or the transfer cylinder 304 of the printing couples 301 have a cooling device, such as, for example, liquid cooling. The same can be provided, in place of, or in addition to its bearing. For cooling devices of this type, a cooling circuit with separate temperature control can be provided.

In a further advantageous embodiment, one or more of the distribution cylinders 316; 321; 324 of the inking and/or dampening unit 305; 306 are embodied as convex. They have a greater diameter, such as, for example, greater by at least 0.5 mm at their center than at their edge areas, in order to compensate for sag.

Figure 19:
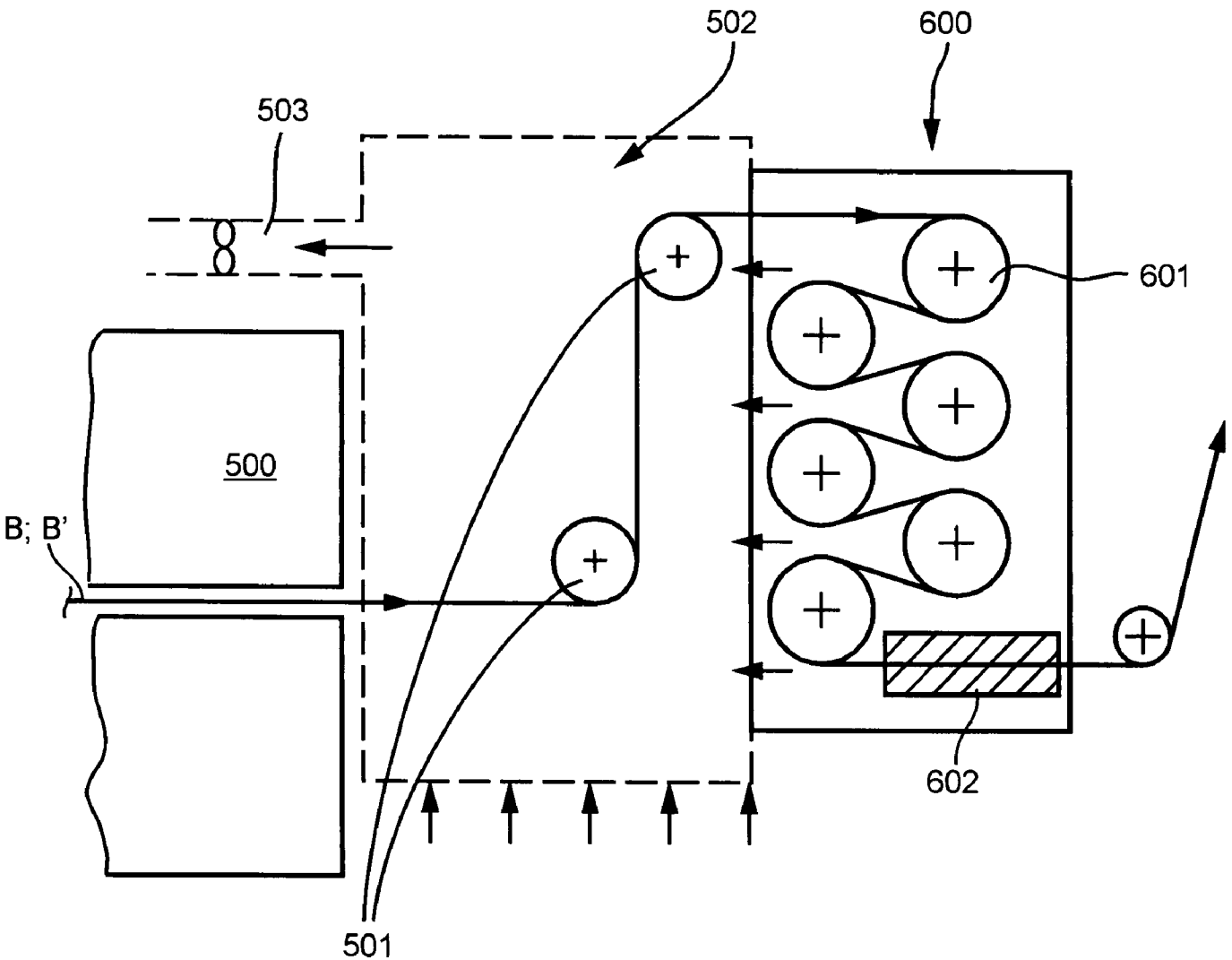
FIG. 19 a schematic illustration of a cooling device with suction.

After imprinting and drying, preferably by utilization of a dryer 500, the web B; B', or the two parallel webs B1; B2, exit the dryer 500 and is fed to the cooling unit 600, for example by guide elements 501, as seen in FIG. 19. In this case, the guide elements 501 can preferably be embodied as guide elements 501 with air outlet openings for use in forming an air cushion for accomplishment of a contactless web lead. In contrast to turner bars, the longitudinal axis of these guide elements extends perpendicular to the direction of the leading web B; B', as may also be seen in FIG. 19.

In an advantageous embodiment, a condensate vacuum extractor 502, such as, for example, a chamber which is largely sealed and which is acted upon with at least a slight negative pressure, is provided directly downstream of the dryer 500 in the web path. The web B; B' is guided through this chamber. The slight negative pressure in the chamber 502 can be produced, for example, using a fan propeller 503 in a suction line of the chamber.

The cooling unit 600 that is depicted schematically in FIG. 1, and as seen in greater detail in FIG. 19, has a group of cooled rollers 601, for example cooling rollers 601, around which the web B; B' to be cooled is wrapped. Such wrapping of the web can be done, one roller after another, for example, at a wrap angle of at least 180°, and advantageously at a wrap angle of at least 240°.

Particularly advantageous is an embodiment of the cooling rollers 601 having a large diameter, such as, for example, a diameter of at least 300 mm. These rollers preferably have grooves, extending either longitudinally or spirally, beneath their outer surface, and through which grooves cooling fluid flows.

Downstream of the last cooling roller 601, a remoistening device 602 can be arranged in the web path.

After imprinting, and after subsequent optional coating, drying and/or cooling in the cooling unit 600, the web B; B' passes to the superstructure 700, as seen in FIG. 1 generally and in FIG. 20 in more detail for further processing. In the superstructure 700, the imprinted web B; B' or the imprinted webs B1; B2 is/are cut into partial webs that correspond to the formats and to the further processing. The resultant partial webs are then brought into the necessary alignments and/or into the desired positions, and in this manner are delivered, oriented and "sorted," for further processing in one or more folding units 800.

In the machine and the process which is presented here in accordance with the present invention, it is a particularly advantageous desired result to produce both multiple, partial products, configured as identical, similar final products or sections of the same final product and/or completely different products, all at the same time.

Figure 20:
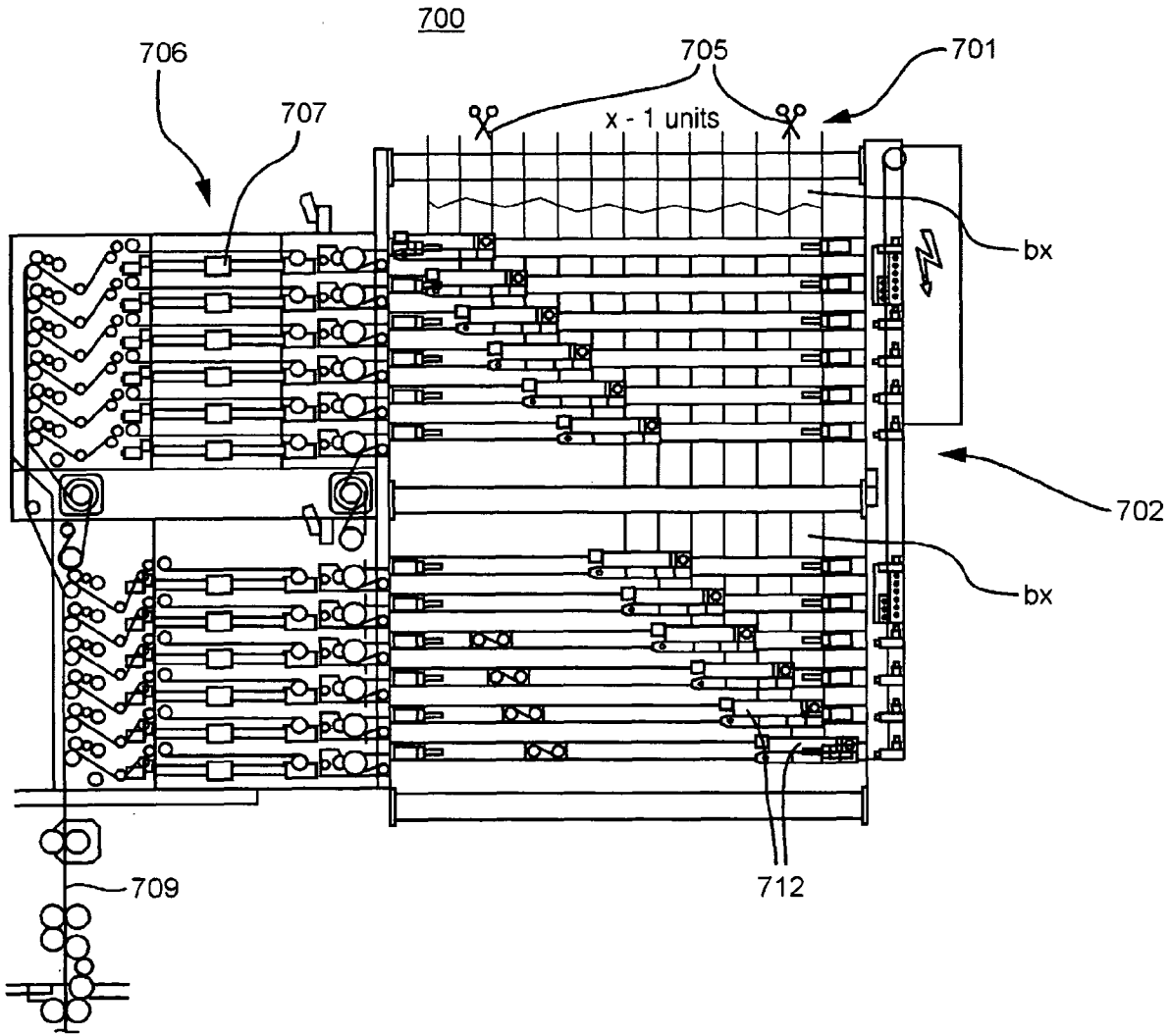
FIG. 20 an embodiment of a superstructure with cutting device, turning device and register devices.

In a simplest embodiment, this desired result can be achieved by utilization of a folding unit 800, with one folding unit, for example, and having only one output 806, but with a later separation of the products which exit the one folding unit arranged in series. This can be achieved, for example, by feeding the ribbons 709 that form the two or more partial products into the single folding unit 800 offset slightly laterally from each other, so that the resultant partial products later come to rest, offset slightly from one another laterally, at the delivery point. If spaced fold formers 708 are used in the superstructure 700, for example, the former noses of two fold formers 708, for example, can be moved relative to one another in the horizontally projected direction of transport of the incoming web B; B', which is the longitudinal direction of the various cylinders, and are offset for the aforementioned operating mode, as depicted in FIG. 24. If only guide elements 712 are used, and specifically if turner bars 712, as seen in FIG. 20, the areas at which the partial webs strike the turner bars can be different for the web ribbons to be assigned to the different products. The alignment of the partial webs or web ribbons bx; by; bz of one, partial product to be formed and of those of the other, partial product to be formed, which webs or ribbons run in the direction of folding unit 800, are offset slightly from one another laterally. The result is that the one ribbon bundle enters the folding unit 800 offset laterally from the other ribbon bundle.

Figure 21:
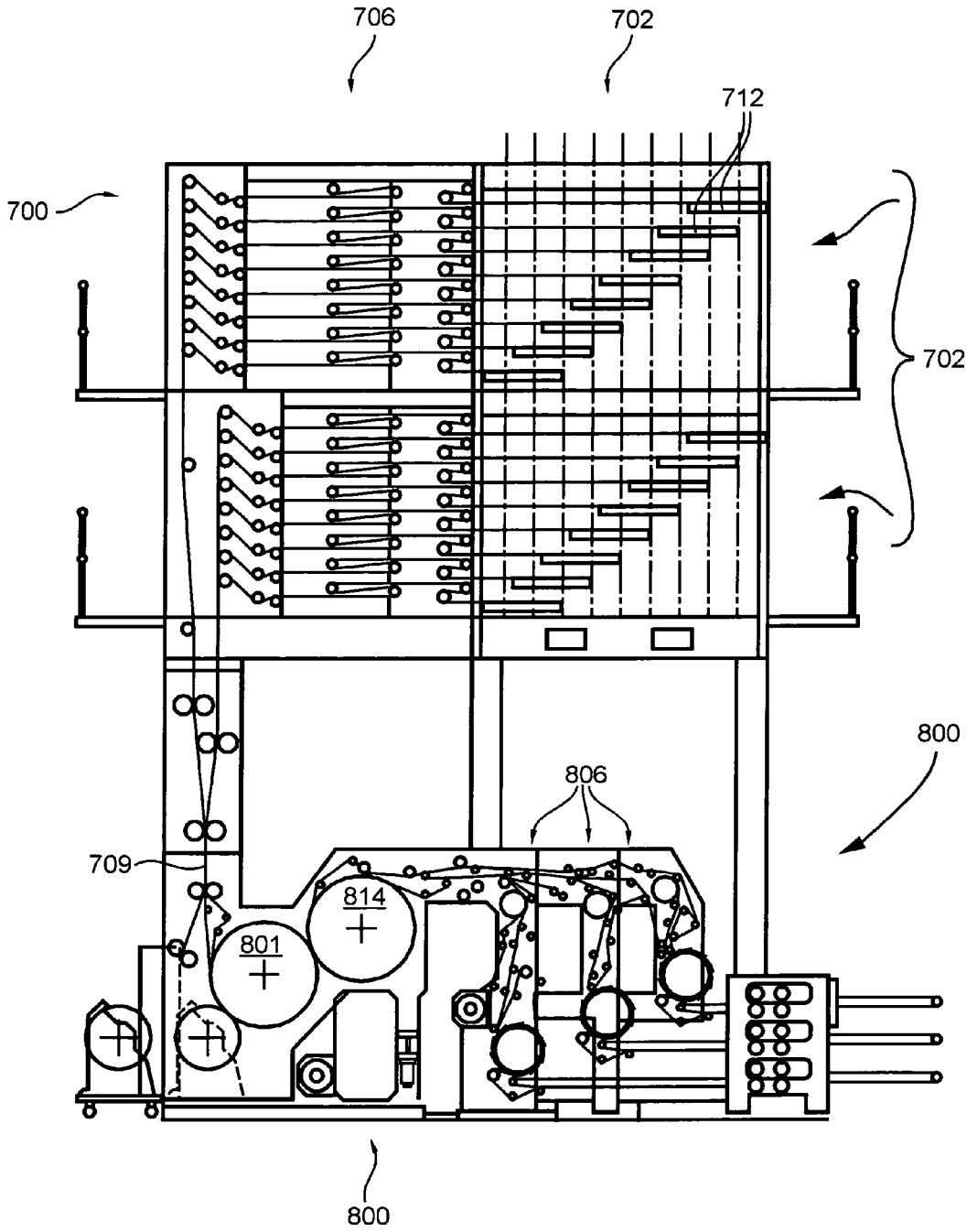
FIG. 21 a side elevation view of an embodiment of a superstructure with a folding unit.

In another embodiment, a folding unit 800, such as, for example, a folding unit 800 with a folder, such as, for example, a cylinder group comprising cylinders 801; 814, and particularly transport and folding jaw cylinders, can have multiple, such as, for example, two or three, outputs 806, which can be seen, for example, in FIG. 21, where the different products are delivered. The different products result, for example, from different printing images belonging to the different, partial products, arranged one in front of the other, for example, in the circumferential direction, on the forme cylinders 304.

Figure 22:
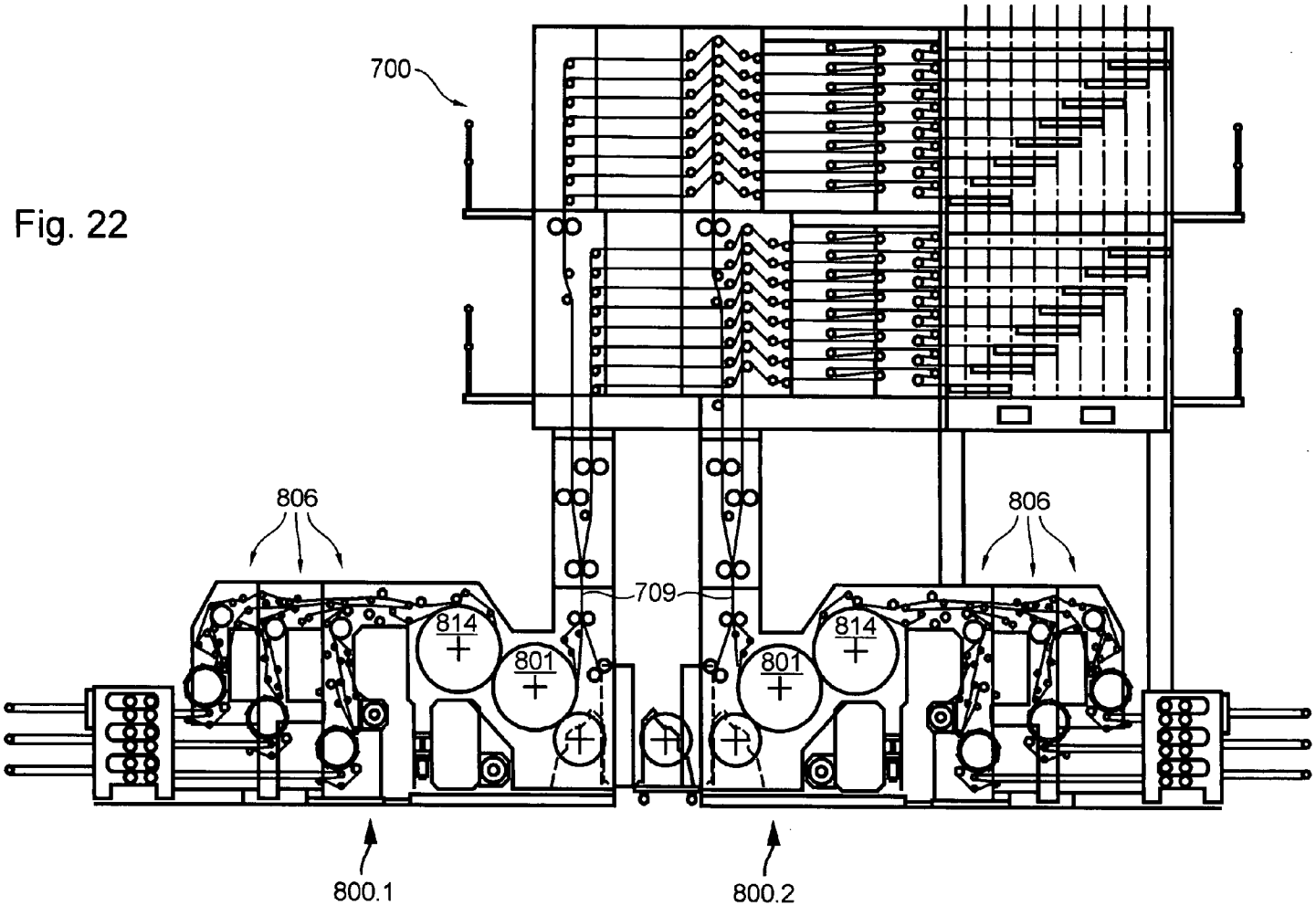
FIG. 22 a side elevation view of a further embodiment of a superstructure with folding units.

In a further, somewhat more variable embodiment, a folding unit 800 can have a multiple folding unit 800, with individual units 800.1; 800.2, each with multiple cylinder groups such as, for example, with two or three folding units, for example, folding cylinder groups, each with one output 806 or with multiple outputs 806 where the different products are delivered, all as seen in FIG. 22 and in FIG. 24.

Further equipment and furnishing is based upon the possibilities of the folding unit/folding units 800 of the superstructure 700.

A superstructure 700, having one or more fold formers 708, can be equipped with "j" fold formers 708, wherein "j" is a number greater than 0, and which fold formers 708 are either stationary or can be displaced longitudinally or transversely. With "j">=2 fold formers 708, it is possible, in principle, to separate the products that lie one inside the other in the shingle stream. For longitudinally offset fold formers 708, see the discussion above.

Particularly, in the case which is presented here, of printing couples 301 having printing couple cylinders 303; 304 of at least double circumference and thus having at least four horizontal or vertical standard pages, for example in DIN A4 format, one in front of the other in the circumferential direction, are suitable for very flexibly processing products containing vertical and/or horizontal pages. In this context, it is advantageous for flexible further processing, to provide one or more variable format folding units 800. As will be discussed below, and/or multiple folding units 800, or one multiple folding unit, having different cut lengths at the same time. A combination of these, and/or optionally an additional cutter, can also enable particular flexibility.

For the various applications with the corresponding folding units 800, a superstructure 700, that has preferably been optimized appropriately, is advantageous. For example, in one embodiment, a folding unit 800, with a fold former 708 which is situated upstream in the ribbon path, is advantageous for producing a product to be produced on a cross-fold, with vertical "v", which is identified in FIG. 37, FIG. 38, FIG. 39, and FIG. 40 in part by an orientation "v" printed pages, referred to here as broadsheet arrangement "s", for example on the forme cylinder 304, in the manner of a newspaper with longitudinal and cross folds, combined with a second folding unit 800 for "h" pages lying horizontally on the forme cylinder 304, in an orientation "h", preferably with an allowance for trimming, for finished products in a tabloid, book, or telephone book format.

A combined production of commercial products and/or of telephone book products and/or of books side by side and/or in series, on the same machine, is also advantageous in terms of cost-effectiveness. In the case of smaller product page numbers, production using only partial width webs B cannot be considered with simultaneous production.

Several sections, or all of the sections, of a final product or even of different, partial products can be produced in a single press run.

In the case of a superstructure 700, which is embodied with fold formers 708, the provision of at least two fold formers 708 is advantageous, especially if multiple sections or products are to be produced simultaneously.

For online production, additional options for inline processing, such as punching tools and/or perforating devices and/or trimming devices and/or longitudinal or transverse gluing devices and/or devices for cross-cutting and/or at least one cross stitcher can be provided in the superstructure 700, either separately or in combination.

In any case, the superstructure 700 comprises a slitter, generally at 701, with which the web B; B' can be cut into partial webs "bx" or into web ribbons "bx", each of one and/or two printed pages in width. In a printing unit 300, which is embodied for a standard eight DIN A4 pages arranged side by side, preferably at least seven blade units 705 are provided side by side. In a printing unit 300, which may be embodied for x, wherein x=6, 8, 10 or 12 DIN A4 pages arranged side by side, a number of at least x−1 blade units 705 are provided side by side, and extending transversely to the web direction. At least some, but preferably all, of the blade units 705 which cut the web B; B' into web ribbons "bx", are preferably arranged so as to be displaceable transversely to the web B; B'. The blade units 705 are each rotationally driven individually and/or can be engaged/disengaged individually from the web B; B'. Preferably, the blade unit 705 is embodied as being supported to be axially movable on a stationary cross member. Axial alignment of the blade units can be carried out using manually adjustable methods, such as manual detachment and displacement, manually driven spindles, and the like, or in an advantageous embodiment, using drives, such as, for example, using motor-driven drives by spindles. The latter is particularly advantageous when the axial positioning or at least the axial pre-adjustment will be carried out automatically by the machine controller, on the basis of the intended width of the web B; B' for imprinting and on the intended cutting lines specific to the product, or will be carried out from a control panel, or in an automated fashion.

A web edge control device or a web center control device with, for example, a rotary frame and sensor system, a silicone unit with two forme rollers that can be brought sequentially into contact with the web B; B' and which are each driven separately by a motor, optionally a sensing device for measuring ink density, and optionally a perforating unit, which is indicated only by dashed lines can also be functionally and/or structurally assigned to the superstructure 700, and especially can be situated upstream of the slitter 701. Also advantageous is the provision of suitable scanning heads for color register control on both sides of the web B; B'.

In an embodiment of the superstructure 700, as a former superstructure, which is not specifically shown here, the resulting web ribbons "bx" are all guided over the edges of fold formers 708. In order for the web ribbons "bx" to be offset laterally in their alignment, and depending upon product requirements, one or more turning devices 711, with turner bars 712 to be traversed in pairs, for offsetting a number of partial webs "bx", can be provided upstream of the former unit 703 with one or more fold formers 708. The web ribbons "bx", which are guided over the fold former or formers 708, are then fed, either folded along the longitudinal fold, or opened up, as a ribbon bundle to the folding unit 800.

In another embodiment of the superstructure 700, such as a magazine superstructure 700, which may be seen, for example, in FIG. 20, the resulting web ribbons "bx" are not guided over fold formers 708, but are instead guided, as web ribbons "bx" of a single page in width, up to a turner unit 702, which has at least a number of turner bars 712, located, for example, side by side transversely to the infeed direction, and which number corresponds to the standard maximum number "x" of printed pages to be printed side by side on a maximum width web B, for example in horizontal or vertical DIN A4 format, as seen in FIG. 20 and in FIG. 21.

After the web ribbons "bx" have been deflected 90°, as projected into the horizontal, the web ribbons "bx" pass through a register device 706 comprising at least x−1 register rollers 707, as seen in FIG. 20. This is done before the web ribbons "bx" to be assembled are combined to form one or more combined ribbons 709, and which combined ribbons 709 are fed to one or more folding units 800, 800.1; 800.2 that are situated downstream, as seen in FIG. 22.

FIG. 20 shows a superstructure 700 of this magazine superstructure type, by way of example, with a turning device 702 for a web B; B' that has been imprinted with x=12 printed pages side by side. FIG. 21 shows a superstructure 700, by way of example, which has, for example, one turning device 702 for two webs B; B' of two printing couple lines M, the turning device 702 comprising a total of 16 turner bars 712, for example, or comprising two turning devices 702, each with x=8 turner bars, for example.

Preferably, a plurality of the turner bars 712, and especially all of the turner bars of the turning device 702, are movable transversely to the entering web ribbon "bx", and/or are embodied to have a length, which, when projected onto the width of the entering web ribbon "bx", is longer and particularly is at least 1.5 times longer than a printed page of the standard format F1, such as, for example, DIN A4 format, in a transverse direction. In this manner, web ribbons "bx" having printing widths that are greater than the standard format F1 can also be turned.

FIG. 21 shows, by way of example, the guidance of the web ribbons "bx" together into a folding unit 800.

As is shown in FIG. 22, however, the web ribbons "bx" can also be guided, in a parallel arrangement, into two folding units 800.1; 800.2. In this case, if multiple original webs B; B' are present, web ribbons "bx" of the one web B; B' can be assigned to the ribbon of the web ribbons "bx" of the other original web B; B'. This allows different product thicknesses to be realized simultaneously.

Figure 25:
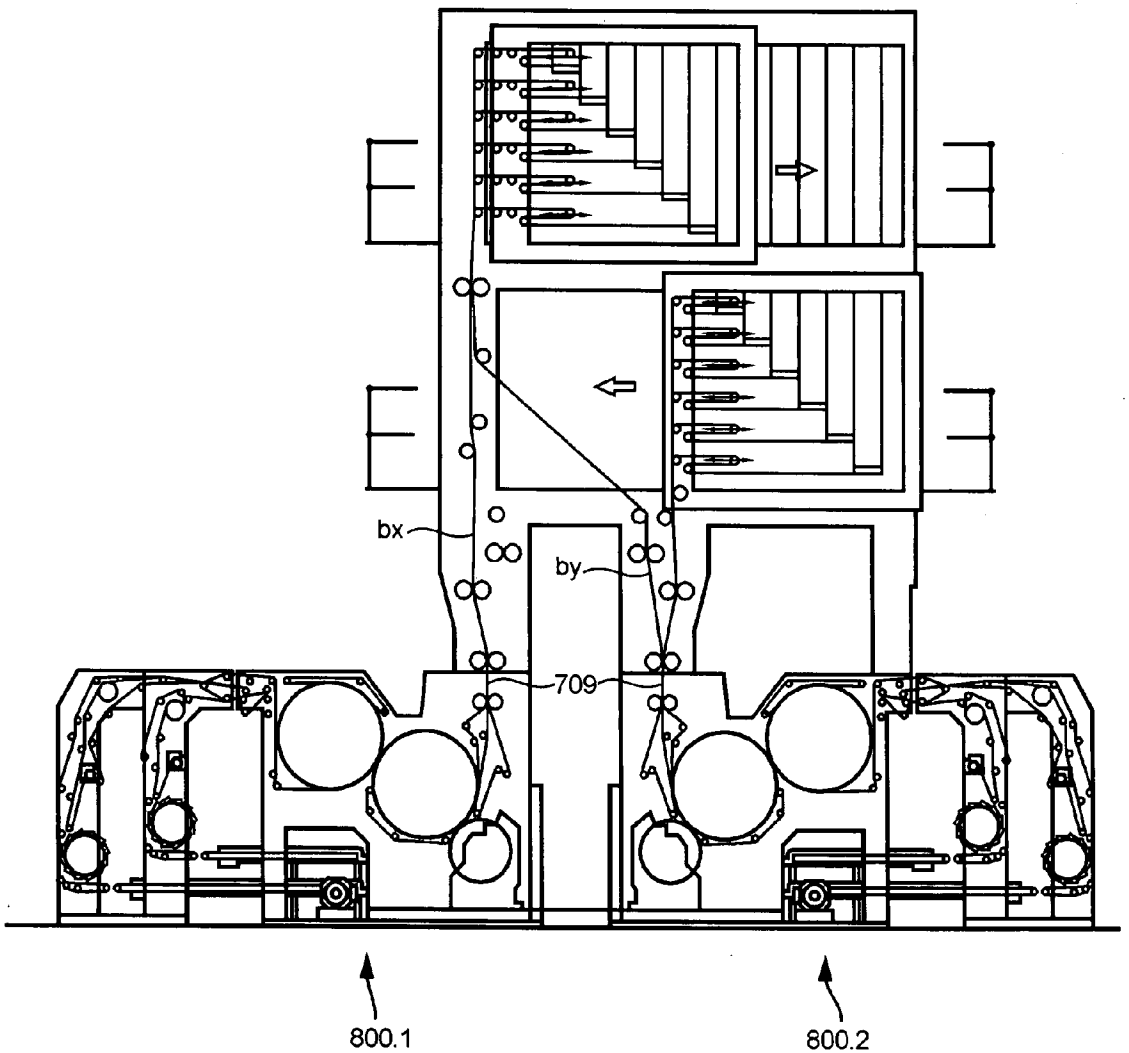
FIG. 25 still a further embodiment of a superstructure with folding units.

FIG. 25 shows an embodiment in which the "x" web ribbons "bx"; "by" from an original web B; B' can be divided between two folding units 800.1; 800.2 by the use of "x" turner bars. With a printing press or web B; B' having such a width, with each revolution two identical products or two different partial products can be produced at the same time, each in one folding unit 800.1; 800.2. This can be advantageous, particularly in terms of reducing the difficulties that arise with folding as product thicknesses increase, such as product damage, folding precision decreases, and the like. Also, as is shown here, two products having different numbers of pages can be produced at the same time. For example, and starting from the center of the original web B; B', web ribbons "bx" can be variably added to the ribbon 709 for passage to one or to the other folding unit 800.1; 800.2.

Figure 23:
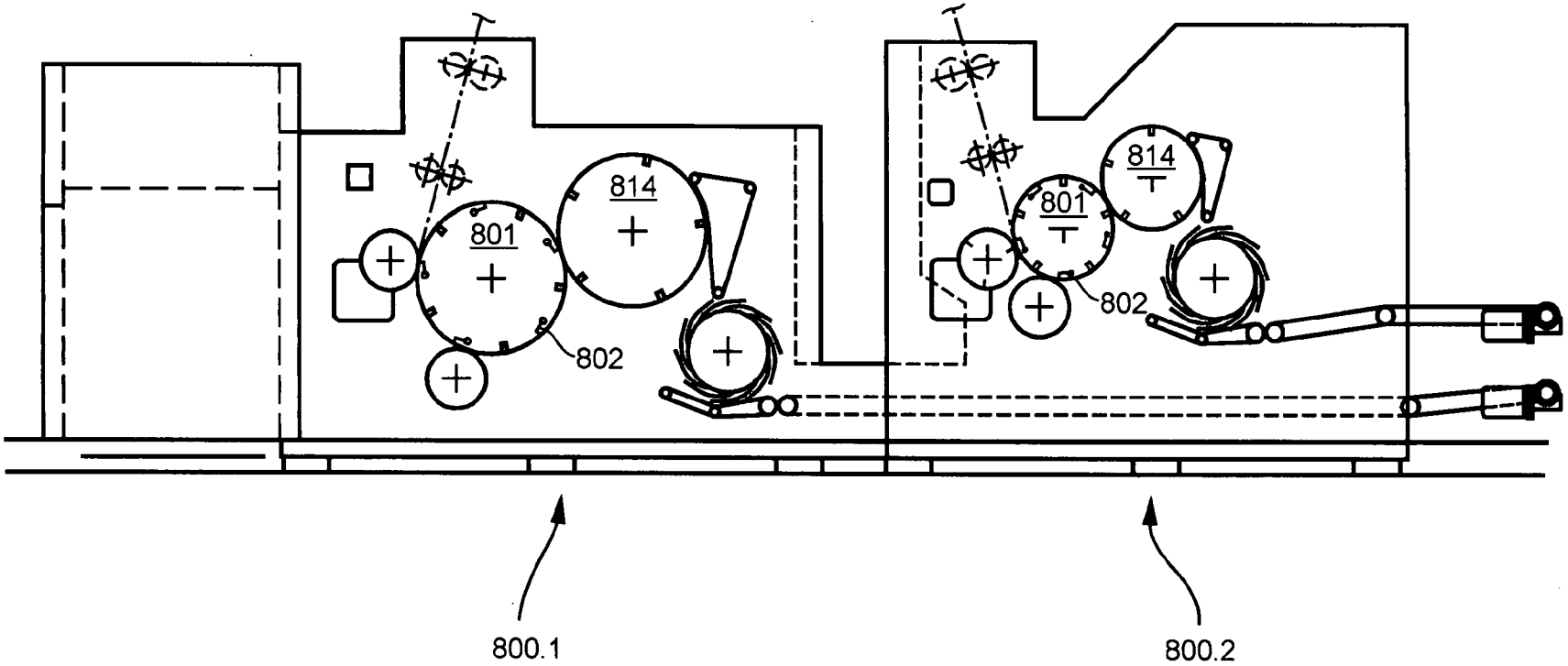
FIG. 23 an embodiment with two folding units having different cut lengths.
Figure 36:
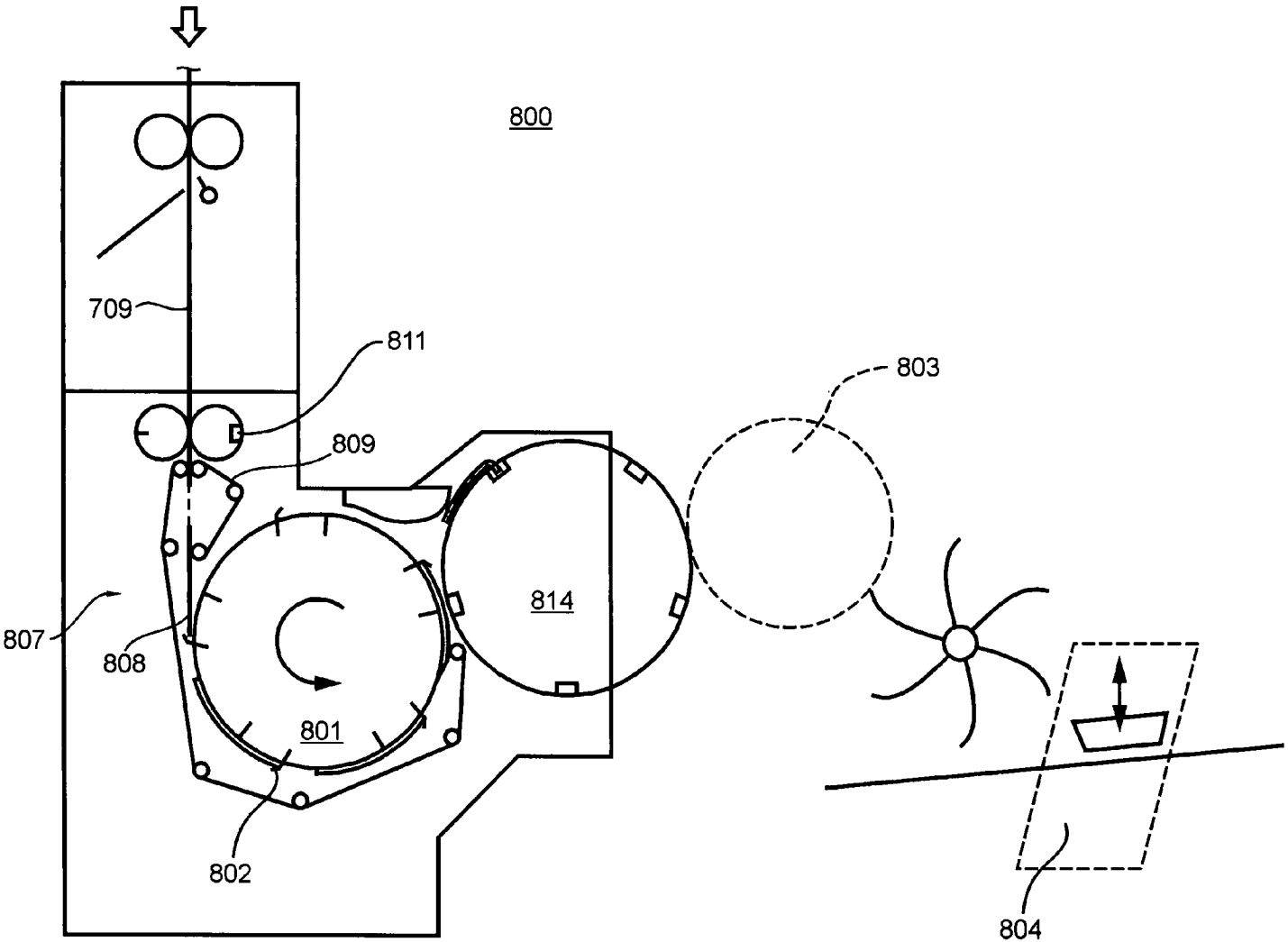
FIG. 36 a schematic side elevation view of a folding unit for variable cut lengths.

In a particularly advantageous embodiment of the present invention, the two folding units 800.1; 800.2 can also be embodied as being different from one another. For instance, one folding unit 800.1 can be embodied as a pin-and-fold unit 800.1 and the other folding unit 800.2 can be configured as a jaw folding unit 800.2. One folding unit 800.1 can be embodied for a first cut length with respect to a fixed-format processing option, and the other folding unit 800.2 can be embodied for a second cut length, different from the first. In this context, see, for example, the two folding units 800.1; 800.2 depicted in FIG. 23, and with different distances between clamping tools 802 of the respective transport cylinder 801, to thereby accommodate different cut lengths, and/or one. One folding unit 800.1 can be embodied for a first cut length, with respect to a fixed-format processing option, for example, of the standard product, and the other folding unit 800.2 can be embodied as a folding unit 800.2 with a variable cut length, such as, for example, with an acceleration path 807, as can be seen in FIG. 36. One folding unit 800.1 can be embodied without an assembly for forming a second longitudinal or cross fold and the other folding unit 800.2 can be embodied with such a second assembly.

In a third embodiment of the superstructure 700, as seen in FIG. 24, an embodiment which is a combination of the first embodiment, which is a "former superstructure" 700, with fold formers 708 and of the second embodiment, which is a "magazine superstructure" 700, without fold formers 708, can be particularly advantageous. In this case, in addition to the turning device 702, a former unit 703, comprising at least one fold former 708, along with a first ribbon path, from turner bars 712 over a fold former 708 to a folding unit 800.1; 800.2, and a second ribbon path, from turner bars 712, without a fold former 708 located in the path, is provided to the same or to a different folding unit 800.1; 800.2. One or more turning devices 711 can be situated upstream of the fold former 708 in the web path. With the combined embodiment, it is possible, in one operating situation, to feed web ribbons "bx" that are only a single page in width over the turning device 702 to a folding unit 800.1; 800.2. In another operating situation, it is possible to guide web ribbons "bx" that are one and/or two pages in width, exclusively over the fold former 708, and to feed these web ribbons, folded longitudinally, to a folding unit. In a third operating situation, it is possible to guide web ribbons "bx" that are one page in width over the turning device 702, and to guide web ribbons that are one and/or two pages in width over the fold former 708. In this manner, two different products, such as, for example, a newspaper-like, longitudinally folded product with printed pages of a first format A in broadsheet configuration "v" on forme cylinder 304, and a tabloid or book-like product of a second format A, such as, for example, in tabloid configuration "h" (horizontal h) on forme cylinder 304 can be produced at the same time in two folding units 800.1; 800.2 which may be provided downstream for this purpose. In the latter case, the two differently processed web ribbons "bx" from two different webs B; B' can come from different printing couple lines M. In a special and advantageous embodiment, however, the two different formats A, such as, for example, format A4 and format A3; Z, can be arranged side by side on longitudinal sections of the same forme cylinder 304, or side by side as print images on the same web B; B'. For example, print images in a vertical newspaper or journal format can be arranged on a longitudinal section of the same forme cylinder 304. On another longitudinal section, print images in another vertical newspaper/journal format or horizontal print pages in a tabloid format can be arranged. Web ribbons "bx", which may be printed through the first longitudinal section such as, for example, in a vertical configuration, are cut, for example, at least partially, into web ribbons "bx" which are two pages in width. These ribbons can then be folded lengthwise, cut crosswise in a folding unit 800.1; 800.2 to sections, the length of which corresponds to a vertical printed page, folded crosswise, and delivered at the delivery point. Web ribbons "bx", which may be printed through the second longitudinal section, for example, in a horizontal configuration, are, for example, cut into web ribbons "bx" that are one page in width. These cut web ribbons can then be guided over the turning device 702, cut crosswise in a folding unit 800.1; 800.2 to sections, the length of which corresponds to two horizontal printed pages, and folded crosswise.

For the embodiments of the present invention containing two folding units 800.1; 800.2, and depending upon the delivery requirements, a back-to-back configuration, as seen in FIG. 24, a front-to-front configuration, as seen in FIG. 25 or an alignment in the same direction can be provided. In the latter case, it can again be advantageous to offset the two folding units 800.1; 800.2 vertically from one another, or to use a folding unit 800 which may be embodied as a double folding unit, and which may be configured with two folding cylinder groups that are offset vertically in relation to one another.

In one special embodiment of the subject invention, the folding unit 800, or at least one of the folding units 800.1; 800.2, is embodied as a folding unit 800 with a variable cut length. Such a variable cut length folding unit has, as is illustrated schematically in FIG. 36, a cross-cutter 811 that is situated upstream of the transport cylinder 801, and an acceleration path 807 for the cut off product sections 808 or signatures such an acceleration path 807 can be provided, for example, by the use of a belt system 809. The equidistant spacing of clamping tools 802 on the transport cylinder 801, such as, for example, gripper cylinder or pin cylinder 801, corresponds, in length, at least to the longest print image to be imprinted, as viewed in the direction of web travel. The transport cylinder 801, along with the belt system 809, is embodied such that it can be operated at a greater conveyance or at a greater circumferential speed than that of the uncut ribbon 709. The units 300 which, for example, are located upstream, are operated essentially at the speed/circumferential speed being used to convey the ribbon 709 that has not yet been cross cut. Based upon the relative circumferential speed of the cross cutter 811, as it is adjusted to the speed of the still uncut ribbon 709, and based upon the cylinder revolution of the transport cylinder 801, longer or shorter product sections are cut off, and then accelerated, and are taken up by the clamping tools 802, such as, for example, grippers or pin strips 802, of the transport cylinder 801. This variable folding unit 800 is therefore suitable for processing different printed page lengths as cut lengths, arranged on the forme cylinder 304, in two different operating situations. These cut lengths can be horizontal printed page sections of the same format, such as, for example, DIN A4 format, in one operating situation, for example, and can be vertical printed page sections of the same format in another operating situation. Alternatively, these cut lengths can be printed page sections that are the length of a first whole-number divisor, such as, for example, three or six, of the circumference of the forme cylinder in a first operating situation, and can be printed page sections that are the length of a second whole-number divisor, such as, for example, two, four or eight, of the circumference of the forme cylinder, which divisor is different from the first, in another operating situation.

The following is a schematic representation of advantageous embodiments of the present invention and having web ribbon guidance for the embodiment of the superstructure 700 in combination with the folding unit 800 or folding units 800.

Figure 26:
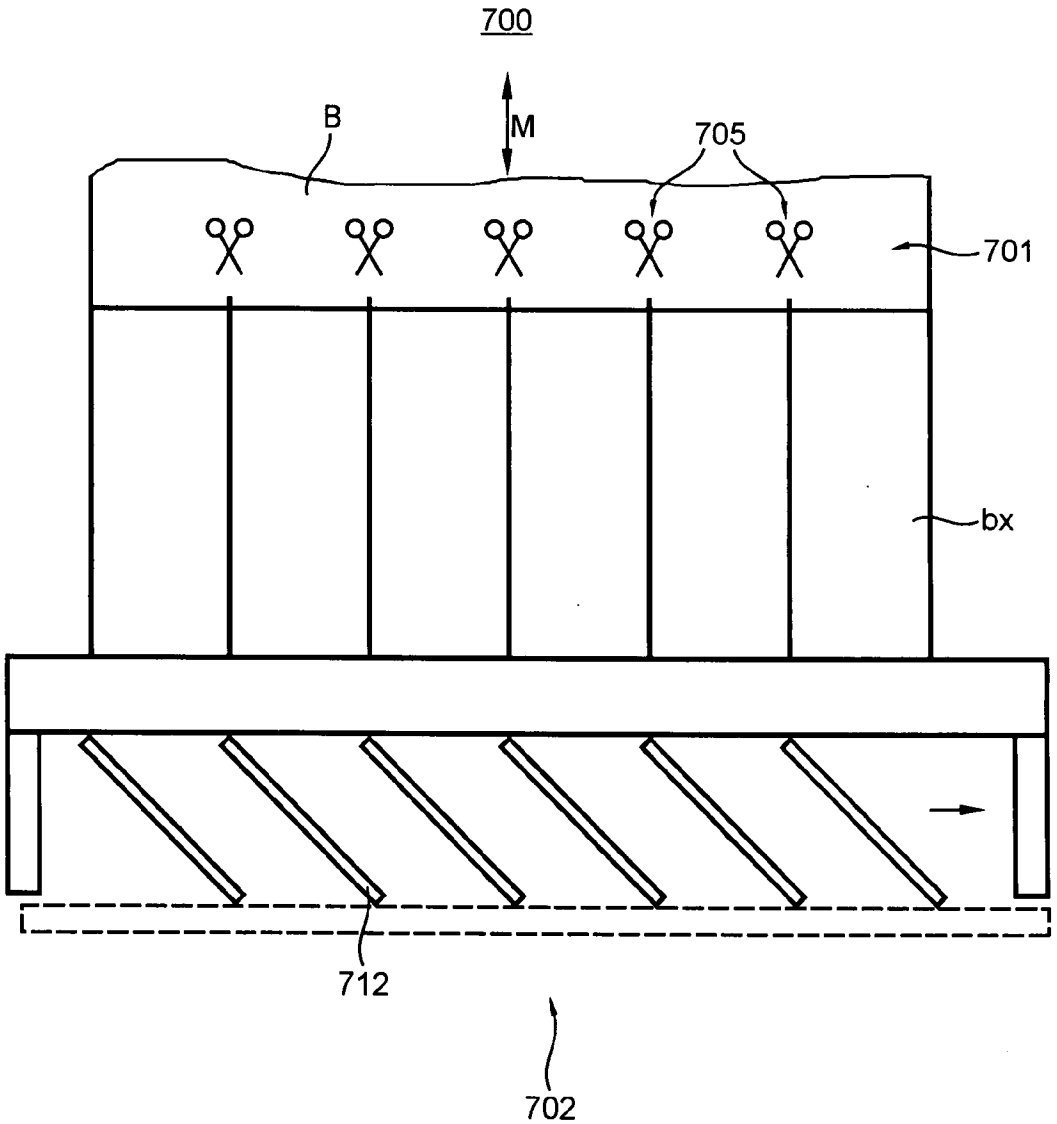
FIG. 26 an embodiment of a web lead with a superstructure.

FIG. 26 shows a so-called machine superstructure 700 comprising a number "x", for example, wherein x=6, of web ribbons "bx", which web ribbons are then slit by x−1 blade units 705, and which web ribbons are then guided onto one another over "x" turner bars and are fed to one or more folding units 800, which are not shown here. The folding unit or units 800 is or are oriented here, for example, in such a way that the rotational axis of the transfer cylinder 801, as depicted in FIG. 36, for example, extends perpendicular to the rotational axis of the printing couple cylinders 303; 304 that are situated upstream, or the transport direction in the folding unit 800, which projects horizontally, extends transversely to the machine alignment M, or to the "machine axis". The web ribbons "bx" each have, for example, only one printed page, and particularly have only one horizontal printed page in, for example, DIN A4 format, across their width. With a plurality of folding units 800.1; 800.2 arranged beneath this superstructure 700, the partial webs "bx", which may be split into two ribbons 709, can also be fed simultaneously to two folding units 800.1; 800.2, or to two groups of folding cylinders of a double folding unit 800.1; 800.2. In this embodiment, or in the subsequent embodiments, the turner bars 712 can be cantilevered, or can be mounted on both sides using a frame, which is indicated in FIG. 26 by dashed lines. One, several, or all of the turner bars 712 can advantageously be mounted so as to be movable across an adjustment area, transversely to the incoming web B; B' or to the partial web "bx".

Figure 27:
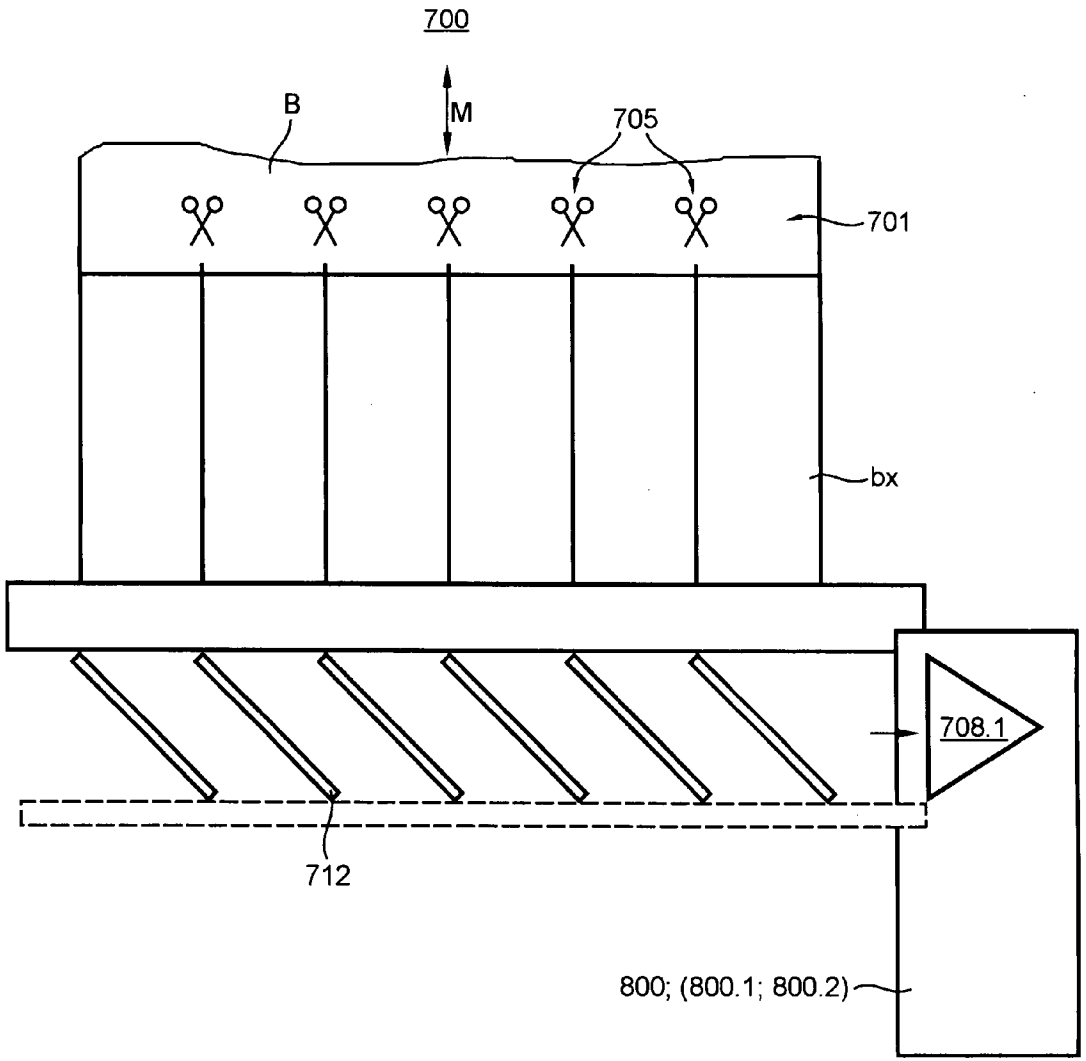
FIG. 27 a further embodiment of a web lead with a superstructure and with a folding unit.

FIG. 27 shows a superstructure 700, which is embodied as a so-called former superstructure 700. In this device, the fold former or formers 708 have a take-up direction projecting horizontally, and which extends perpendicular to the machine alignment M. A number "x" of web ribbons "bx", for example, wherein x=6, or in the case of cross-fold production, for example, wherein x=3, and which are slit by x−1 blade units 705, are combined over "x" turner bars 712, are guided over one or, optionally, are guided separately over multiple fold former 708, and are fed to one or more folding units 800 to form a cross fold. In this case, the folding units 800.1; 800.2 is or are oriented in such a way that the rotational axis of the transport cylinder 801 extends parallel to the rotational axis of the printing couple cylinders 303; 304, which are arranged upstream. Alternatively, the transport direction in the folding unit 800, which projects horizontally, extends parallel to the machine alignment M or "machine axis". The web ribbons "bx", upstream of the turner bars 712, each have two printed pages, for example, over their width, such as, for example, two horizontal printed pages in, for example, a DIN A4 format. In a broadsheet or cross-fold production, the web ribbons "bx" that are two pages in width, are folded longitudinally over the fold former 708, and for cross-cutting and cross-folding, are fed to the folding unit 800 or to multiple folding units 800. In tabloid production such as, for example, having printed pages arranged horizontally on the forme cylinder 304, the web ribbons "bx" can be cut between turner bars 712 and fold former 708 into web strips one page in width, and can then be laid one on top of the other by the fold former 708. With a plurality of folding units "FA" 800.1; 800.2 arranged beneath these, the partial webs "bx" split into two ribbons 709 can also be fed simultaneously to two folding units 800.1; 800.2, or to two groups of folding cylinders of a double folding unit 800.1; 800.2.

Figure 28:
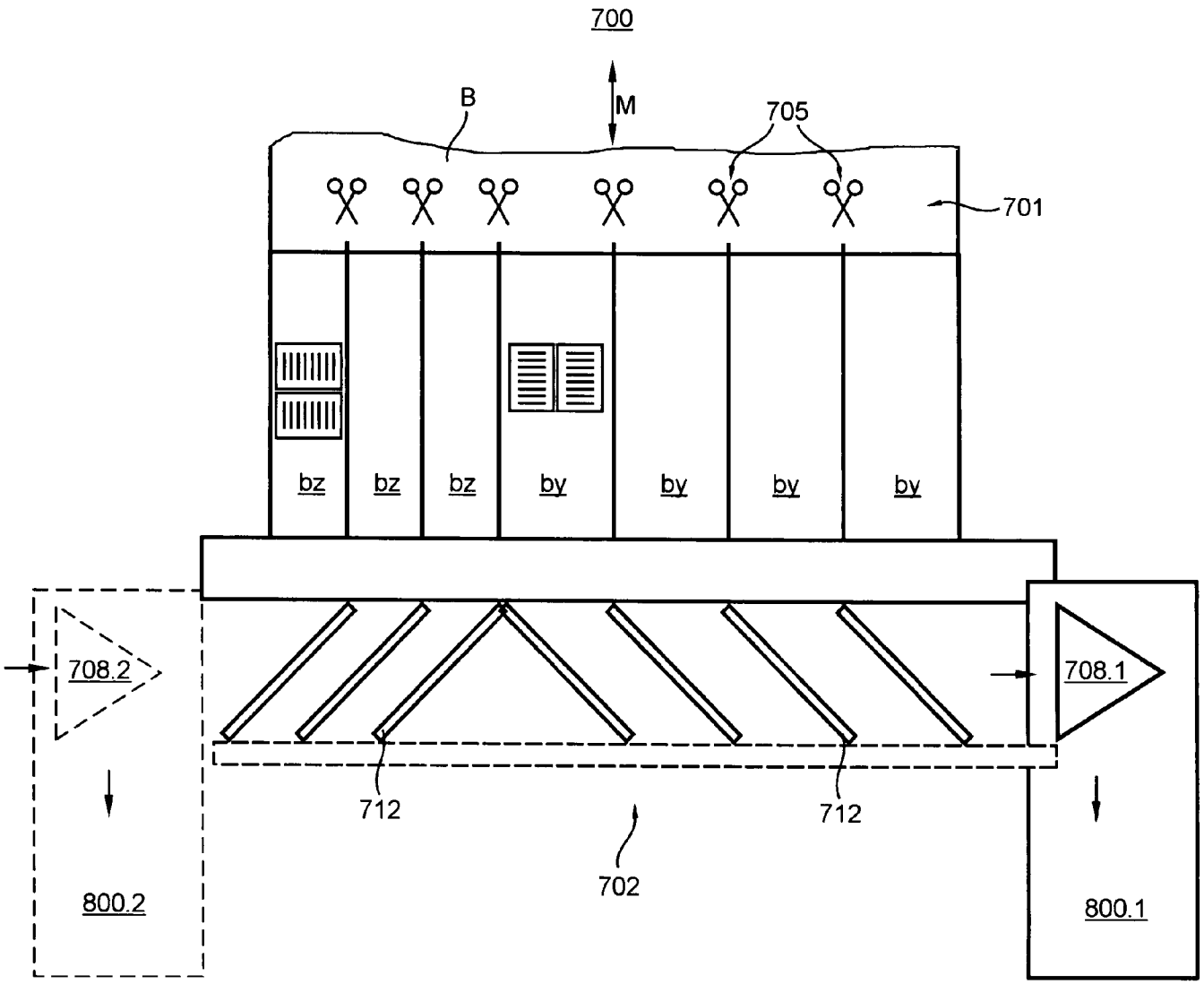
FIG. 28 yet a further embodiment of a web lead with a superstructure and with folding units.

FIG. 28 shows the simultaneous production of two different products or partial products or product formats from the same imprinted web B; B'. This can be accomplished by using one former superstructure 700 and two folding units 800.1; 800.2.

In this case, the web B; B' is cut into a number "y" of web ribbons "by" having a first web width and/or having first printed page orientation and/or having a first printed page format, and a number "z" of web ribbons "bz" having a second web width that is different from the first web width and/or having a second printed page orientation and/or a second printed page format, optionally corresponding to the respective printed page widths. The web ribbons "by"; "bz" of the different widths or of the different printed page formats and/or orientations, are then combined to form ribbons 709 and are fed to different folding units 800.1; 800.2. In this process, for example, the wider web ribbons "by" are folded longitudinally over fold former 708.1, and are further processed in a first folding unit 800.1 to produce a cross-fold product such as, for example, like a newspaper. Web ribbons "bz", that are one page in width, are laid one on top of the other using the other fold former 708.2, and are further processed in the second folding unit 800.2 to produce a tabloid product, such as, for example, an essentially A4 product as indicated by dashed lines. In the second ribbon path, the fold former 708.1; 708.2 can also be dispensed with, in which case the folding unit 800.2 is then optionally rotated 90° in relation to the figure. In FIG. 28, by way of example, possible orientations of horizontal or tabloid printed pages and vertical or broadsheet printed pages are shown. In FIG. 28, the feed directions, as depicted by the arrows, of the fold formers 708.1; 708.2, which are provided on both sides of the superstructure, and the transport directions in the folding units 800.1; 800.2, are embodied as being parallel to one another.

Figure 29:
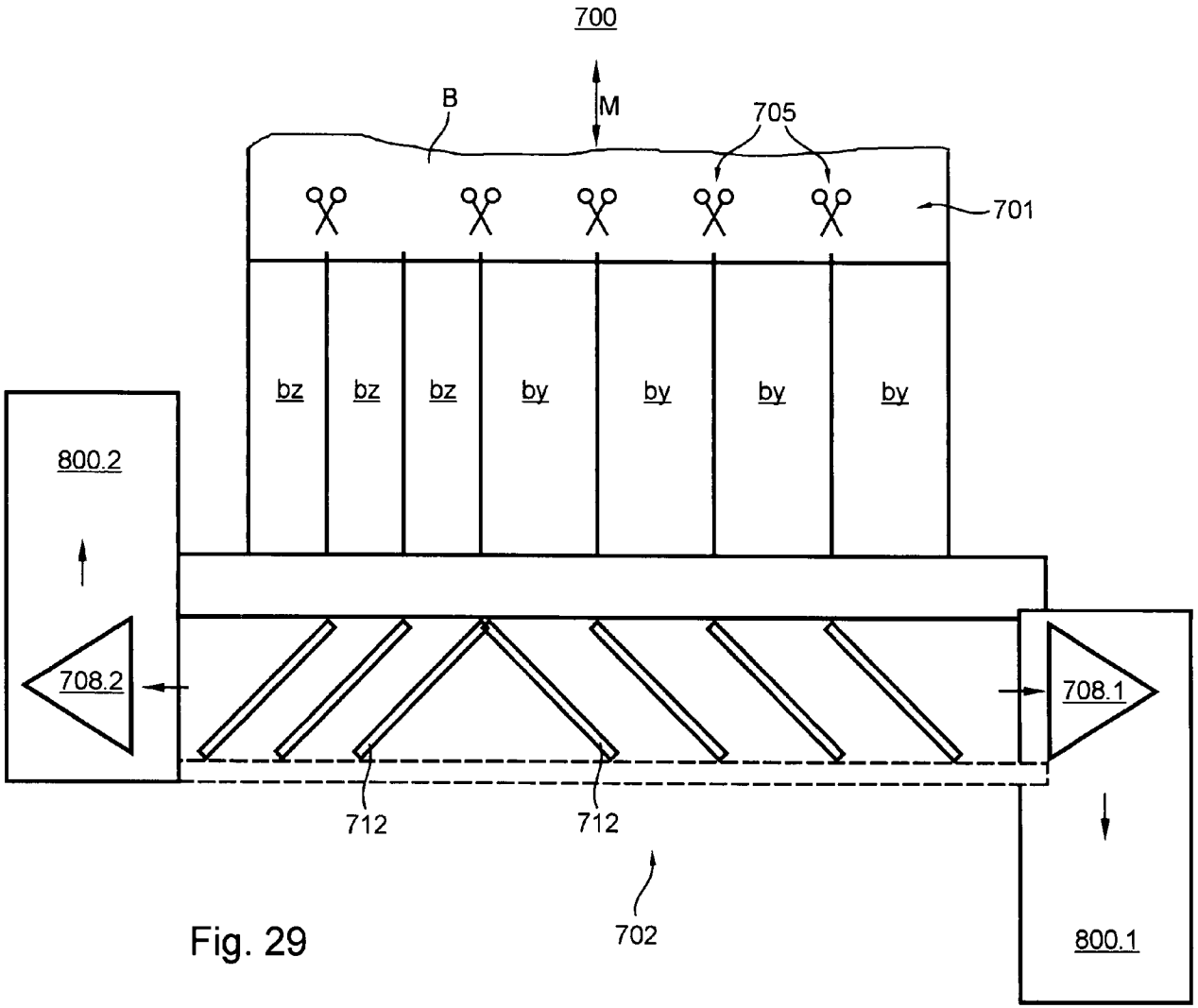
FIG. 29 still a further embodiment of a web lead with a superstructure and with folding units.

FIG. 29 shows an arrangement which is generally similar to FIG. 28. However, in this case, the feed directions of the fold formers 708.1; 708.2, which are provided on both sides of the superstructure, and the transport directions in the folding units 800.1; 800.2 are embodied as being antiparallel to one another. The latter is advantageous in terms of a backup function, since without great expense, the same product with the same loading configuration of the cylinder 304 can be produced on one or on the other folding unit 800.1; 800.2.

Figure 30:
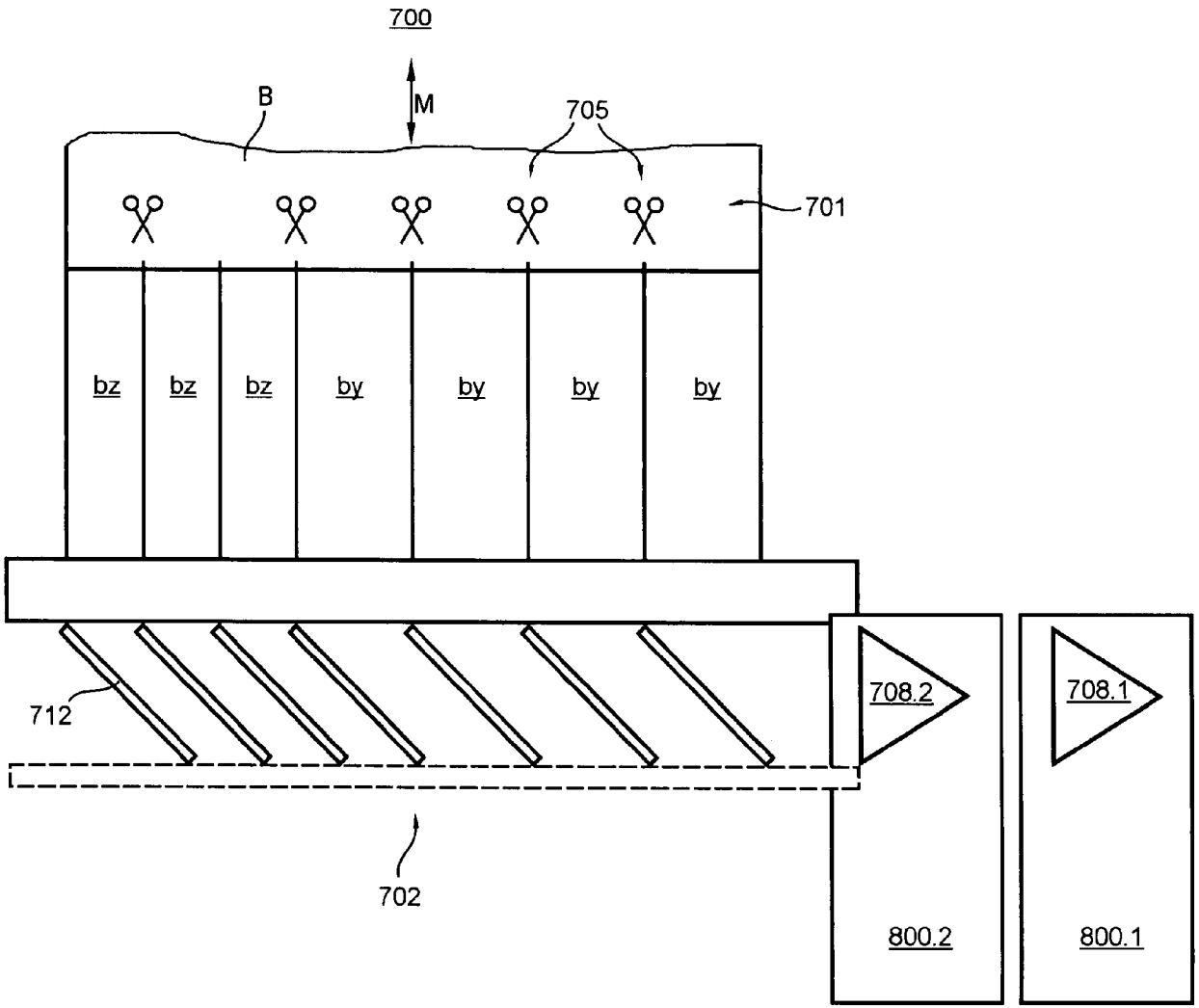
FIG. 30 even yet a further embodiment of a web lead with a superstructure and with folding units.

FIG. 30 shows another embodiment of the present invention, which is similar to the aforementioned examples, but with two folding units 800.1; 800.2 both arranged on the same side of the machine, and in particular, with two fold formers 708.1; 708.2 arranged upstream, respectively.

Figure 31:
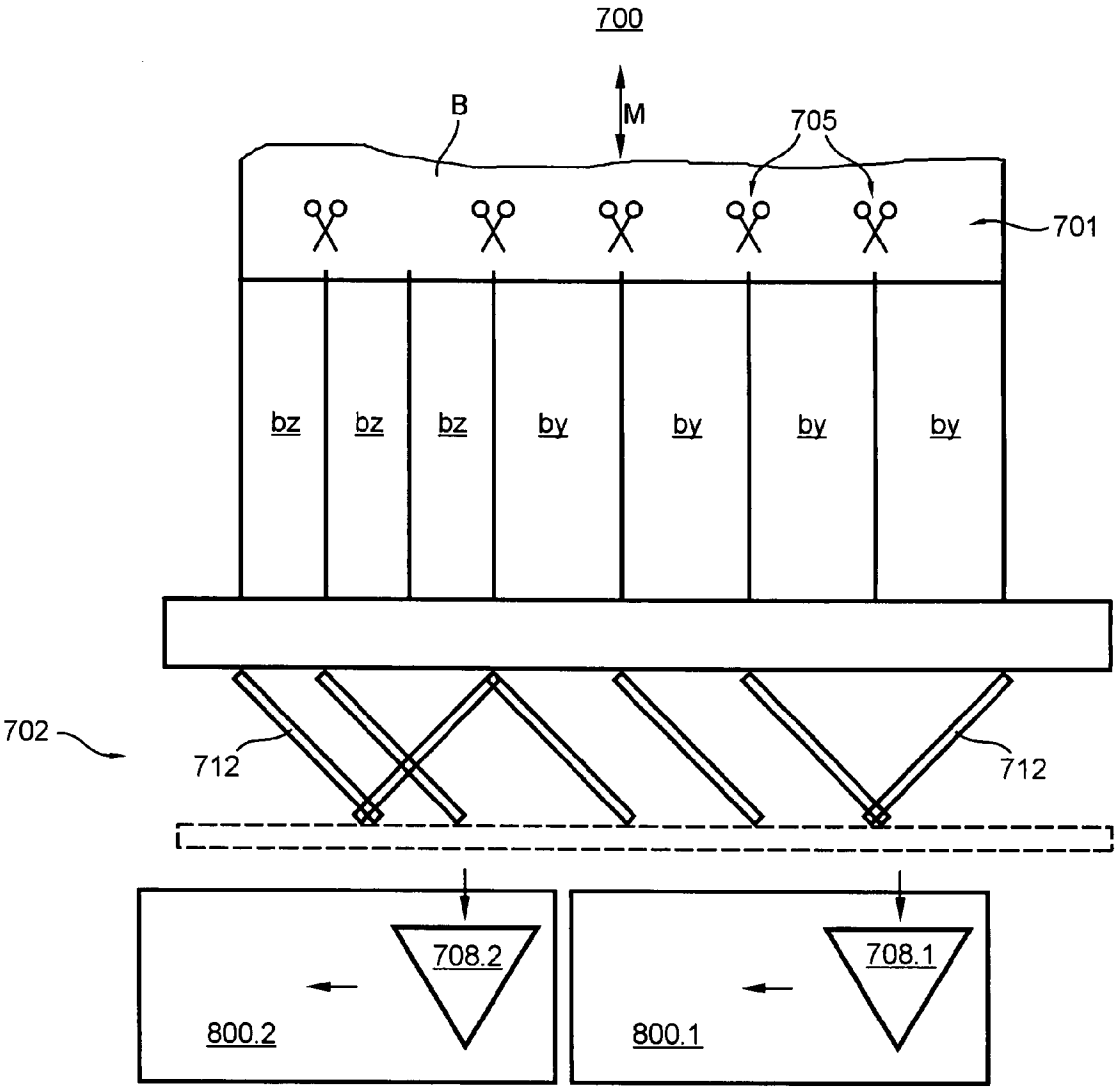
FIG. 31 still yet another embodiment of a web lead with a superstructure and with folding units.

FIG. 31 shows an advantageous embodiment of the present invention in which a feed direction into the fold formers 708.1; 708.2, which projected horizontally, extends parallel to the machine alignment M and/or extends perpendicular to the rotational axes of the printing couple cylinders 303; 304. In this case, the folding unit or units 800.1; 800.2 is or are oriented, for example, in such a way that the rotational axis of the transport cylinder 801 extends perpendicular to the rotational axis of the printing couple cylinders 303; 304 that are situated upstream. Alternatively, the transport direction in the folding unit 800.1; 800.2, which projects horizontally, extends transversely to the machine alignment M or "machine axis". In this example, an operating situation is again shown in which, for example, printed pages of different widths or orientations will be or are imprinted onto the web B; B', and that web is then cut into web ribbons "by"; "bz" of different widths, and are further processed simultaneously in two folding units 800.1; 800.2 to produce two different products, such as intermediate products. The two folding units 800.1; 800.2 can be embodied on the same plane, can be offset vertically from one another, or can be configured as a folding unit 800 comprising two folding cylinder groups and two delivery points.

Figure 33:
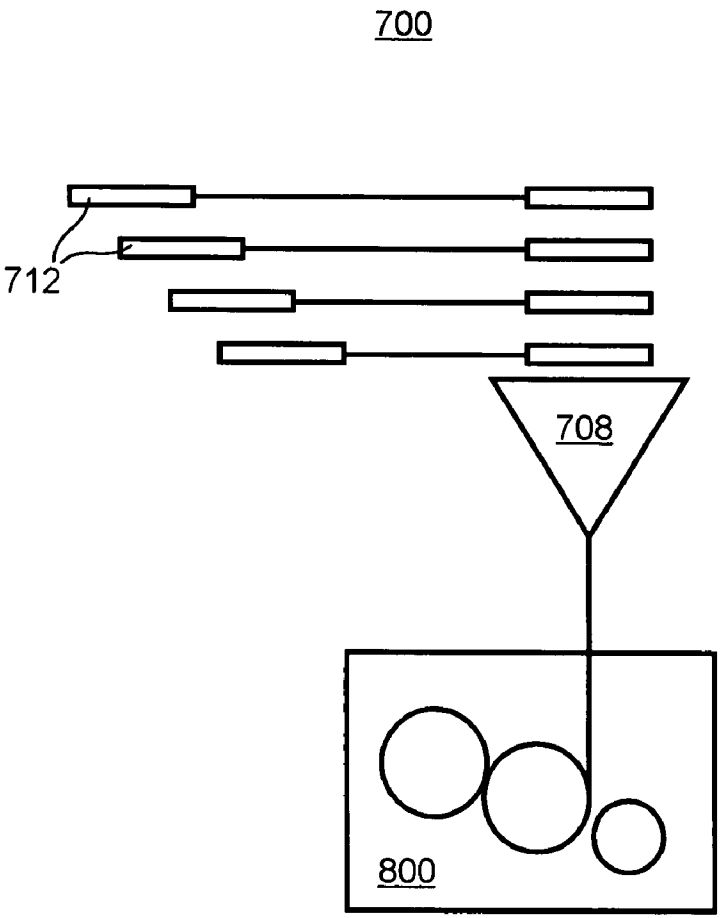
FIG. 33 a further schematic front elevation view of a superstructure and folding unit.
Figure 32:
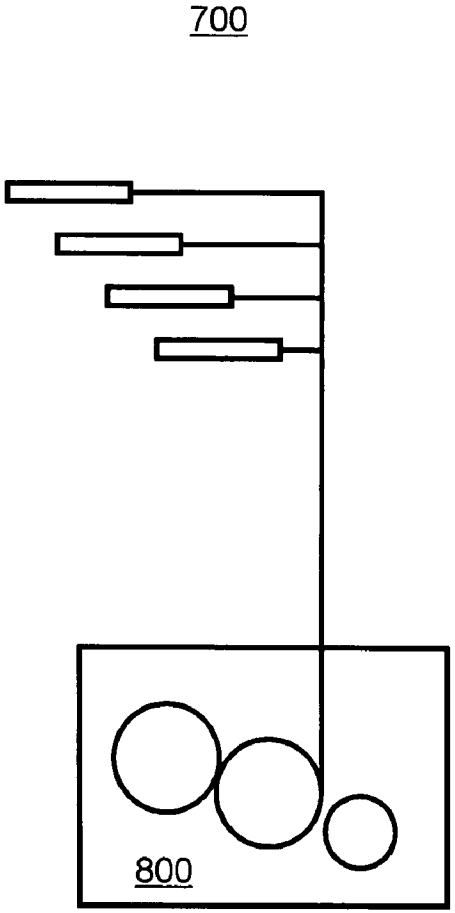
FIG. 32 a schematic front elevation view of a superstructure and folding unit.

FIG. 32 shows a schematic front elevation of a magazine superstructure 700, without a fold former, with a folding unit 800 located downstream, which is comparable with an embodiment according to FIG. 26. FIG. 33, in contrast, shows a former superstructure 700 with a fold former 708 located between the turner bars 712 and the folding unit 800.

Figure 35:
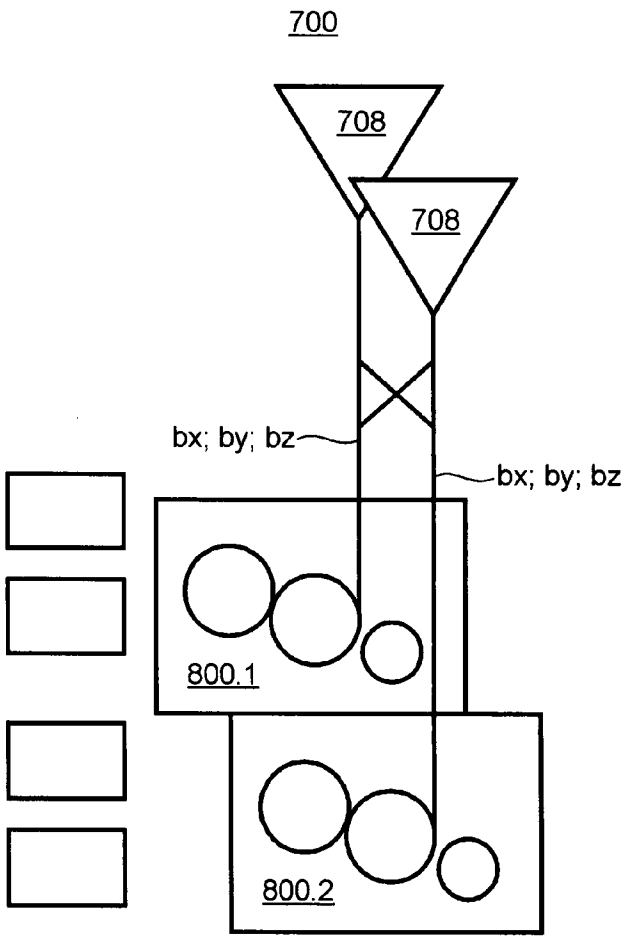
FIG. 35 still yet another schematic front elevation view of a superstructure and folding units.
Figure 34:
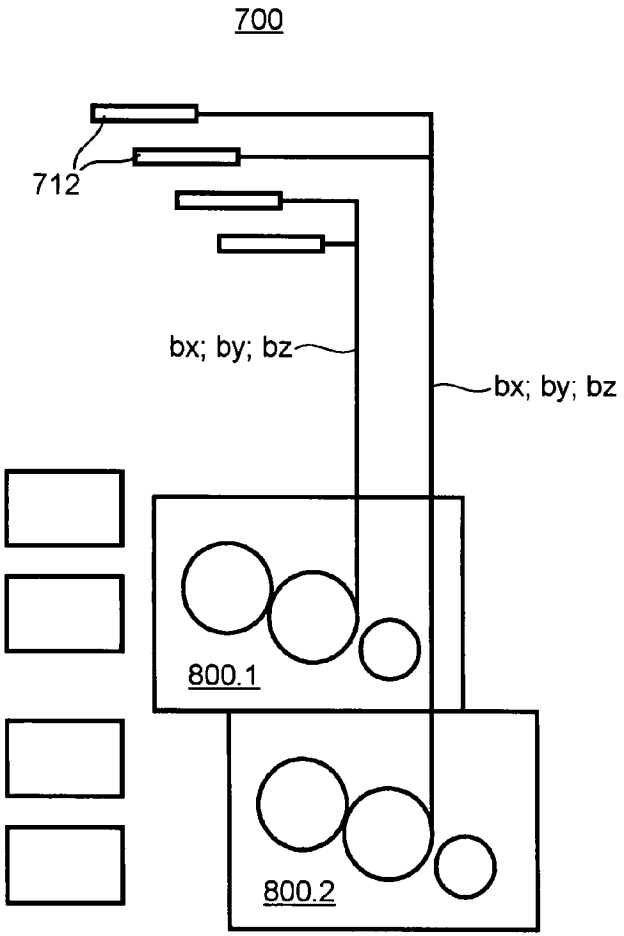
FIG. 34 yet a further schematic front elevation view of a superstructure and folding units.

FIG. 34 shows a schematic front elevation of a magazine superstructure 700, without a fold former, and with two folding units 800.1; 800.2 situated downstream. Using a number of web ribbons "bx"; "by"; "bz", with that number representing merely an example, a separation between two folding units 800.1; 800.2 is illustrated schematically. Similarly, FIG. 35 schematically illustrates the embodiment of a former superstructure 700 with two fold formers 708 and two folding units 800.1; 800.2, in which two ribbon bundles of web ribbons "bx"; "by"; "bz" are guided over the fold former 708, and are fed to two folding units 800.1; 800.2 simultaneously. As indicated by the "crossing," one, several, or all of the web ribbons "bx"; "by"; "bz" can be transferred from one bundle to the other, such as, for example, to correspondingly achieve different section or product thicknesses. A stitcher can also be provided at individual ribbons, to thereby allow a part of the signatures to be removed from the later product as a stitched book. The folding units 800.1; 800.2 which are arranged here offset, and one on top of the other, can also be arranged side by side at the same level. In addition, turning devices 711, which are not shown specifically here, can be situated upstream of the folding units.

If only one folding unit 800 is provided, that folding unit, or if two folding units 800.1; 800.2 are provided, at least one of those folding units 800.1; 800.2, preferably have, in addition to the first cross-folding device, such as, for example, a transport cylinder 801 which may be embodied as a pin-and-fold blade cylinder, with a folding jaw cylinder 814, a device for forming a second cross fold 803 and/or a device for forming a longitudinal fold 804, and which is situated downstream. This is illustrated, by way of example, in FIG. 24, but is to be applied in each case to one of two folding units 800.1; 800.2 or to the sole folding unit 800 of the other examples.

Figure 37:
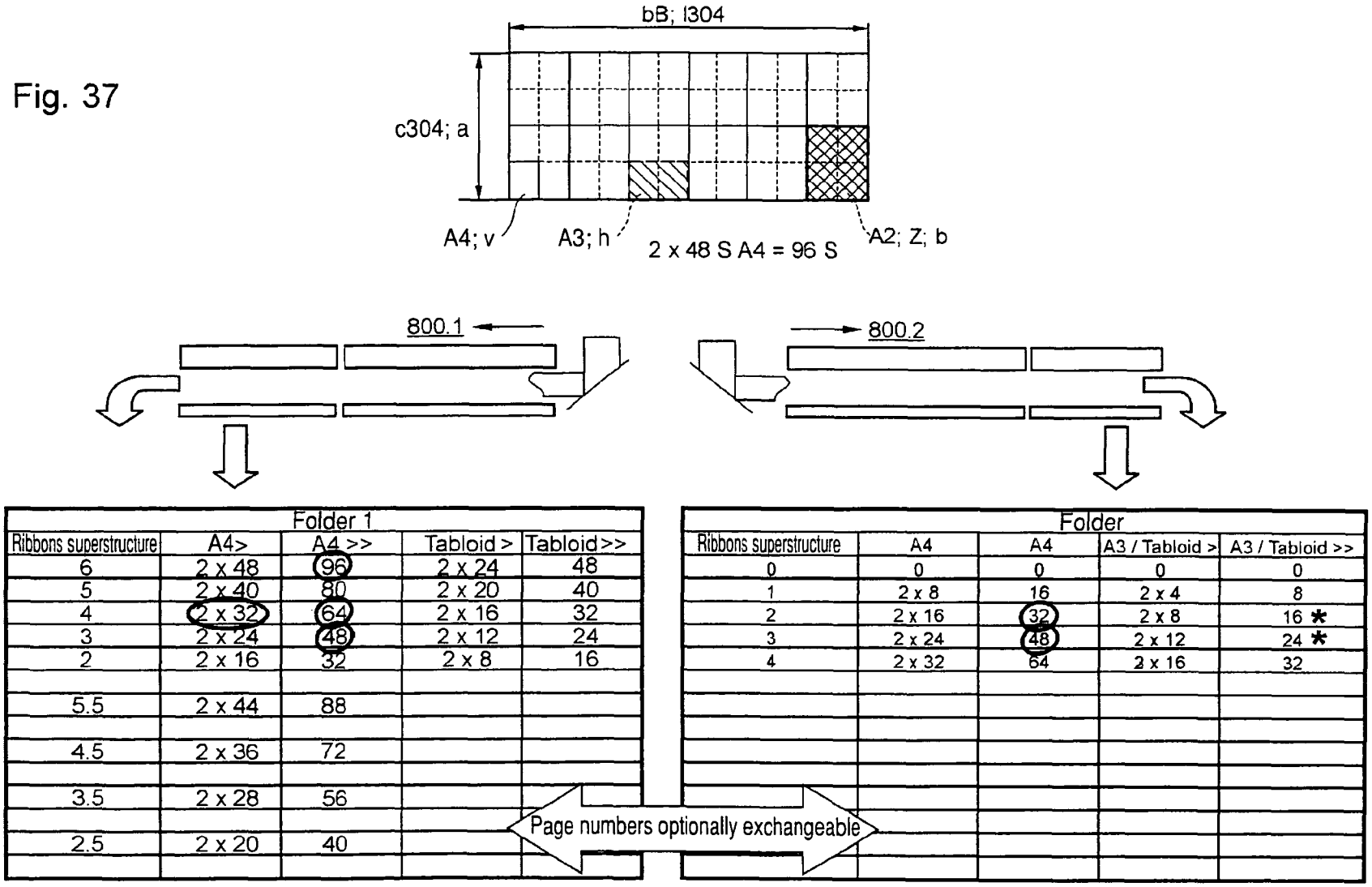
FIG. 37 an illustration of the production possibilities on a double-circumference press with two folding units or with two groups of folding cylinders.

FIG. 37 depicts advantageous production options using a printing couple line M or a web B, the printing couple cylinders 303; 304 of which printing couple line M have a width of 12 and a circumference of four vertical DIN A4 pages, and downstream of which two folding units 800.1; 800.2 or one folding unit 800 with two folding cylinder groups and two delivery points are situated. The dimensions of such a printing couple or a web B have been described previously.

At the top center of FIG. 37, there is depicted a grid for loading vertical DIN A4 format print images, with diagonal hash marks indicating an example of a tabloid page T, for example, in A3 format, and with crosshatching indicating an example of a vertical printed page in a DIN A2 format, or corresponding newspaper format Z, or a newspaper-like printed image format Z.

The two tables shown in FIG. 37 and situated under the folding units 800, which are identified as 800.1 and 800.2, indicate advantageous production schemes. In each case, from one web B; B'; B1; B2, a maximum of one product example from one row of the first table can be produced by the first folding unit 800.1, and at the same time, one product example from the same row of the second table can be produced by the second folding unit 800.2. It is advantageous, for example, if, for one operating mode in standard production with homogeneous forme cylinder loading, such as, for example, with printed pages of a single format arranged over the forme cylinder surface with uniform orientation, a partial product of 48 DIN A4 pages is delivered at the first folding unit 800.1, and a partial product of 48 DIN A4 pages is also delivered at the second folding unit 800.2. These two partial products can then represent two identical products, with a corresponding print image loading which repeats over half the forme cylinder, or which is mirror symmetrical over half the forme cylinder 304, in the longitudinal direction. In the first case, an arrangement can be provided, for example, with an antiparallel folding unit arrangement and/or a former arrangement. As discussed above, and in the second case, for example, with a parallel folding unit arrangement and/or former arrangement, as is also discussed above. In the case of a different print image loading configuration on the cylinder halves, two parts of a combined product, or two different products, can be produced. A further advantageous production variation with three partial products, having the same number of pages, can be produced, if, for example, on one folding unit 800.1, two uncollected partial products, 32 pages thick and made up of four ribbons, each two pages in width, or of 8 ribbons, each one page in width, and on the other folding unit 800.2, an uncollected partial product, 32 pages thick and consisting of two ribbons, each two pages in width or 4 ribbons, each one page in width are produced and delivered. If all the ribbons of the superstructure 700, wherein, in this case, these ribbons are web ribbons "bx"; "by"; "bz" two DIN A4 pages in width, are guided into a folding unit 800.1; 800.2, then in collect production, which is identified in the tables as >>, a product with 96 DIN A4 pages can be produced.

Particular advantages result in production with non-homogeneous cylinder loading, such as, for example, with a loading of the forme cylinder 304 with different print image formats side by side, such as, for example, with a vertical format A4, such as DIN A4 and with a horizontal tabloid in format A3, such as DIN A3, or with vertical print image formats A of different sizes, such as, vertical DIN A4 page, format A4, with vertical DIN A2 page, format A2 or with a newspaper-like format Z, which can advantageously correspond to format A2. For example, a production scheme is advantageous in which, in addition to an aforementioned A4 production, with vertical A4 printed pages, on the first folding unit 800.1, at the same time a production of tabloid format T products is also possible, with rows for two cases marked in the table in FIG. 37 with *, by way of example. For example, on the one folding unit 800.1, a DIN A4 product with 2×32 pages, uncollected > or with 64 pages collected >>, can be delivered. At the same time, on the other folding unit 800.2, a tabloid product with 16 pages collected, or 2×8 pages uncollected, can be delivered. In this case, the ribbons generated from the same web B; B', as indicated in each case in column 1, are divided into four or into two, each with a corresponding width, for example a tabloid product corresponding to one vertical DIN A4 page or two vertical DIN A4 pages. The forme cylinder 304 is loaded with the different print images in each case corresponding to the grid for the necessary ribbons. In FIG. 38*a*), one example of the aforementioned, inhomogeneous loading, with 2×32 or 64 A4, 2×8 or 16 tabloid pages, is provided in the illustration of an unwound forme cylinder 304 or a repeating length of an imprinted web B; B'. The remaining variations for inhomogeneous A4/tabloid production are to be applied accordingly.

FIG. 38*b*) shows an example of simultaneous production of an A4 product or alternatively, of a tabloid product and a newspaper-like product in broadsheet configuration "v" of the printed image in a newspaper-like format Z or A2 forma [-]], such as, for example, as an advertisement insert or as a small newspaper. In this example, for example, four of the "ribbons", that are each two A4 pages wide, are imprinted in the manner of pages in newspaper format Z. These four "ribbons" need not be cut into four, and may instead be cut into only two web ribbons "bx"; "by"; "bz", which are two pages in width, and the two web ribbons "bx"; "by"; "bz", which are each two newspaper pages in width, are guided, one above the other, over a fold former 708, and before entering the folding unit 800.2.

Figure 38:
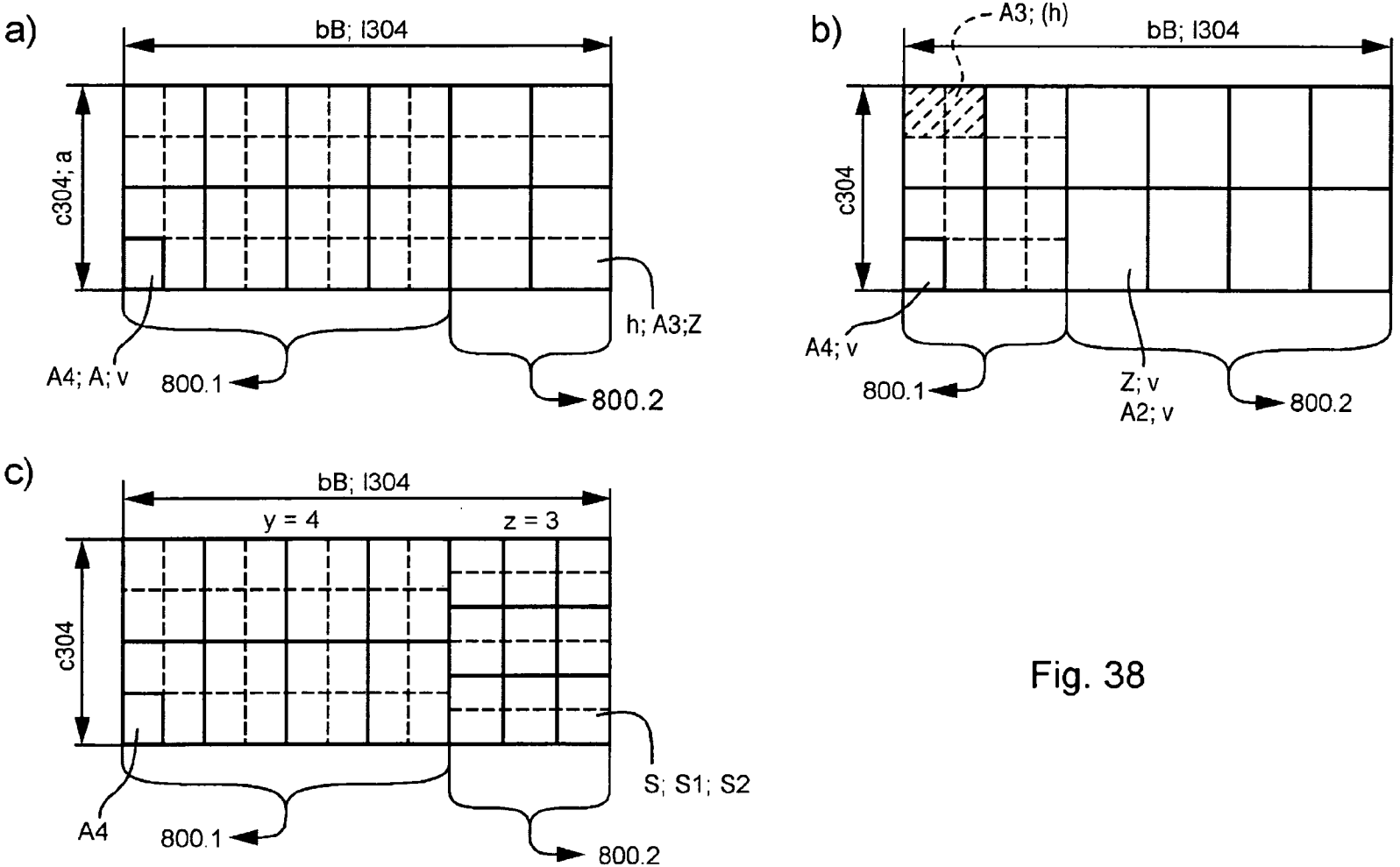
FIG. 38*a*), *b*) and *c*) examples of heterogeneous printing image configurations loaded on the forme cylinder or a heterogeneous printing image from one cylinder revolution on an uncut web.
Figure 39:
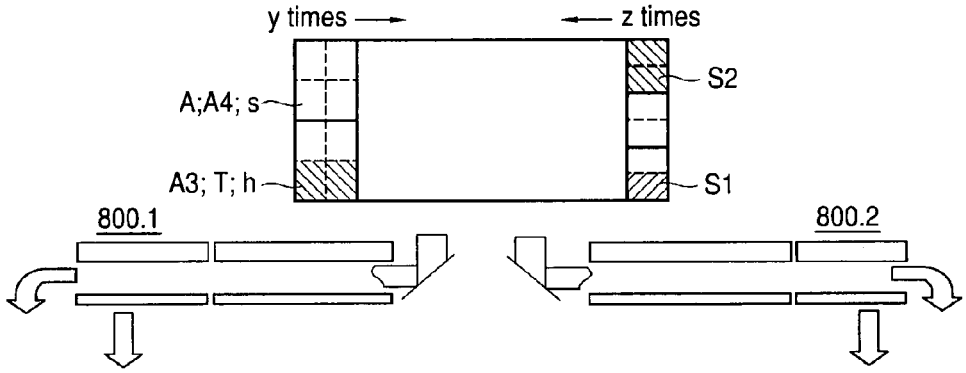
FIG. 39 an illustration of the production possibilities on a double-circumference press with heterogeneous printing image configurations on two folding units or two groups of folding cylinders.

In a variation of the subject invention, which is illustrated, by way of example, in FIG. 38*c*), in addition to the standard A4 product, with a printed page of format A, for example, with, for example, a number that is a multiple of two in the circumferential direction, for example, an additional format which is different from the A4 format, such as, for example, a special format S, for example, with a number of printed pages in the circumferential direction which corresponds to a multiple of three, in this case with three printed pages of a vertical special format S2 in the circumferential direction, or with six printed pages of a horizontal special format S1, as is also depicted in FIG. 39, are imprinted simultaneously onto the web B; B', and are processed in two folding units 800.1; 800.2. In the direction of the width of the forme cylinder 304, the printed images can extend, but need not necessarily extend up to the end of the effective cylinder body. This production variation is particularly to be used in connection with a folding unit having a variable cut length. For instance, the first folding unit 800.1 is embodied as a fixed-format pin-and-fold unit for a fixed, standard format, for example, DIN A4 format A4, and the second folding unit 800.2 is embodied, for example, as a variable-format folding unit 800.2. The latter can be operated with the corresponding requirements, based upon the operating mode and the loading configuration, either homogeneous or inhomogeneous, of the machine.

FIG. 39 shows an overview of advantageous production options, based upon the principle of mixed production from FIG. 38*c*), with printed pages on the forme cylinder 304 which differ either in terms of format and/or orientation. In this manner, partial products that are listed in the same row of the two tables, for example, can be produced simultaneously from the same web B; B'. On the one folding unit 800.1, for example, a number "y" of partial webs by can be produced to form customary products in DIN A4 format A4. From a number "z" of partial webs "bz" from the same imprinted web B; B', products containing horizontal or vertical printed pages of a special format S1; S2, or also of a format that is different from the first format A4, such as, for example, format A3 or even A2, can be produced on the other folding unit 800.2. The corresponding number "z" of partial webs "bz" is then determined by the page width of the print image of special format S; S1; S2 or of format A2; A3 and/or by its alignment v; h, and, if applicable, by whether the printing couple cylinders 304; 303 are embodied with an addition to the width b304, which is defined by the nominal width of the maximum number of DIN A4 pages to be imprinted side by side. In the table, the example of FIG. 38*c*) is marked, by way of example, wherein, in this table row, y=4 partial webs "by" are imprinted and processed in format A4 with vertical orientation v, and z=3 partial webs "bz" are imprinted and processed in a horizontal special format S1 or in a vertical special format S2. In this case, the first folding unit 800.1 is embodied, for example, as a fixed-format folding unit 800.1 with a cut length which corresponds essentially to two vertical pages in format A4, or to half of the circumference c304 of forme cylinder 304, on the transport cylinder 801. The other folding unit 800.2 is embodied either as a variable-format folding unit 800.2 or as having a cut length which corresponds to the special format S1; S2, of, for example, one-third the circumference c304 of the forme cylinder 304.

In another advantageous production example which is marked, as seen in corresponding table rows, y=3 partial webs are imprinted and are processed to form two uncollected 24-page products in format A4, for example, or one collected 48-page product in format A4 in a vertical orientation v, or to form two uncollected 12-page products in format A3 or T, or a collected 24-page product in format A3 or T in a horizontal orientation. Depending upon the page width of the second format, for example, special format S; S1; S2 or another format A2; A3, z=3 or z=4 or z=5 partial webs "bz" in a horizontal special format S1 or in a vertical special format S2 are imprinted and are processed to form products having a corresponding number of pages, which are collected or uncollected, depending upon the operating mode. For z=3 partial webs "bz", the page numbers can then be, for example, three uncollected products, with 12 pages each, or can be one collected product with 36 pages each in the horizontal special format S1. For z=4 partial webs "bz", the number of pages can advantageously be three uncollected products with 16 pages each, or can be one collected product of 48 pages in horizontal special format S1. Other alternative product possibilities result from the tables in the manner described by way of example.

Of advantage is one embodiment, in which, from one web B, multiple partial webs support for four vertical printed pages of a first format A; A4, particularly with DIN A4 format A4, in the circumferential direction of the forme cylinder 304 or per printing length, and support for multiple partial webs "bz", with six horizontal printed pages of a second format A, for example, a DIN-A format A5, particularly, for example, a special format S1, in the circumferential direction of the forme cylinder 304 or per printing length is provided. These different partial webs are each fed, as a bundle, into a different of two folding units 800.1; 800.2, as has been discussed above.

One advantageous embodiment, which is not specifically illustrated here, has a number "y" of partial webs "by" with, for example, pages in format A4 as described above, whereas a number "z" of partial webs "bz", as illustrated schematically in FIG. 38*b*), and with, for example, one vertical newspaper- or journal-like format Z in a vertical orientation, has, for example, three vertical pages, one in front of the other. In this case, it can be expedient to guide these partial webs "bz" over a fold former 708, before they are fed to the folding unit 800.2 downstream to form a cross fold. One or more of these second partial webs "bz" can then have a width, upstream of the fold former 708, which has two printed pages of format Z side by side.

Figure 40:
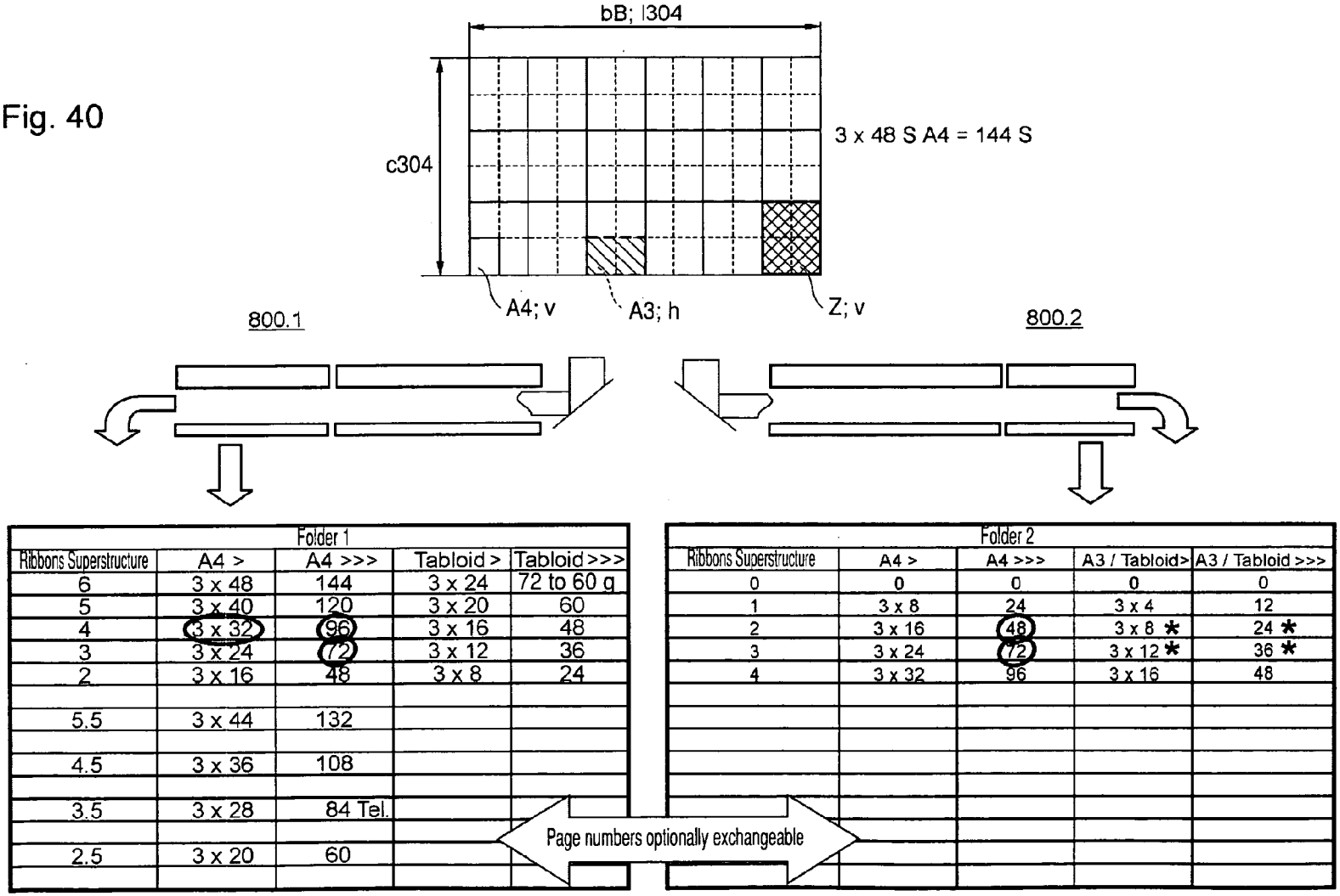
FIG. 40 an illustration of the production possibilities on a triple-circumference press with two folding units or two groups of folding cylinders.

In FIG. 40, the conditions for production possibilities correspond to those described above in relation to FIG. 37, but for a printing couple line M, the printing couple cylinders 303; 304 of which have a width of 12 and a circumference of six vertical DIN A4 pages, for dimensions, see the above discussion, for example, and two folding cylinder groups and two delivery points are situated downstream of the two folding units 800.1; 800.2 or of the one folding unit 800. Once again, at the top center of the figure, a grid for loading the forme cylinder with vertical DIN A4 print images is shown, with diagonal hash marks indicating an example of a tabloid page T, and with cross hatching indicating an example of a vertical printed page in a DIN A2 or a corresponding newspaper format Z.

The principles which are presented in FIG. 38 can be applied directly to this case, wherein, due to the larger circumference, a correspondingly larger number of the pages shown in the respective format A4; T; Z; S are to be arranged in the circumferential direction. In an operating situation which is comparable to that of FIG. 38*c*), a number of printed pages corresponding to a multiple of four, in this case, for example, four or eight printed pages in the circumferential direction, with corresponding page lengths in the circumferential direction, can be provided here as special format S, for example. At the same time, a standard format, for example, A4, is imprinted with six printed pages on the circumference.

In the special, aforementioned embodiment involving an infeed of two webs B1; B2 through the printing units 300 side by side, in the aforementioned examples the one longitudinal slitting between two web ribbons "bx"; "by"; "bz" can be dispensed with, because the butt joint between the two webs B1; B2 extends here.

While preferred embodiments of a web-fed offset printing press and a method for operating the web-fed offset printing press, in accordance with the present invention, have been set forth fully and completely hereinabove, it will be apparent to one of skill in the art that various changes in, for example, the specific structure of the printing couple cylinders, their cooperating inking unit and dampening units, the specific types of plate and clamping mechanism, and the like, could be made without departing from the true spirit and scope of the present invention which is accordingly to be limited only by the appended claims.

What is claimed is:

1. A web-fed offset printing press comprising a plurality of I-type printing units (300) embodied as blanket-to-blanket printing units, through which a web (B; B') passes essentially in a horizontal direction, a multiple folding unit assembly (800) having at least one first folding unit (800.1) and at least one second folding unit (800.2), each of said at least one first folding unit and said at least one second folding unit being adapted for forming a cross fold, wherein each of the printing units (300) has at least one forme cylinder (304) and one transfer cylinder (303) that interacts with the web (B; B'), wherein an effective cylinder width of the forme cylinder (304) has a width which corresponds to the printing images of at least x=8 vertical or horizontal printed pages in a DIN A4 format (A4), characterized in that a first number x; y; z of first web ribbons (bx; by; bz), produced by slitting the web (B; B'), are fed to said at least one first folding unit (800.1, to form a first cross fold, and at the same time, a second number y; x of second web ribbons (bx; by; bz), produced by slitting the same web (B; B'), are fed to said at least one second folding unit (800.2), to form a second cross fold, and further wherein, in one operating mode, said at least one forme cylinder carries, in its longitudinal direction, and arranged longitudinally side by side, first printing images of one of a first orientation and format and second printing images of one of a second orientation and format, said first printing images having a first forme cylinder circumferential length and said second printing images having a second forme cylinder circumferential length different from said first forme cylinder circumferential length.

2. The web-fed offset printing press according to claim 1, characterized in that in one operating situation, the forme cylinder (304) carries one of a first number of four and six printing images of a first format (A; A2; A3; A4; S; Z) on one longitudinal section of its outer surface, one in front of the other in the circumferential direction, and at the same time carries half of this first number of printing images of a second format (A; A2; A3; A4; S; Z) in another longitudinal section, one in front of the other in the circumferential direction.

3. The web-fed offset printing press according to claim 1, characterized in that in one operating situation, a first number (y) of web ribbons (by) produced from one web (B; B') carries a number of at least one of four and six printing images of a first format (A; A2; A3; A4; S; Z), one in front of the other over a printing length (a), and a second number (z) of partial webs (bz) produced from the same web (B; B') carries half the first number of printing images of a second format (A; A2; A3; A4; S; Z), one in front of the other, over a printing length (a).

4. The web-fed offset printing press according to claim 1, characterized in that the at least one forme cylinder (304) carries a first number of printing images of a first format (A; A2; A3; A4; Z; S) which first number of printing images corresponds to n times (n c N) three, on one longitudinal section, and at the same time carries a second number of printing images of a second format (A; A2; A3; A4; Z; S), which second number of printing images is not divisible by three, one in front of the other in the circumferential direction, on a second longitudinal section.

5. The web-fed offset printing press according to claim 4, characterized in that the at least one forme cylinder (304) carries six printing images of a first format (A; A2; A3; A4; Z; S), one in front of the other, on said one longitudinal section, and at the same time carries one of four and eight printing images of a second format (A; A2; A3; A4; Z; S), one in front of the other in the circumferential direction, on said second longitudinal section.

6. The web-fed offset printing press according to claim 1, characterized in that the at least one forme cylinder (304) carries a single printing forme (333) on its outer surface, on which all printing images to be printed are arranged.

7. The web-fed offset printing press according to claim 1, characterized in that a width of the first web ribbon (bx; by; bz) is different from a width of the second web ribbons (bx; by; bz).

8. The web-fed offset printing press according to claim 1, characterized in that at least one of the at least first and second folding units (800.1; 800.2) is embodied as a folding unit with a variably adjustable cut length (a).

9. The web-fed offset printing press according to claim 1, characterized in that the at least first and second folding units (800.1; 800.2) are embodied with cut lengths (a) on a transport cylinder of each folding unit (801) that differ from one another.

10. The web-fed offset printing press according to claim 1, characterized in that the at least first and second folding units (800.1; 800.2) are embodied as folding units (800.1; 800.2) of different types, particularly as two of the different types including a pin-and-fold unit, a folding jaw unit, and a rotary folding unit.

11. The web-fed offset printing press according to claim 1, characterized in that a first bundle consisting of first web ribbons (bx; by; bz) is fed to one of the at least first and second folding units (800.1; 800.2) without passing through a fold former (708), and a second bundle consisting of second web ribbons (bx; by; bz) is fed to the other of the at least first and second folding units (800.1; 800.2) after passing through a fold former (708).

12. The web-fed offset printing press according to claim 11, characterized in that the first web ribbons (bx; by; bz) have printed pages of a first format (A; A2; A3; A4; Z; S) imprinted in a horizontal orientation (h) on the forme cylinder (304), and the second web ribbons (bx; by; bz) have printed pages of a second format (A; A2; A3; A4; Z; S) imprinted in a vertical orientation (v) on the forme cylinder (304).

13. The web-fed offset printing press according to claim 7, characterized in that to produce a heterogeneous product, particularly a popup product having a part which projects beyond the remaining layers, at least one first web ribbon having a first web ribbon width (bx; by; bz) and one second web ribbon having a second web ribbon width (bx; by; bz) which is different from said first web ribbon width, are fed together to a folding unit (800.1; 800.2).

14. The web-fed offset printing press according to claim 1, characterized in that the forme cylinder (304) has a width that corresponds to the width of eight, particularly horizontal, printed pages in a DIN A4 format (A4) and a circumference that corresponds to the length of six, particularly horizontal, printed pages in a DIN A4 format (A4).

15. The web-fed offset printing press according to claim 1, characterized in that the forme cylinder (304) has a width that corresponds to the width of twelve, particularly vertical, printed pages in a DIN A4 format (A4) and a circumference that corresponds to the length of four, particularly vertical, printed pages in a DIN A4 format (A4).

16. The web-fed offset printing press according to claim 1, haracterized in that the rotational axes of the forme and transfer cylinders (304; 303) of a printing unit (300) are embodied as lying essentially within a shared plane (E) in a print-on position of the web-fed offset printing press.

17. The web-fed offset printing press according to claim 1, characterized in that the forme and transfer cylinders (304; 303) of the printing unit (300), which are to be moved with respect to a print-on/print-off adjustment, are arranged in bearings with a linear adjustment path (L).

18. The web-fed offset printing press according to claim 1, characterized in that the forme cylinder (304) has at least one groove (331) which extends continuously over the effective cylinder length (L304), and which is usable for fastening one of one printing plate (333) which is continuous over the length and multiple printing plates (333) arranged side by side.

19. The web-fed offset printing press according to claim 1, characterized in that at least one reel changer (100) is situated upstream of the printing units (300), and wherein a support (103) of said reel changer, which supports a reel (104; 106), can be swiveled by means of drive motors (112) acting at both of its sides.

20. The web-fed offset printing press according to claim 1, characterized in that at least one reel changer (100) is situated upstream of the printing units (300), and wherein a support (103) of said reel changer has a braking device (107), which can be placed in direct contact with the reel (104; 106), in the manner of a friction wheel.

21. The web-fed offset printing press according to claim 1, characterized in that two reel changers (100) are situated upstream of the printing units (300) of a printing couple line (M), through which, at the same time, two webs (B; B'), each of which is narrower than the usable cylinder width, can be fed side by side to the printing units (300).

22. The web-fed offset printing press according to claim 1, characterized in that a superstructure (700) has a slitter (701) comprising a plurality of blade units (705), which plurality of blade units are individually movable transversely to the direction of the incoming web (B; B').

23. The web-fed offset printing press according to claim 22, characterized in that at least x−1 blade units (705) are provided side by side.

* * * * *